US005870114A

United States Patent [19]

Numata et al.

[11] Patent Number: 5,870,114

[45] Date of Patent: Feb. 9, 1999

[54] IMAGE RECORDING APPARATUS WITH IMPROVED CONVEYING SYSTEM FOR RECORDING MEDIUM

[75] Inventors: Yasuhiro Numata, Kawasaki; Yoshiaki Takayanagi; Akio Takeda, both of Yokohama; Hideaki Takada, Kawasaki; Tsuyoshi Ohtani, Machida, all of Japan

[73] Assignee: Canon Kabushiki Kaisha, Tokyo, Japan

[21] Appl. No.: 17,732

[22] Filed: Feb. 10, 1993

[30] Foreign Application Priority Data

| | | | |
|---|---|---|---|
| Feb. 12, 1992 | [JP] | Japan | 4-025425 |
| Feb. 14, 1992 | [JP] | Japan | 4-028229 |
| Apr. 20, 1992 | [JP] | Japan | 4-099267 |
| Jun. 1, 1992 | [JP] | Japan | 4-140561 |

[51] Int. Cl.[6] ..... B41J 2/01

[52] U.S. Cl. ..... 347/16; 347/104; 250/208.2; 250/208.6; 250/548; 271/228; 399/389; 399/395; 400/708

[58] Field of Search ..... 347/16, 104, 19, 347/5, 14; 355/206, 311; 271/227, 228; 400/578, 579, 706, 708, 708.1; 358/448, 449; 399/370, 371, 367, 389, 395; 200/548, 206.1, 208.2, 208.6

[56] References Cited

U.S. PATENT DOCUMENTS

| | | | |
|---|---|---|---|
| 4,272,204 | 6/1981 | Quinn, Jr. et al. | 400/708 |
| 4,453,166 | 6/1984 | Enoto . | |
| 4,564,861 | 1/1986 | Hishinuma et al. | 358/448 |
| 4,625,216 | 11/1986 | Brooks et al. . | |
| 4,639,152 | 1/1987 | Yamamoto et al. . | |
| 4,672,465 | 6/1987 | Ono | 355/311 |
| 4,723,129 | 2/1988 | Endo et al. | 347/56 |
| 4,855,607 | 8/1989 | Eckl | 371/227 X |
| 4,922,350 | 5/1990 | Rombola et al. | 358/449 |
| 5,128,717 | 7/1992 | Uchikawa et al. | 355/208 |
| 5,139,339 | 8/1992 | Courtney et al. | 355/311 |
| 5,149,941 | 9/1992 | Hirabayashi et al. | 219/216 |
| 5,198,853 | 3/1993 | Ichihara et al. | 355/311 X |
| 5,228,099 | 7/1993 | Yamada | 358/449 |
| 5,290,027 | 3/1994 | Clanton et al. | 271/227 |

FOREIGN PATENT DOCUMENTS

| | | | |
|---|---|---|---|
| 254454 | 1/1988 | European Pat. Off. . | |
| 452585 | 10/1991 | European Pat. Off. . | |
| 452585A3 | 10/1991 | European Pat. Off. . | |
| 59-104981 | 6/1984 | Japan | 347/14 |
| 60-257279 | 12/1985 | Japan . | |
| 61-041567 | 2/1986 | Japan . | |
| 61-41567 | 2/1986 | Japan . | |
| 63-54270 | 8/1988 | Japan . | |
| 63-216779 | 9/1988 | Japan . | |
| 1-53890 | 3/1989 | Japan . | |
| 1-64862 | 3/1989 | Japan . | |
| 1-218865 | 9/1989 | Japan | 400/579 |
| 2-086486 | 3/1990 | Japan . | |
| 3-275 | 1/1991 | Japan . | |
| 3000275 | 1/1991 | Japan . | |
| 4-148945 | 5/1992 | Japan . | |

*Primary Examiner*—John E. Barlow, Jr.
*Assistant Examiner*—Charles Stewart, Jr.
*Attorney, Agent, or Firm*—Fitzpatrick, Cella, Harper & Scinto

[57] ABSTRACT

An image recording apparatus for controlling an image recording operation on the basis of a detected width of a recording medium by a paper width detecting means after the recording medium is fed to a predetermined position on a platen. Whether the recording medium is desirably conveyed or not is determined on the basis of a signal obtained by said paper width detecting means.

33 Claims, 45 Drawing Sheets

IMAGE RECORDING APPARATUS WITH IMPROVED CONVEYING SYSTEM FOR RECORDING MEDIUM

BACKGROUND OF THE INVENTION

1. Field of the Invention

The present invention relates to an image recording apparatus for recording an image on a recording medium.

2. Related Background Art

In a conventional recording apparatus, such as an ink jet recording apparatus, a paper feeding means comprising a pair of rollers etc. is disposed in the upstream side of the platen with respect to a conveying direction in which a recording medium such as a recording paper or a clear sheet for OHP is supplied along the platen, while in the downstream side of the platen a paper discharge means comprising a pair of rollers etc. is disposed. Further, in the vicinity of the paper feeding means and the paper discharge means, a paper feeding sensor and a paper discharge sensor are provided, respectively, for detecting the presence of the recording medium. A recording head is mounted on a carriage reciprocally moving between the paper feeding means and the paper discharging means in the direction perpendicular to the conveying direction (hereinafter referred to as "paper width direction"), the recording head being opposed to the recording medium on the platen with a predetermined space therebetween. A paper width sensor is provided near a recording head of the carriage to read out a difference between a reflecting light amount from the platen and that from the recording medium to detect a width of the recording medium (hereinafter referred to as "paper width") and a kind of the recording medium (hereinafter referred to as "paper kind").

A method for controlling such an ink jet recording apparatus will now be described.

(1) Normal Mode

In this mode, firstly, the recording medium is fed by the paper feeding means along the platen by a paper feeding amount required to make the rear end of the recording medium reach the paper discharging means from a position detected by the paper feeding sensor disposed at the upstream side of the platen. At this time, the presence of the recording medium is detected by the paper discharging means disposed at the downstream side of the platen. If the detected result shows an absence of any recording medium, an indication is made to inform generation of jamming by judging that the recording medium does not reach the paper discharging means. If the paper discharging sensor detected that the recording medium is present, it is considered that the recording medium reaches the paper discharge means and then the carriage is moved to detect the paper width and the paper kind. Thereafter, the recording operation starts.

In this normal mode, a large blank area where nothing is recorded is generated due to the distance between the rear end of the recording medium and the position where the recording head records. Therefore, there has been proposed a leading and rear end mode in which the recording operation is started from a position immediately near the rear end of the recording medium, without producing a large blank.

(2) Leading and Rear End Mode

In this mode, firstly, the recording medium is fed toward the platen by the paper feeding means, and the paper feeding sensor judges whether the rear end of the recording medium has reached the paper feeding sensor. If the sensor detects no paper, the paper feeding operation continues. If paper is detected, the rear end of the recording medium is fed in the conveying direction along the platen by the paper feeding means by a predetermined paper feeding amount A required to make the rear end of the recording medium pass over the recording position of the recording head. Next, the carriage is moved in the paper width direction to detect the paper width and the paper kind by the paper width sensor, and the resulting signal pattern therefrom will be used to judge the paper kind. If the paper width sensor is judged as being abnormal, it is informed. Otherwise, a signal indicating that the paper is a predetermined recording paper or a clear sheet for OHP is output to judge the paper width, and thereafter, the recording operation starts.

In the method for controlling the ink jet recording apparatus described above, in the normal mode it is possible to judge by the paper discharging sensor if the recording medium is correctly supplied to the paper discharging means. But in the leading and rear end mode, even if the recording paper is correctly fed by a predetermined paper feeding amount, the rear end of the recording medium does not reach the paper discharging means, leading sometimes to a case in which it is not possible to judge by a sheet exhaust sensor or a paper discharging sensor if the recording medium is correctly fed.

Further, in either mode, in order to perform a successive recording operation, it is necessary to delicately adjust the rotating angle of the driving motor and the ink outlet opening at the time of stepping feeding in which the sheet member passes out from the conveying upper and lower rollers 7, 8, for increasing the interfacing accuracy particularly after completing the recording operation for one sheet for shifting to the next sheet. For this purpose, it is indispensable to accurately detect the remaining amount of the rear end of the sheet member from the conveying upper and lower rollers 7, 8.

Therefore, the number of stepped feedings of the sheet member by the conveying roller from the sheet member is detected as one of fixed sizes on the basis of the number of stepped feedings until the rear end of the sheet member passes trough the paper sensor, thereby judging the remaining amount of the rear end of the sheet member. This method, however, has the following disadvantage.

That is, there would arise cases where any optimum controlling operation in accordance with the remaining amount at the respective rear end of each sheet member becomes impossible. Such cases include one in which an indefinite sheet member passes through the paper sensor by accidentally the same number of stepped feedings as that for a definite size sheet member, and another case in which the paper sensor undesirably detects the rear end by the same number of times for the stepped feedings when the difference of length of sheet members between one of A5 size (148×210 mm) and 5.5×8.5 inches (139.7×215.9 mm), in this case, the difference being 5.9 mm, is less than the feeding amount for one step. As a result, it becomes impossible to perform the optimum controlling operation corresponding to the remaining amount of the rear end of the respective sheet member.

Further, in addition to the problem of the paper feeding accuracy, a disadvantage is that white lines between an image recorded at the first line and an image recorded at the second line due to the floating of the paper on the platen when the paper is conveyed.

Namely, although the paper is conveyed through the paper feeding rollers and the paper discharging rollers, the rear end of the paper would not smoothly enter into a pair of paper discharging rollers so as to float on the platen due to the rolling at the rear end of the paper when the rear end of the paper is supplied into the paper discharging rollers.

SUMMARY OF THE INVENTION

It is therefore an object of the present invention to provide a reliable image recording apparatus using a structure being capable of accurately judging the state of feeding a recording medium without needing any complicated composition.

It is another object of the present invention to provide an image recording apparatus being capable of performing a high-quality image recording operation by securely feeding the recording medium.

According to an aspect of the present invention, an image recording apparatus is provided for controlling an image recording operation on the basis of the width of a recording medium detected by a paper width detecting means after feeding the recording medium to a predetermined position on a platen, the recording medium conveying state being judged on the basis of a signal from said paper width detecting means.

According to another aspect of the present invention, an image recording apparatus comprises: conveying means for conveying a sheet member; recording means for recording an image on the sheet member conveyed by said conveying means; first detecting means for detecting the width of the sheet member; second detecting means for detecting the rear end of the sheet member at the upstream side of said recording medium; and control means for controlling at least one of a conveyed amount by said conveying means and recording area of said recording means on the basis of information in accordance with the width of the sheet member detected by said first detecting means and with the conveyed amount of the sheet member until the rear end of the sheet is detected by said second detecting member.

According to another aspect of the present invention, an ink jet recording apparatus comprises: conveying means for conveying a recording paper along a platen to a predetermined position thereon; paper holding means for preventing the paper from floating on the platen; and carriage means for mounting a recording head to be opposed to the platen with a predetermined space therebetween, and moving in the direction perpendicular to the conveying direction.

According to another aspect of the present invention, a recording apparatus for performing a recording operation on a medium disposed on a predetermined recording position by a predetermined recording method, comprises: light-emitting means for generating light and emitting it to a predetermined detecting position; detecting means for receiving light generated by said light-emitting means which is reflected at random at the detecting position but not regularly reflected; and recognizing means for recognizing the presence and the kind of the recording medium at the detecting position from the intensity of the light detected by said detecting means.

The above and other advantages, features and additional objects of the present invention will be manifest to those versed in the art upon making reference to the following detailed description and the accompanying drawings in which the structural embodiment incorporating the principles of this invention is shown by way of illustrative example.

BRIEF DESCRIPTION OF THE DRAWINGS

FIGS. 5A and 5B are diagrams showing a potential recording area in the normal mode and in the leading and rear end mode of the first embodiment, in which FIG. 5A is in the normal mode while FIG. 5B is in the leading and rear end mode.

DETAILED DESCRIPTION OF THE PREFERRED EMBODIMENTS

Figure 1:
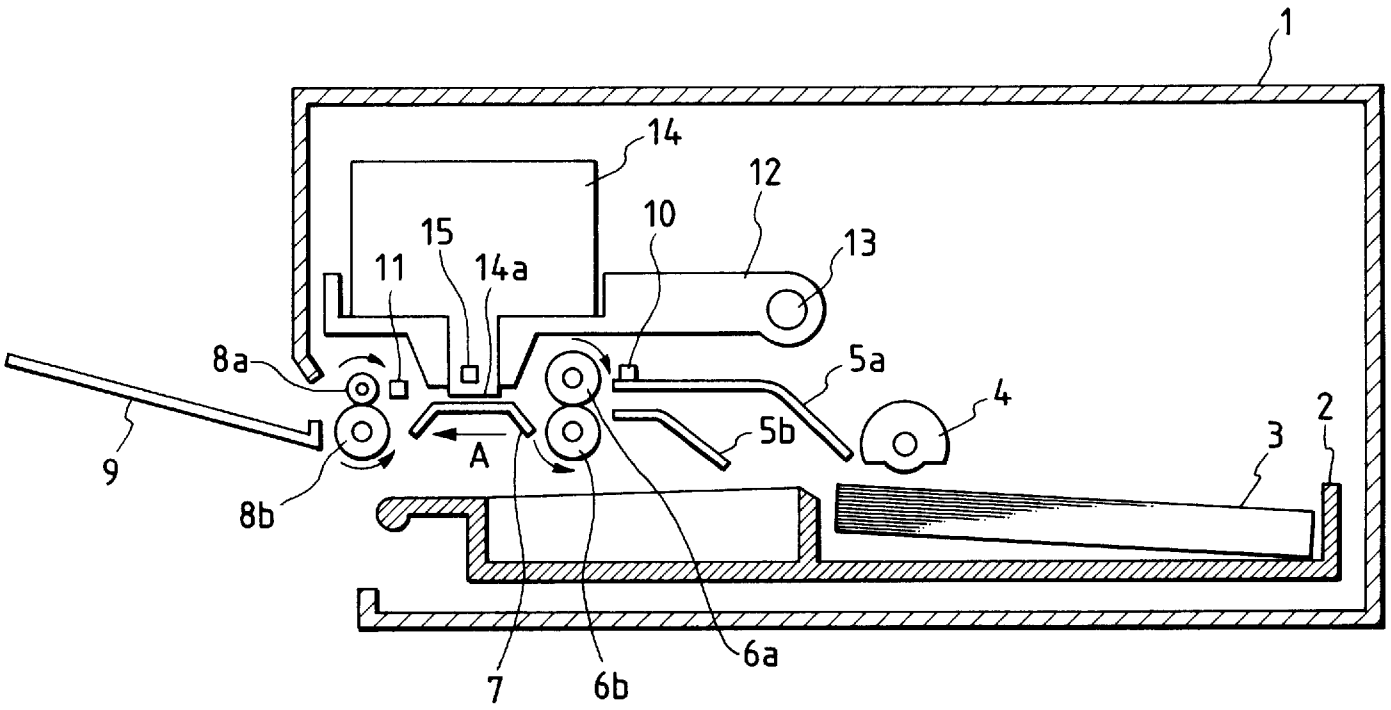
FIG. 1 is a cross-sectional view of a first embodiment of an ink jet recording apparatus according to the present invention.
Figure 2:
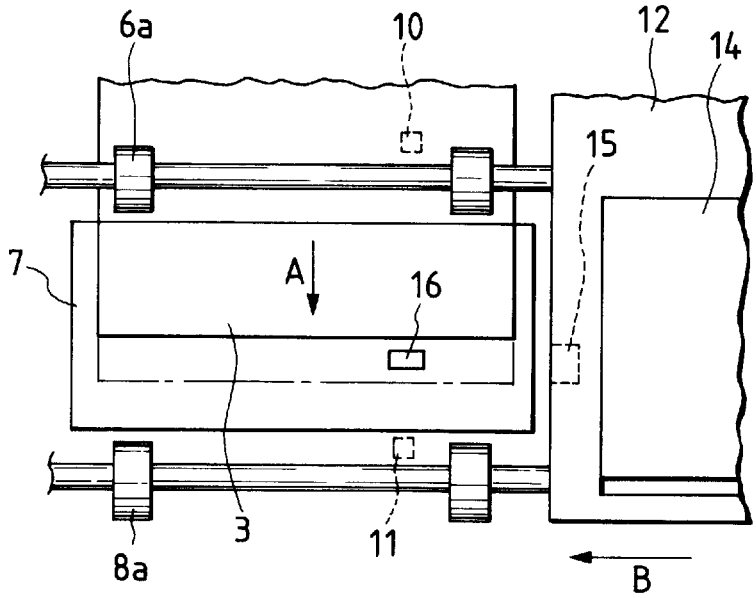
FIG. 2 is a plan view showing a platen part of the first embodiment.
Figure 3:
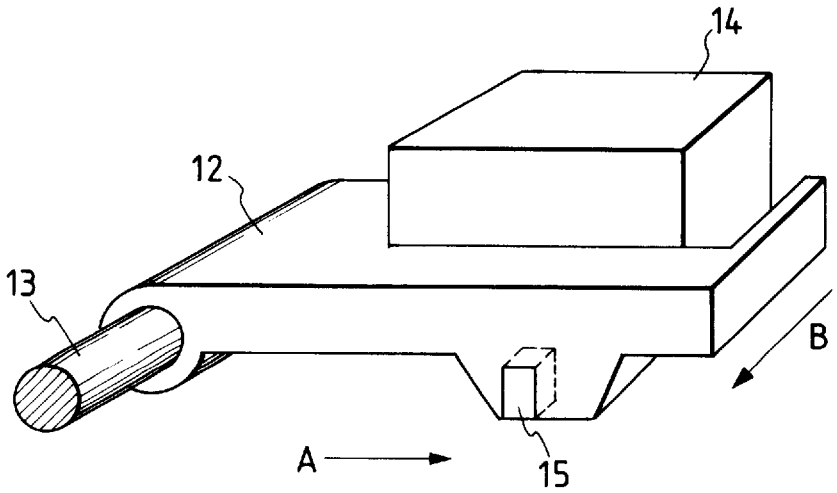
FIG. 3 is a perspective view of a carriage in the first embodiment.

FIG. 1 is a cross-sectional view of a first embodiment of an ink jet recording apparatus according to the present invention, FIG. 2 is a plan view of platen parts of the same embodiment, and FIG. 3 is a perspective view of a carriage of the same embodiment. The first embodiment of the present invention will now be described with reference to those drawings.

As shown in FIG. 1, at the bottom of the body 1, a cassette 2 incorporating a recording medium 3 such as a coated paper (a paper with a coating on its surface for promoting the absorption of ink) cut out in a predetermined magnitude or a clear sheet for overhead projection (OHP) is removably mounted thereon. Above an end of the recording medium 3, a pick-up roller 4 is disposed with two guide plates 5*a*, 5*b* in a vicinity thereof. At the left-hand side of the guide plates 5*a*, 5*b* in the drawing, a pair of paper feeding rollers 6*a*, 6*b* as paper feeding means, a platen 7 and a pair of paper discharging rollers 8*a*, 8*b* as paper discharging means are sequentially disposed in a row. A conveying means is composed of this paper feeding means and the paper discharging means. At the left-hand side of the pair of paper discharging rollers 8*a*, 8 *b* in the drawing, a paper discharging tray 9 is removably mounted on the body 1 as projecting externally. In the guide plate 5*a,* a paper feeding sensor 10 is disposed close to the paper feeding roller 6*a,* while a paper discharging sensor 11 is disposed at a position close to the right-hand side of the paper discharging roller 8*a* in the drawing (see FIG. 2). Each of the paper feeding sensor 10 and the paper discharging sensor 11 is composed as a type for reading out a reflecting light from the recording medium by a reflective photosensor disposed to face the recording medium 3, or a type for detecting a shift of a lever movable in contact with the recording medium 3 by a photosensor or a microswitch. Although not shown, a movable lever of the paper discharging sensor 11 is disposed in a vicinity of the paper discharging tray 9 side of the paper discharging roller 8*a* for detecting the rear end of the recording medium having been manually inserted through the paper discharging tray 9 in a case of manually inserting a recording case as mentioned later.

The carriage 12 is slidably coupled to a guide shaft 13 mounted on the body 1 parallel to the paper feeding roller 6*a,* and reciprocally moved in the paper width direction (arrow B direction and its reverse direction) perpendicular to the conveying direction (arrow A direction) being the direction for feeding the recording medium 3 on the platen 7 by a driving means such as a timing belt, a pulley and a motor which are not shown. The carriage 12 is provided with a removable recording head 14 for ejecting ink through an ejection opening (not shown) to perform the recording. An ejecting opening surface 14*a* at which the ejecting opening of the recording head 14 is opened is opposed to the platen 7 with a predetermined gap (e.g.: 0.75 mm) therebetween. Immediately near the ejecting opening surface 14*a,* a paper width sensor 15 is provided on the carriage 12, composed of a reflective photosensor for radiating light and reading the amount of the reflected light. At a part of the radiated light path of the paper width sensor 15 on the platen 7, a silver plate 16 (see FIG. 2), being nickel-plated for increasing the light amount of the reflected light, is disposed. Further, the paper width sensor 15 and the ejecting opening of the recording head 14 are separated by a distance between the rear end of the recording medium 3 and the rear end of the recording potential region 3*b* in the case of a leading/rear end mode (see FIG. 5) mentioned later.

The operation of the apparatus when the recording medium 3 is conveyed will now be described. The top recording medium 3 is fed between the two guide plates 5*a*, 5*b* by a pick-up roller 4, and the rear end thereof will reach the nip portion of the pair of paper feeding rollers 6*a*, 6*b*. Thereafter, the recording medium 3 is fed in the conveying direction (arrow A) along the platen 7 by being held between the pair of paper feeding rollers 6*a*, 6*b* which are rotating in the direction of the shown arrow (FIG. 1). The recording medium having passed through the platen 7 will be discharged to the paper discharging tray 9 after being fed by being held between the pair of paper discharging rollers 8*a*, 8*b* which are rotating in the shown arrow direction (FIG. 1) synchronously with the pair of paper feeding rollers 6*a*, 6*b*. The recording head 14, being moved by the carriage 12, ejects the ink against the recording medium 3 on the platen 7 to carry out the recording operation. Further, in the case of a manually inserting recording operation, the recording medium 3 is inserted along the paper discharging tray 9 to reach the nip portions of the pair of the paper discharging rollers 8*a*, 8*b,* which is then sensed by a movable lever (not shown) of the paper discharging sensor 11. The pair of the paper discharging rollers 8*a*, 8*b* are rotated in the reverse direction of the shown arrow direction (FIG. 1) to feed the recording medium 3 along the platen 7 in the reverse direction of the arrow A direction by a predetermined paper feeding amount. At this time, the pair of paper feeding rollers 6*a*, 6*b* also rotate in the reverse direction of the shown arrow direction (FIG. 1) in synchronicity with the pair of the paper discharging rollers 8*a*, 8*b*. After the recording medium 3 is fed to a predetermined position, the recording medium 3 is conveyed in the arrow A direction as the recording head 14 performs the recording operation to be discharged on the paper discharging tray 9.

Next, the operation to detect the paper width and the paper kind will now be described. The carriage 12 moves from a position shown in FIG. 2 to a reverse side of the platen 7 in the arrow B direction. Namely, the paper width sensor 15 moves in the arrow B direction to pass an area where the rear end of the recording medium is to be present in the case of the leading/rear end mode. During this movement, the paper width sensor 15 radiates light toward the platen 7 side to read the reflected light amount.

Figure 4A:
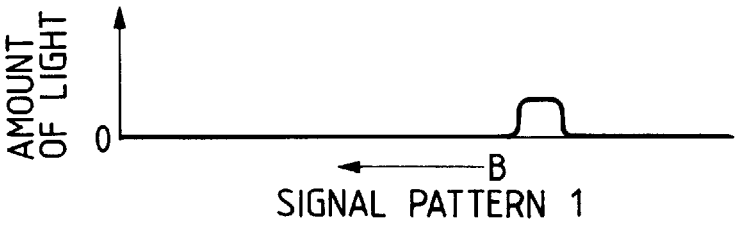
FIGS. 4A to 4D are diagrams showing signal patterns obtained from a paper width sensor in the first embodiment.
Figure 4B:
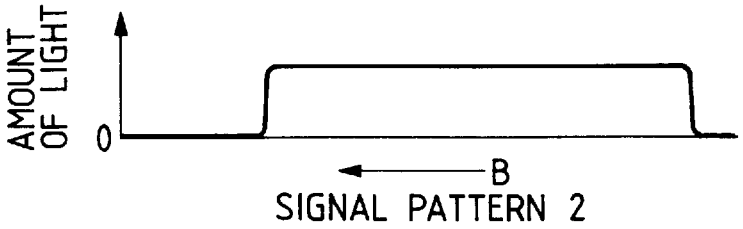
Figure 4C:
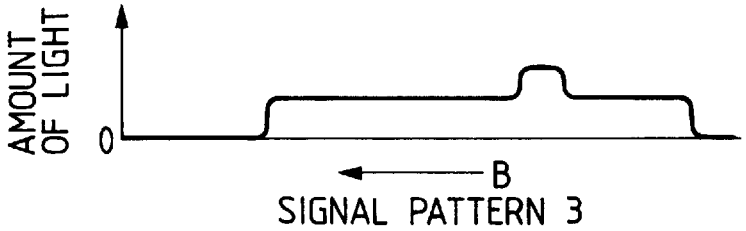
Figure 4D:
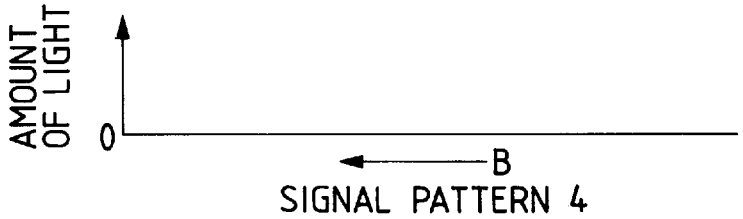

FIGS. 4A–4D show signal patterns obtained from the paper width sensor 15, in which the lateral axis corresponds to the moving path of the radiated light on the platen 7, while the transverse axis represents the light amount of the reflected light. When the recording medium 3 is in the position shown by the solid line in FIG. 2, namely when it does not yet reach the moving path of the radiated light, the signal pattern obtained by the paper width sensor 15 will be a signal pattern 1 as shown in FIG. 4A. The convex portion with a small signal pattern 1 stands for the reflected light amount from the silver plate 16 of the platen 7. In a case that the recording medium 3 is at the position shown by an alternate long and short dash line in FIG. 2, i.e., when the rear end of the recording medium 3 covers the silver plate 16 reaching a predetermined position in the leading/rear end mode, while the recording medium 3 consists of a coated paper (white), the signal pattern obtained from the paper width sensor 15 will be a signal pattern 2 shown in FIG. 4B. The convex portion of the signal pattern 2 represents the reflected light amount from the coated paper. When the recording medium 3 is a clear sheet (transparent) for OHP, the signal pattern obtained from the paper width pattern will be a signal pattern 3 shown in FIG. 4C. The wide convex portion in the signal pattern 3 stands for the reflected light amount, while the small convex portion stands for the reflected light amount of the silver plate 16 having passed the clear sheet. The case where no signal pattern is obtained as shown in FIG. 4D would suggest an occurrence of a failure in the paper width sensor 15 and the platen 7.

Figure 5A:
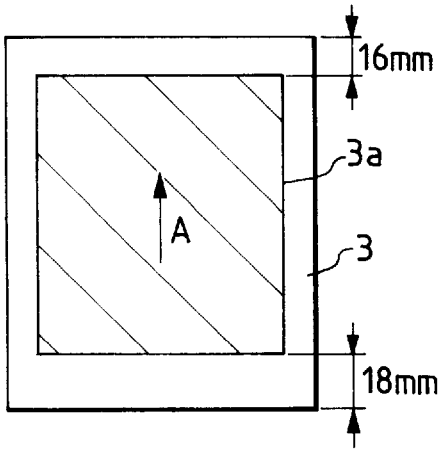
Figure 5B:
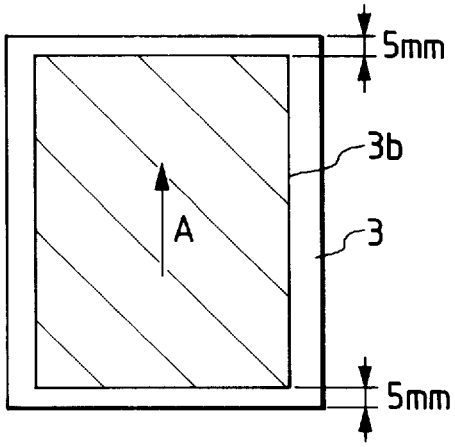
Figure 6:
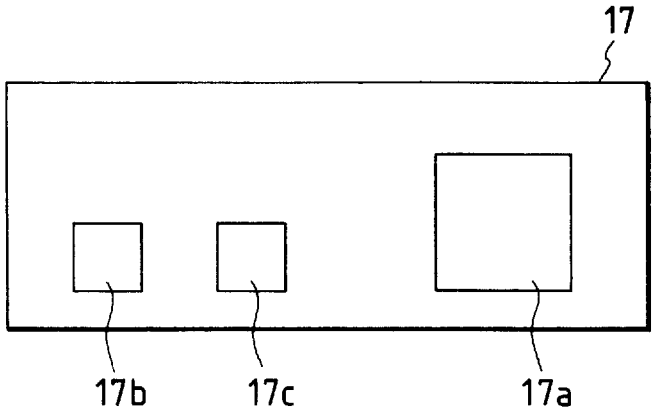
FIG. 6 is a diagram showing an operation panel of the first embodiment.

FIG. 5A shows a possible recording area in a case of a normal mode of the ink jet recording apparatus according to the present embodiment, while FIG. 5B shows a possible recording area in a case of the leading/rear end mode. The rear end of the possible recording area 3*a* (shadowed area in FIG. 5A) in the conveying direction (arrow A) is at a position internal by 16 mm from the rear end of the recording medium, while the rear end of the possible recording area 3*a* is at a position internal by 18 mm from the rear end of the recording medium 3. The rear end and the leading end of the possible recording area 3*b* (FIG. 5B) in the case of the leading/rear end mode will be at a position internal by 5 mm respectively from the leading and rear ends of the recording medium 3. The selection of the normal mode or the leading/rear end mode is carried out through a normal mode key 17*b* or a leading/rear end mode key 17*c* on the console (operation) panel 17 mounted on the body 1 (see FIG. 6). The start key 17*a* is to start recording.

Figure 7:
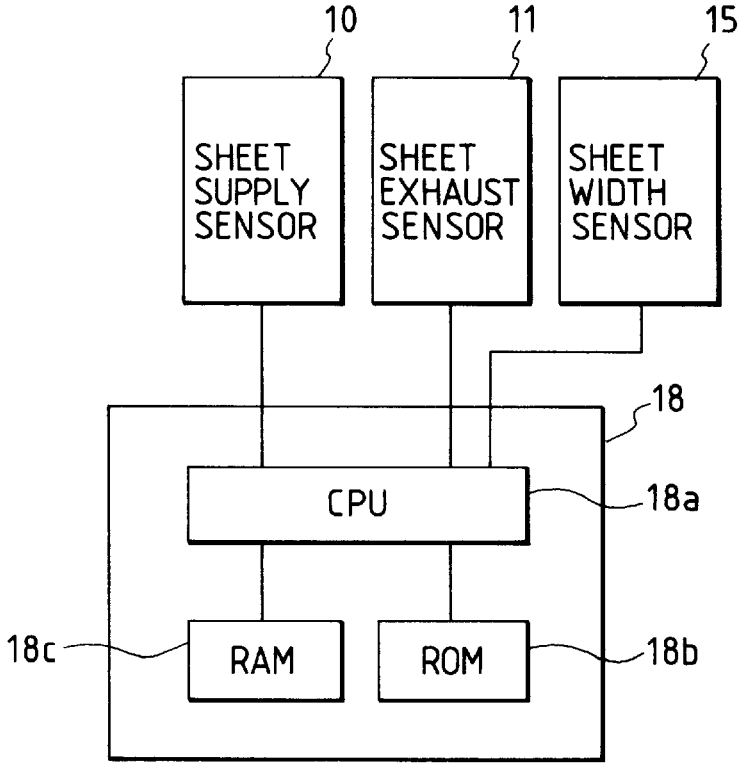
FIG. 7 is a block diagram showing a control system of the first embodiment.

FIG. 7 is a block diagram showing a controlling system of an ink jet recording apparatus according to the present embodiment. The controlling section 18 comprises a CPU 18*a* for performing the process of the first embodiment of a controlling method of the ink jet recording apparatus according to the present invention mentioned later, a ROM 18*b* for storing fixed data such as programs in accordance with the aforementioned process, and a RAM 18*c* for operation.

Figure 8:
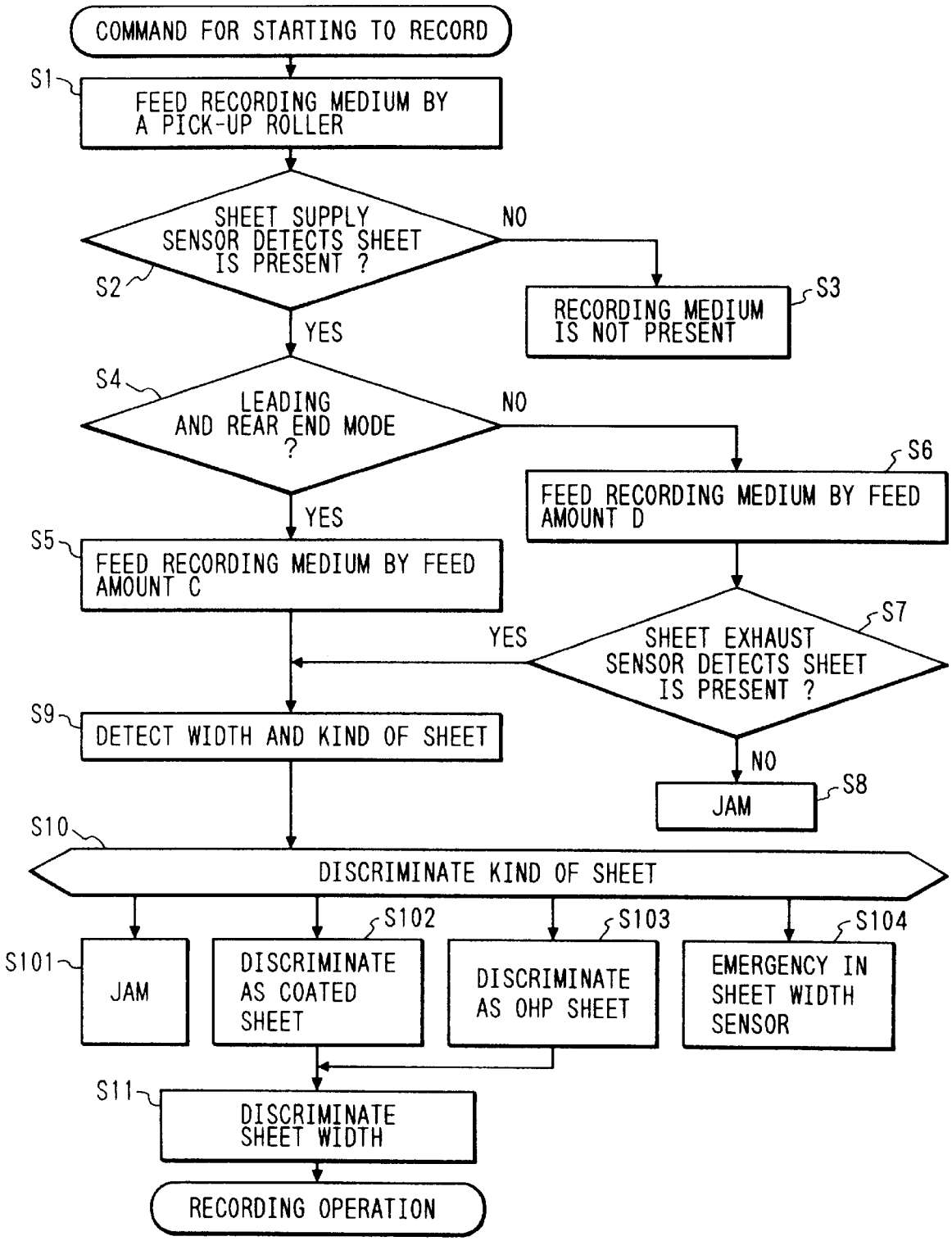
FIG. 8 is a flow diagram showing a controlling method of an ink jet recording apparatus according to the first embodiment of the present invention.

FIG. 8 is a flow diagram showing a controlling method of the ink jet recording apparatus according to the first embodiment of the present invention. The present embodiment will now be described with reference to FIG. 8.

The first embodiment of the aforementioned ink jet recording apparatus is used to carry out the present embodiment. In response to a recording start order, the recording medium 3 is supplied from the cassette 2 by the pick-up roller 4 (step S1). In step S2, the presence of the recording medium 3 is judged by the paper feeding sensor 10, and if the judged result is negative, i.e., no recording medium 3 is present, it is informed that no recording medium 3 is judged by the paper feeding sensor 10, and if the judged result is negative i.e., no recording medium 3 is present, it is informed that no recording medium 3 is in the cassette 2 (step S3), while if the judged result is affirmative, i.e., a recording medium 3 is in the cassette 2, the process is advanced to step S4. In step S4, whether the leading/rear end mode is selected is judged, and if it is in the leading/rear end mode, the operation advances to step S5 in which the recording medium 3 is fed by the pair of paper feeding rollers 6*a*, 6*b* by a paper feeding amount C necessary to make the rear end of the recording medium 3 reach a predetermined position (shown by the alternate long and short dash line in FIG. 2), and shifting then to the step S9. In the normal mode, operation is advanced to step S6 in which the recording medium 3 is fed by the pair of paper feeding rollers 6*a*, 6*b* by a paper feeding amount D required to hold the rear end of the recording medium 3 by the pair of paper discharging rollers 8*a*, 8*b*. Subsequently, in step S7, the paper discharging sensor 11 judges the presence or absence of the recording medium 3, and if it is judged to be absent, the process advances to step S8 to inform a state of jamming in which the distal end of the recording medium does not reach the paper discharging rollers 8*a*, 8*b*. If it is judged to be present, the process advances to step S9. In step S9, the carriage 12 is moved in the paper width direction (arrow B direction) to detect the paper width and the paper kind, and in step S10, the paper kind is judged on the basis of the signal pattern obtained by the paper width sensor 15. If the signal pattern is as a signal pattern 1 shown in FIG. 4A, it is judged that the recording medium 3 does not reach a predetermined position on the platen 7, and advances to step S101 to inform the occurrence of a jamming state. If the signal pattern is as a signal pattern 2 shown in FIG. 4B, the recording medium 3 is judged to be a coated paper and the process advances to step S102. If the signal pattern is as the signal pattern 3 shown in FIG. 4C, the recording medium 3 is judged to be a clear sheet and the process advances to step S103. If the signal pattern is as a signal pattern 4 shown in FIG. 4D, it is judged that a failure has occurred in the paper width sensor 15, the platen 7, the carriage 12 and the like, and the process advances to step S104 to inform of the failure. After passing through step S102 or step S103, the process advances to step S11 to judge the paper width on the bases of the signal pattern 2 or 3. Thereafter, the recording operation starts.

In a case of a manual feeding, the recording operation in leading/rear end mode will not be described. After approximately one second has passed from the detection of the recording medium 3, inserted through the paper discharging tray 9, by the movable lever (not shown) of the paper discharging sensor 11, the recording medium 3 is fed in the reverse direction of the arrow A direction by the conveying means. The recording medium 3 is continued to be fed even after the paper feeding sensor 10 has detected the presence of the medium, and when the paper discharging sensor 11 detects the absence of the paper, the recording medium 3 is fed in the reverse direction of the arrow A direction by a paper feeding amount required to move the rear end of the recording medium 3 from that position to a predetermined position for the leading/rear end mode. The subsequent steps are identical to those including and after step S9 shown in FIG. 8.

According to the method for controlling the ink jet recording apparatus of this embodiment, since the signal pattern 1 obtained by the paper width sensor 15 is used also to judge the presence or absence of the rear end of the recording medium at a predetermined position on the platen 7, the jamming state can be accurately detected even in a case of leading/rear end mode in which the paper discharging sensor 11 is unavailable. As a result, the undesirable ink-jetting action directly against the platen is prevented so as to keep the surface at the side of the platen 7 of the apparatus and the recording medium 3.

Figure 9:
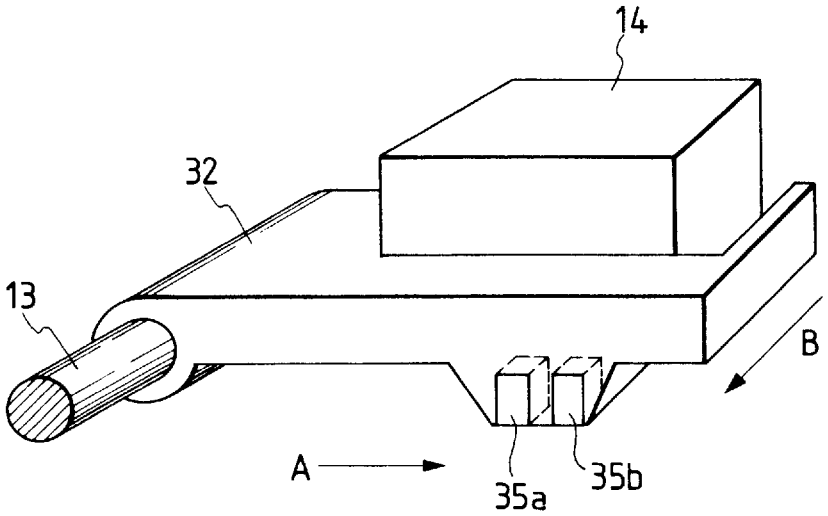
FIG. 9 is a perspective view showing a carriage in the second embodiment of the ink jet recording apparatus according to the present invention.
Figure 10:
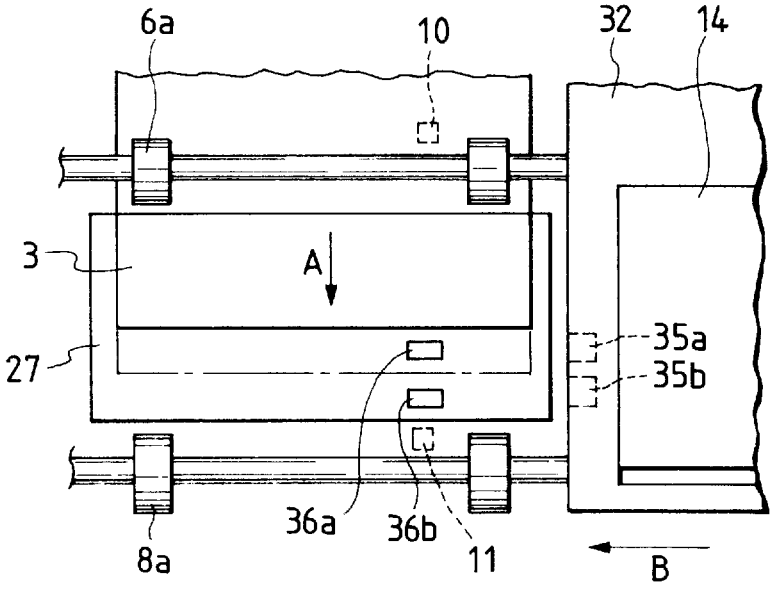
FIG. 10 is a plan view showing platen parts of the second embodiment of the present invention.

FIG. 9 is a perspective view showing a carriage of the ink jet recording apparatus, according to a second embodiment of the present invention, and FIG. 10 is a plan view showing the platen section of the same embodiment. The second embodiment of the present invention will now be described with reference to FIGS. 9 and 10.

The carriage 32 has two paper width sensors disposed laterally near the ejecting opening surface (not shown) of the recording head 14, a first paper width sensor 35*a* at the upstream side of the conveying direction A and a second paper width sensor 35*b* at the downstream side. The first and second paper width sensors 35*a* and 35*b* are disposed along the conveying direction with a proper gap (e.g., 5 mm) therebetween. Also, the first paper width sensor 35*a* and the ejecting opening (not shown) of the recording head 14 are separated from each other in the conveying direction by a distance between the rear end of the recording medium and the rear end of the possible recording area in the case of the leading/rear end mode. A first silver plate 36*a* and a second silver plate 36*b* are disposed at positions on the platen 27 corresponding to the first paper width sensor 35*a* and a second paper width sensor 35*b*, respectively. Other structures are the same as those of the first embodiment already described above.

According to the paper width and kind detecting operation of this embodiment, the carriage 32 is moved from a position shown in FIG. 10 toward a paper width direction (arrow B direction) perpendicular to the conveying direction (arrow A direction). The first paper width sensor 35*a* is moved in the paper width direction such that the rear end of the recording medium in the leading/rear end mode passes across a certain area (shown by alternate long and short dot lines in FIG. 10), while the second paper width sensor 35*b* moves in the paper width direction at the downstream side of the conveying direction of the area.

Next, a second embodiment of the method for controlling the ink jet recording apparatus according to the present invention will be described. In this embodiment, the ink jet recording apparatus of the second embodiment mentioned above is used.

In a step for judging the paper kind when the leading/rear end mode is selected, if both signal patterns obtained by the first paper width sensor 35*a* and the second paper width sensor 35*b* are as the signal pattern 1 shown in FIG. 4A, the rear end of the recording medium 3 is judged not to have reached a predetermined position, thereby informing the occurrence of a jamming state. If the signal pattern of the first paper width sensor 35*a* is as the signal pattern 2 shown in FIG. 4B and the signal pattern of the second paper width sensor 35*b* is as the signal pattern 1 shown in FIG. 4A, it is judged that the rear end of the recording medium 3 is a coated paper, and thereafter, the process advances to the first paper width judging step. If the signal pattern of the first paper width sensor 35*a* is as the signal pattern 3 shown in FIG. 4C and the signal pattern of the second paper width sensor 35*b* is as the signal pattern 1 shown in FIG. 4A, it is judged that the rear end of the recording medium 3 has reached a predetermined position and that the recording medium is a clear sheet for OHP, and thereafter, the process advances to the paper width judging step. If both signal patterns of the first and the second paper width sensors 35*a* and 35*b* are as the signal pattern 2 shown in FIG. 4B or as the signal pattern 3 shown in FIG. 4C, it is judged that the rear end of the recording medium 3 has passed over a predetermined position, such that the rear end of the recording medium is moved in the reverse direction of the arrow A direction by the conveying means until the rear end of the recording medium 3 comes back to the predetermined position. If the signal patterns of at least either one of the first paper width sensor 35*a* and the second paper width sensor 35*b* is as the signal pattern 4 shown in FIG. 4D, it is judged that a failure has occurred and the failure is informed.

The aspects other than those above-described are the same as explained in the first embodiment.

In this embodiment, in addition to those obtained in the first embodiment of the method for controlling the ink jet recording apparatus of the present invention, there is an advantage that the following matters can be detected separately: the rear end of the recording medium does not reach the predetermined position on the platen; the rear end of the recording medium reaches the predetermined position on the platen 7; and the rear end of the recording medium has passed over the predetermined position on the platen 7.

Figure 11:
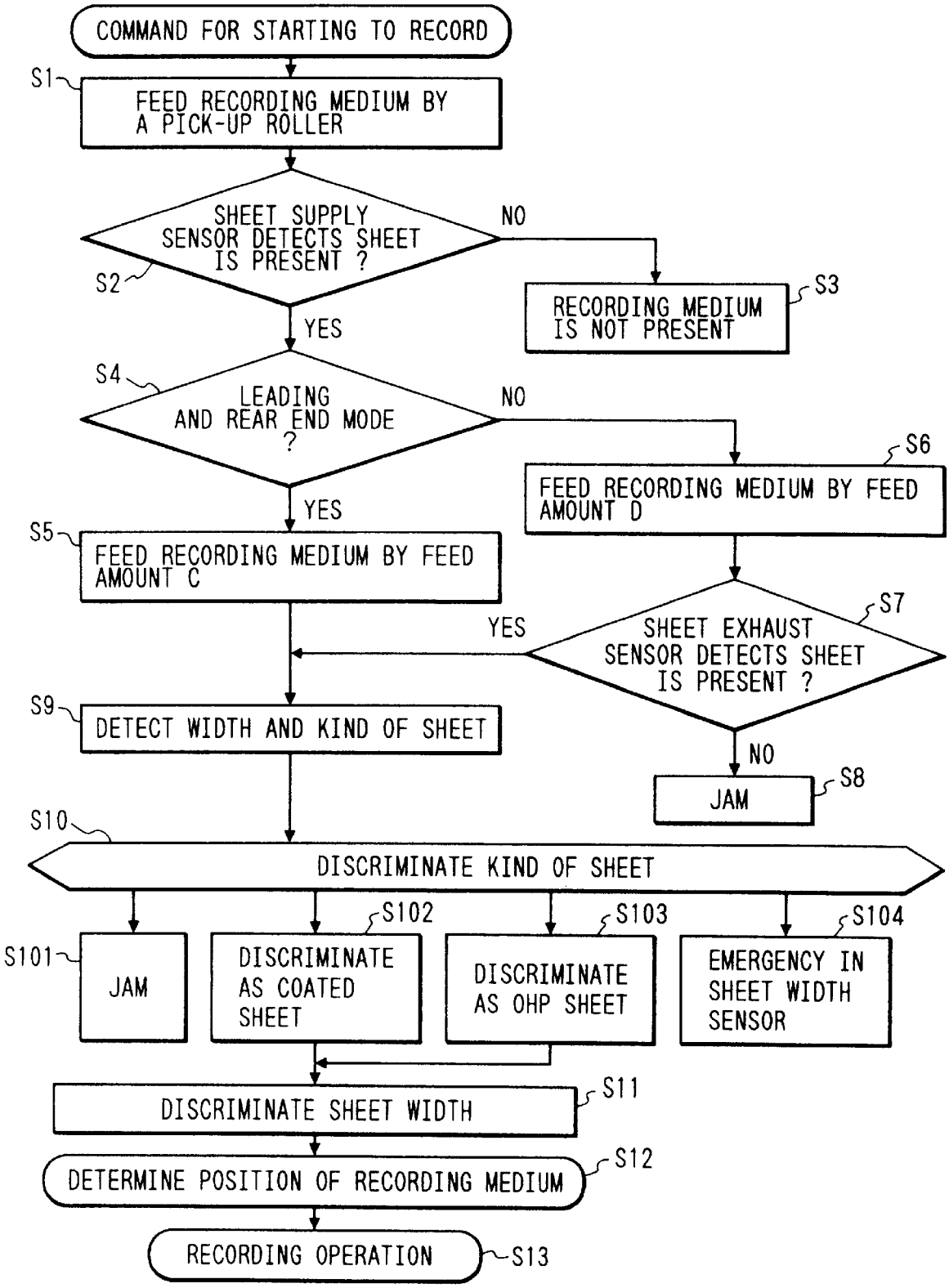
FIG. 11 is the third flow diagram showing a method for controlling an ink jet recording apparatus according to the third embodiment of the present invention.

Next, a third embodiment of the present invention will now be described. In the first embodiment, in the leading/rear end mode, whether the rear end of the recording medium has reached the predetermined position on the platen was checked on the basis of the output from the paper width sensor. Meanwhile, according to this embodiment, in addition thereto, the lateral (in the direction perpendicular to the conveying direction) positional deviation of the recording medium is checked on the basis of the output from the paper width sensor. FIG. 11 is a flow diagram showing a controlling sequence of this embodiment, in which the judging of the paper width is made in step S11, and thereafter, the positional judgment of the recording medium is made n step S12. The processes in other steps are identical to those in FIG. 8 so that discussion of them is omitted.

Figure 12:
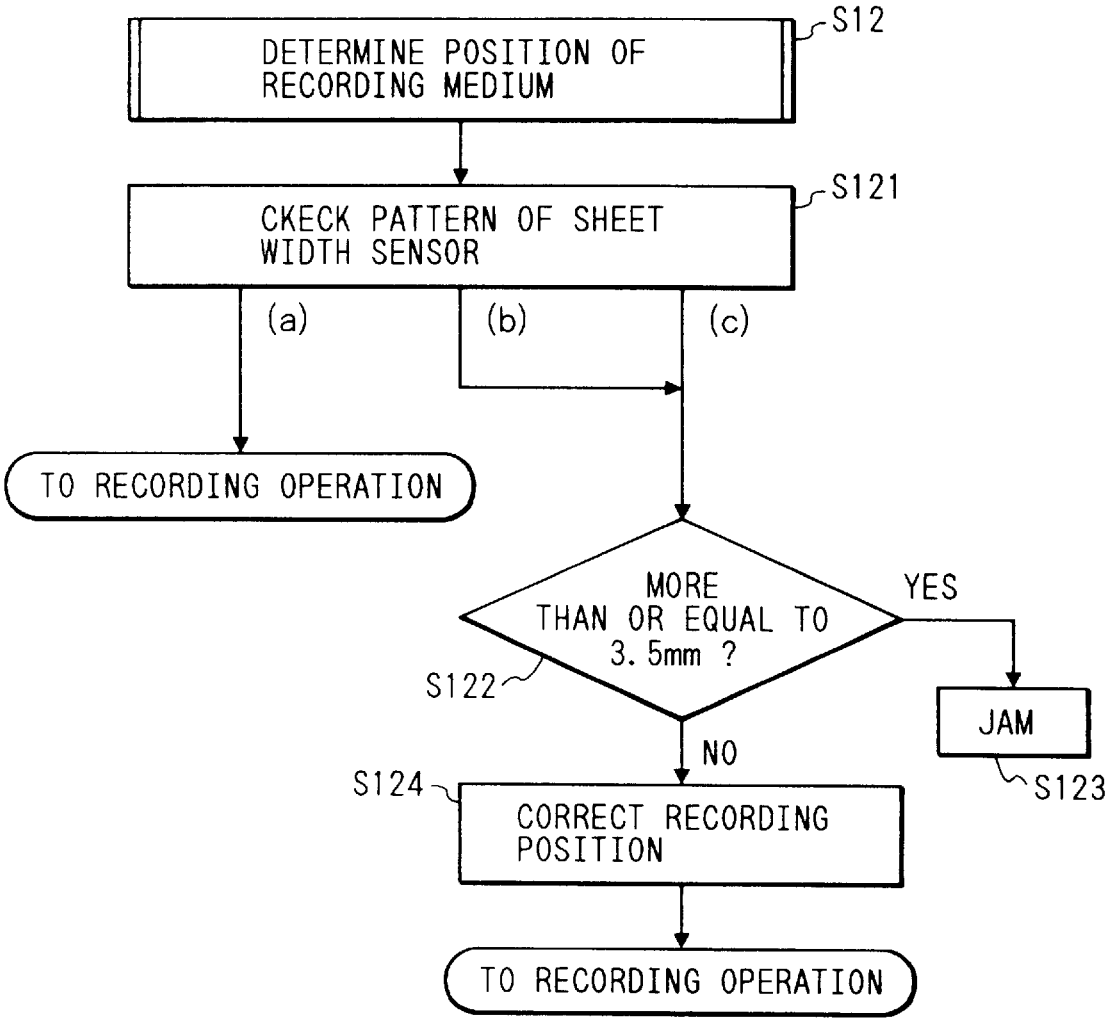
FIG. 12 is a flow diagram showing a flow of the positional judging process of a recording medium according to the third embodiment of the present invention.

FIG. 12 shows a sequence of the positional judgment process for the recording medium. The recording medium is checked for lateral (left and right) deviation on the basis of the output data from the paper width sensor 15.

Figure 13A:
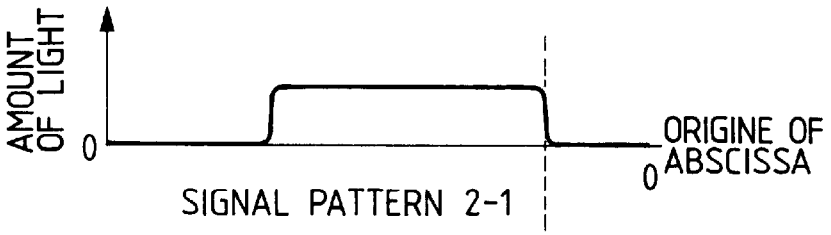
FIGS. 13A to 13C are diagrams showing an output pattern of a paper width sensor.
Figure 13B:
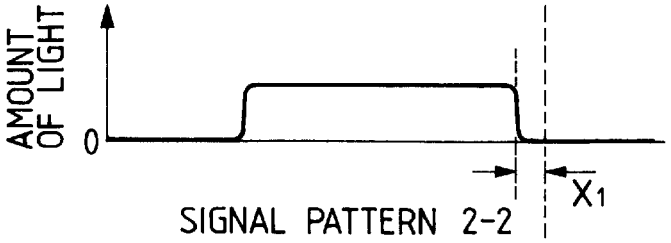
Figure 13C:
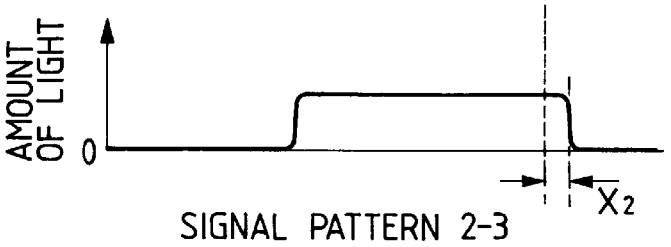

In this embodiment, the position of the signal pattern being the checked output from the sensor is checked for any deviation from the reference position, and if such a deviation is present, the deviated amount is examined. First, in step S121, the output pattern of the paper width sensor 15 is checked. If it is as shown in FIG. 13A, it is judged that the recording medium has been correctly fed, and the process advances to the recording operation. If it is as a pattern as shown in FIGS. 13B and 13C, the recording medium is judged as being deviated laterally in the left or right direction, respectively. In step S122, the deviated amount is detected, and it is judged as a jamming state if it is equal to or above 3.5 mm. If it is less than 3.5 mm, the recording position of the deviated amount is corrected in step S124. The threshold value 3.5 mm of this deviated amount judgement is based on the lateral blank amount, 5 mm respectively at the left and right end, of the recording medium of this embodiment. The recording positional correction in step S124 is to change the setting of the parameter of the recording operation so as to change the recording position (x direction).

Figure 14A:
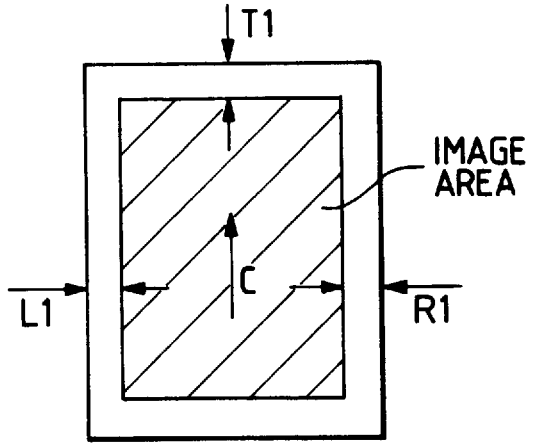
FIGS. 14A to 14C are diagrams showing a relationship between a paper feeding state and an image area of the recording medium.
Figure 14B:
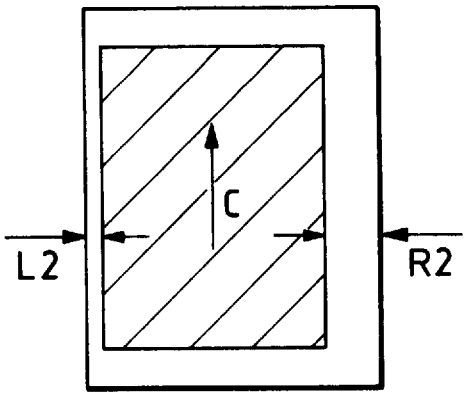
Figure 14C:
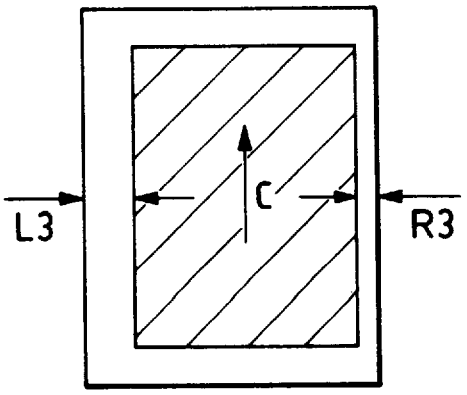

FIGS. 14A–14C show a deviation of the recording image position when the recording medium is conveyed with a lateral deviation. When the recording medium is laterally deviated in the left or right direction as shown in FIGS. 14B and 14C, (L2=2 mm, R2=8 mm, L3=8 mm, R3=2 mm) the image area is subject to the corresponding deviation in the left or right direction in accordance therewith. To overcome this, such parameters as recording timing, etc., are reset so that the image can be recorded at the center of the recording medium as shown in FIG. 14A (L1=5 mm, R1=5 mm, L1=5 mm). In the case of FIGS. 14A–14C, since both FIGS. 14B and 14C present 3 mm of deviation in the left and right directions, respectively, a correction by 3 mm is performed.

Next, a fourth embodiment of the present invention will now be described. In the second embodiment aforementioned, there are provided two paper width sensors to detect the reaching or passing over the rear end of the recording medium the predetermined position of the platen. Meanwhile, in this embodiment, a diagonal passing of the recording medium is further detected to control the operation of the apparatus.

Figure 15:
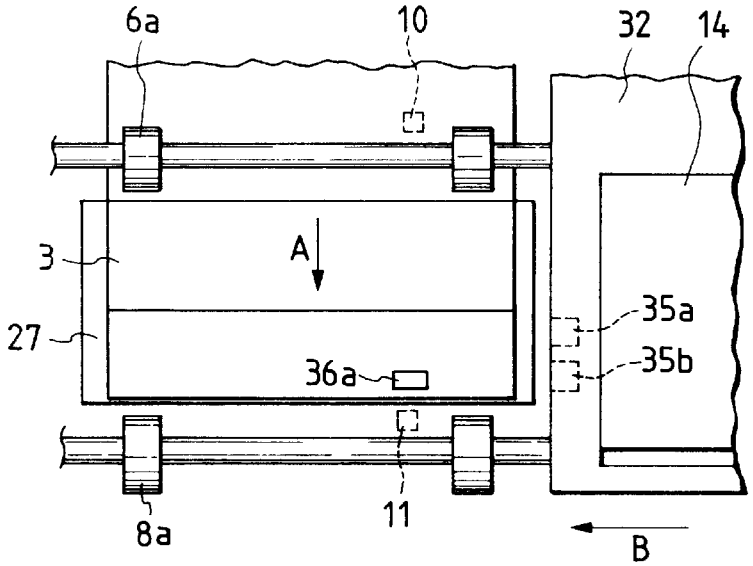
FIG. 15 is a plan view showing platen parts of the ink jet recording apparatus according to the fourth embodiment of the present invention.

FIG. 15 is a plan view showing a platen section of the ink jet recording apparatus according to the present embodiment. In FIG. 15, the same numerals refer to the same components as in FIG. 10. The first paper width sensor 35*a* and the second paper width sensor 35*b* are disposed along the conveying direction with a proper gap (e.g., approximately 10 mm) therebetween. For detecting the paper width and the paper kind, the carriage 32 is moved in the paper width direction (arrow B direction) perpendicular to the conveying direction (arrow A direction) from the position shown in FIG. 15. This is the same manner as in the second embodiment. The first paper width sensor 35*a* moves in the paper width direction as passing through the rear portion of the recording medium in a case of the leading/rear end mode, while the second paper width sensor 35*b* moves in the paper width direction at the downstream side in the conveying direction of the area.

The present embodiment features detecting in more detail the position of the recording medium using these two paper width sensors 35*a*, 35*b*, and to carry out controlling operations suitable for the respective cases. As the total controlling sequence of this embodiment is substantially the same as that in FIG. 11, further explanation will be omitted.

Figure 16:
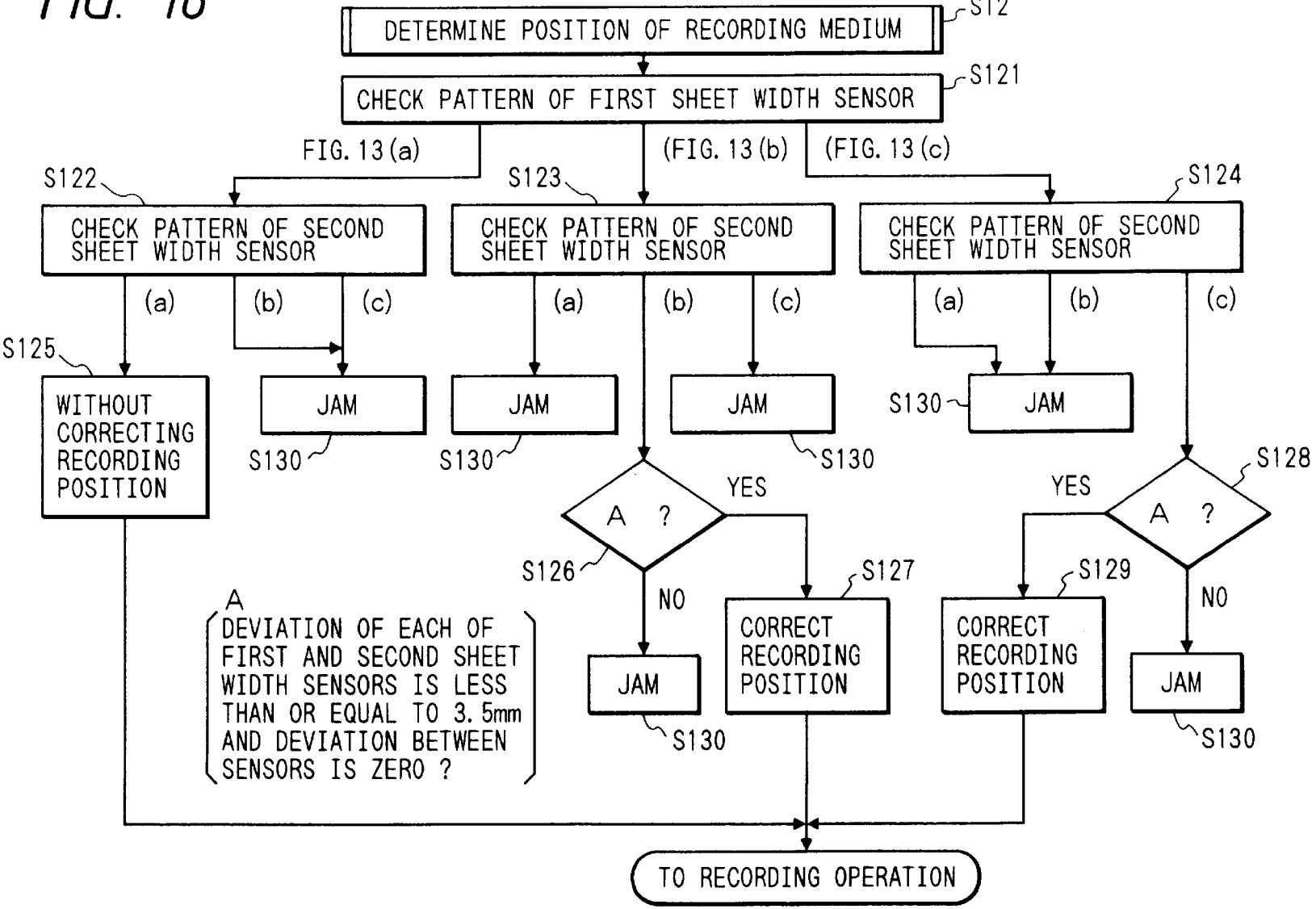
FIG. 16 is a flow diagram showing a flow of the positional judging process according to the fourth embodiment of the present invention.

FIG. 16 shows a determination control flow diagram for the recording medium position. In step S121, the pattern of the first paper sensor 35*a* is checked. Next in steps S122–S124, the pattern of the second paper width sensor 35*b* is checked. If the pattern of the paper width sensor 35*a* is judged in step S121 as being a signal as in FIG. 13A, the process advances to step S122. Likewise, if it is judged as being a signal as in FIG. 13B, then to step S123, and if as being a signal as in FIG. 13C, to step S124. In the pattern of FIG. 13A, the recording medium is judged as having been at the correct position at the time of passing through the first paper width sensor 35*a*, while in FIG. 13B and FIG. 13C, it is deviated to the left and right side respectively. Subsequently, in step S122, the output pattern of the second paper width sensor 35*b* is checked. If it is as shown in FIG.

Figure 17A:
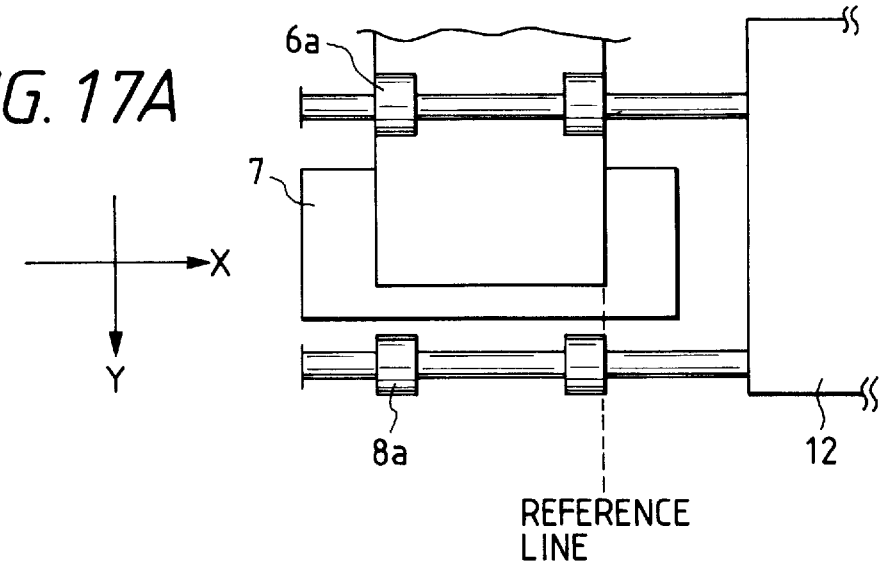
FIGS. 17A to 17C are diagrams showing a state of the recording medium fed over the platen.
Figure 18A:
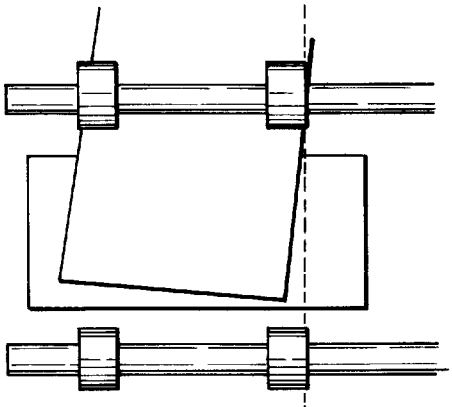
FIGS. 18A and 18B are diagrams showing a state of the recording medium supplied diagonally.
Figure 18B:
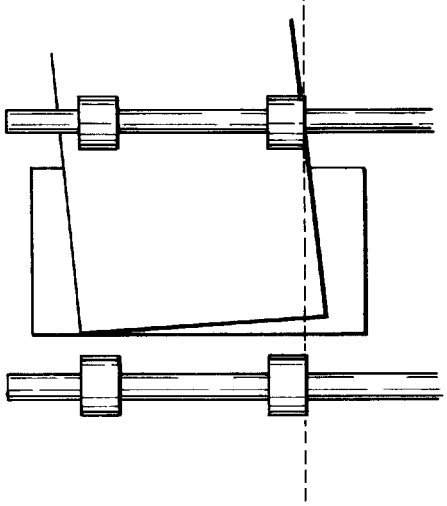

13A, the process advances to the recording operation without recording positional correction in step S125, since the first and second paper width sensors have the pattern as shown in FIG. 13A, i.e., the recording medium has been conveyed to the correct position as shown in FIG. 17A. If the output pattern of the first and second paper width sensors are as shown in FIGS. 13B and 13C, the process advances to the jamming processing routine of step S130. This is because the recording medium is considered to have been fed diagonally as shown in FIGS. 18A and 18B, due to the output pattern of the first paper width sensor 35*a* as shown in FIG. 13A. The same is true in step S123 and S124. Namely, if the output pattern data of the first paper width sensor 35*a* is as shown in FIG. 13B, when the output pattern data of the second paper width sensor 35*b* is as shown in FIG. 13A or 13C, they would be in a jamming state, respectively, in step S130. Further, if the output pattern data of the first paper width sensor 35*a* is as shown in FIG. 13C, when the output pattern data of the second paper width sensor 35*b* is as shown in FIG. 13A or 13B, they would be in a jamming state in step S130.

Figure 17B:
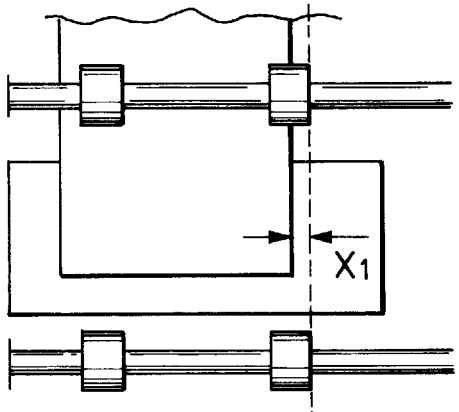

Also, when both the output patterns of the first paper width sensor 35*a* and the second paper width sensor 35*b* are as shown in FIG. 13B, namely when the fed recording medium is as shown in FIG. 18A, if the deviated amount of the output patterns from the first and the second paper width sensors 35*a*, 35*b* in step S126 are less than 3.5 mm respectively with no difference therebetween (a state as shown in FIG. 17B), the recording position is corrected in step S127 to advance to the recording operation.

Figure 17C:
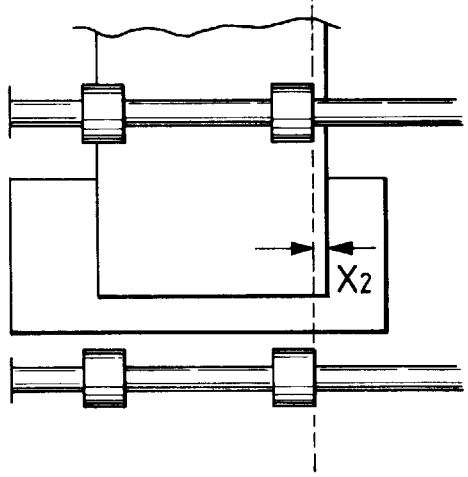

Further, when the output patterns of the first paper width sensor 35*a* and the second paper width sensor 35*b* are both as shown in FIG. 13C, namely when the fed recording medium is as shown in FIG. 18B, likewise the process advances to step S128 to perform the examination. If the deviated amount is equal to or less than 3.5 mm with no difference therebetween (a state as shown in FIG. 17C), the recording position is corrected in step S129 to advance to the recording operation.

Thus, using the signal pattern obtained from the paper width sensor for judging the fed state of the recording medium, the undesirable direct printing on the platen can be surely prevented, thereby keeping the platen side surface of the recording medium clean.

Further, when the recording medium is fed with a deviation in the X direction as shown in FIGS. 18B and 18C, the right and left blanks can be adjusted by deviating the recording start position to obtain a desired image recording.

According to the present invention as composed above, it is possible to detect that the recording medium does not reach a predetermined position on the platen or that there is a positional deviation by using the signal obtained from the paper width detecting means to judge the conveyed state of the recording medium without requiring any particular sensor separately. As a result, the direct printing on the platen can be certainly prevented so as to keep the platen side surface of the apparatus and the recording medium clean.

The above-described sensor can be composed to have higher sensing accuracy by using a sensor unit of the following structure. This sensor unit is composed of a reflective-type photosensor 48 shown in FIG. 19 and a circuit shown in FIG. 20. A terminal Vo in FIG. 20 is input to an A/D converter of the control section as a detected output to be processed.

Figure 19:
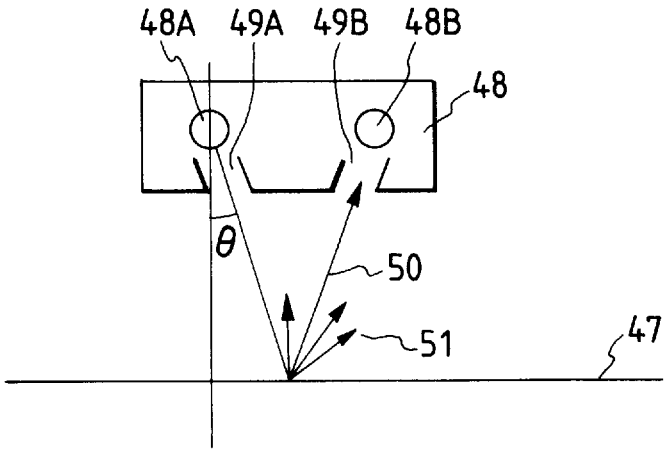
FIG. 19 is a diagram for the explanation of a reflective photosensor according to the embodiments of the present invention.
Figure 20:
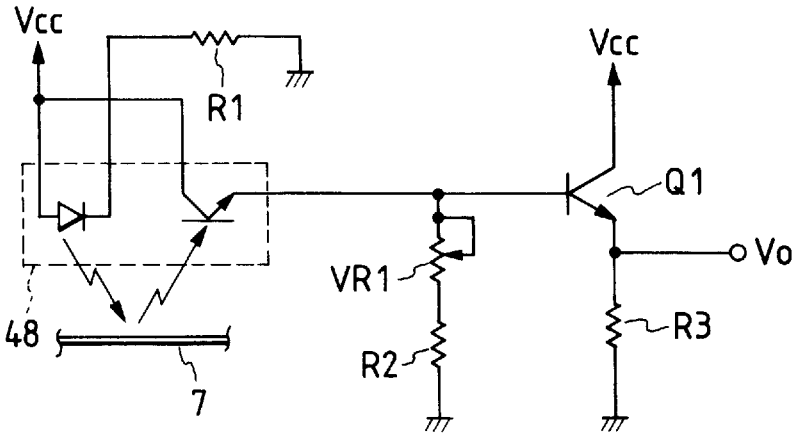
FIG. 20 is a diagram showing a sensor circuit of the present invention.
Figure 21:
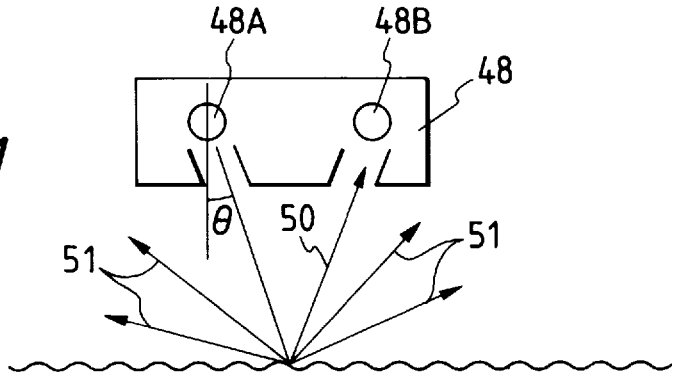
FIG. 21 is a diagram for the explanation of the irregular reflective medium of the present invention.

The reflective-type sensor unit 48 in FIG. 19 includes a light-emitting element 48A and a light-receiving element 48B. Slits 49A and 49B are formed to emit light from the vertical plane against a recording medium 47 with an angle of ΘLED (hereinafter referred to as a "light emitting angle") and to receive light with an angle of ΘTR (hereinafter referred to as a "light receiving angle"), respectively, to provide the light emitting and receiving angles with a directivity. For example, the light emitting element is an LED while the light receiving element 48B is a phototransistor. The light emitted from the light emitting element 48A impinges on the recording medium with a light emitting angle. The light reflected therefrom is received by the light receiving element 48B, and a current corresponding to the light energy received there flows as a base current for the transistor Q1. As a result, the detected output Vo is output in accordance with the energy received at the light receiving element. The VR1 is a variable resistor for adjusting the gain of the circuit.

When such a sensor unit as described above is used for a recording medium, if the recording medium is substantially a regular reflector, a regular reflective light 50 having the same reflective angle as an incident angle would be the main component with thereby a small random reflection component 51. However, as to the surface of the recording medium, since it has microscopic convexes and concaves due to its texture, the random reflection component 51 would be large.

Figure 23:
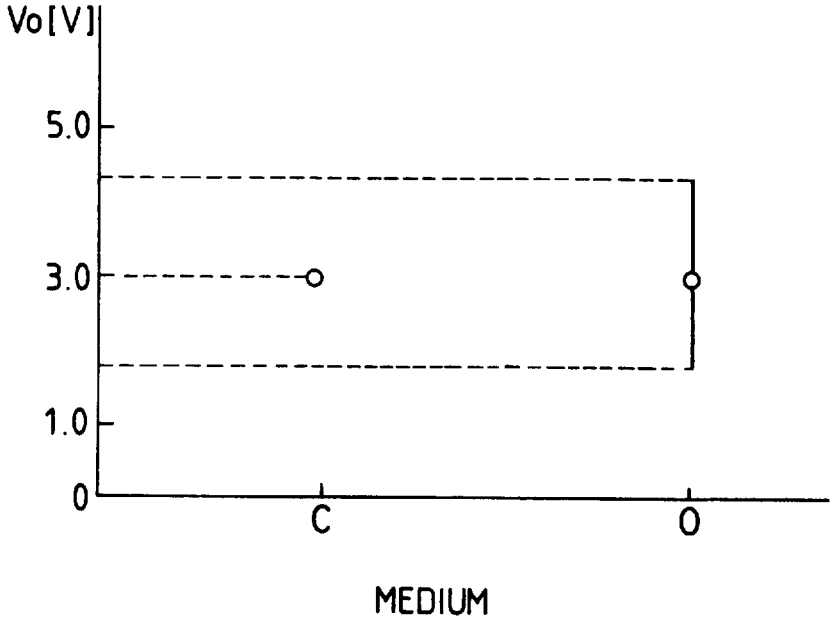
FIG. 23 is a diagram showing a relationship between the kind of the recording medium and the detected output.

FIG. 23 is a graphic diagram showing a measured result of the detected output Vo by the sensor unit 48 with the kind of the recording medium and the sensor mounting angle being varied (C=COATED SHEET, O=OHP SHEET; X-axis represents kind of medium). In FIG. 23, a coated paper (a paper having a coating-processed surface to be properly ink-stained) used in this embodiment is compared with an OHP sheet. The output Vo in a case of the coated paper is adjusted by the VR1 to be 3V, in which state the output in a case of an OHP sheet is measured. As clearly seen from the FIG. 23, it is understood that the output level in the case of an OHP sheet when measured on various sensor mounting angles would range from 1.8 V to 4.2 V. The reason can be explained on the basis of FIGS. 24 to 26, which show reflective properties of the sensor unit 3 for three kinds recording mediums, i.e., mirror, an OHP sheet, and coated paper. The measurement system is shown in FIG. 27 (L27= 35 mm). But as to the mirror shown in FIG. 24, the reason is because the gain of the circuit is reduced by the variable resistor VR1 in comparison with the OHP sheet or the coated paper. This is due to the fact that, since the mirror has a high light reflective rate, the detected output Vo would be minimum at a region where the rotating angle in FIG. 24 is a negative value, but even so it would reach a saturated voltage of the circuit.

In the drawing, the code 1 is designated as a distance between the medium and a distance from a medium to the sensor. The lateral axis a is an angle rotated with a point located at a distance from the center of the recording. The clockwise rotation would be referred to as a plus direction while the counter-clockwise as a minus direction. But the gain, the value of VR1 in FIG. 20 is set to be different from that in the case of the mirror and those of the other two cases. Further, for the sensor used in this case, the light emitting angle is formed to be smaller than the light receiving angle.

Figure 24:
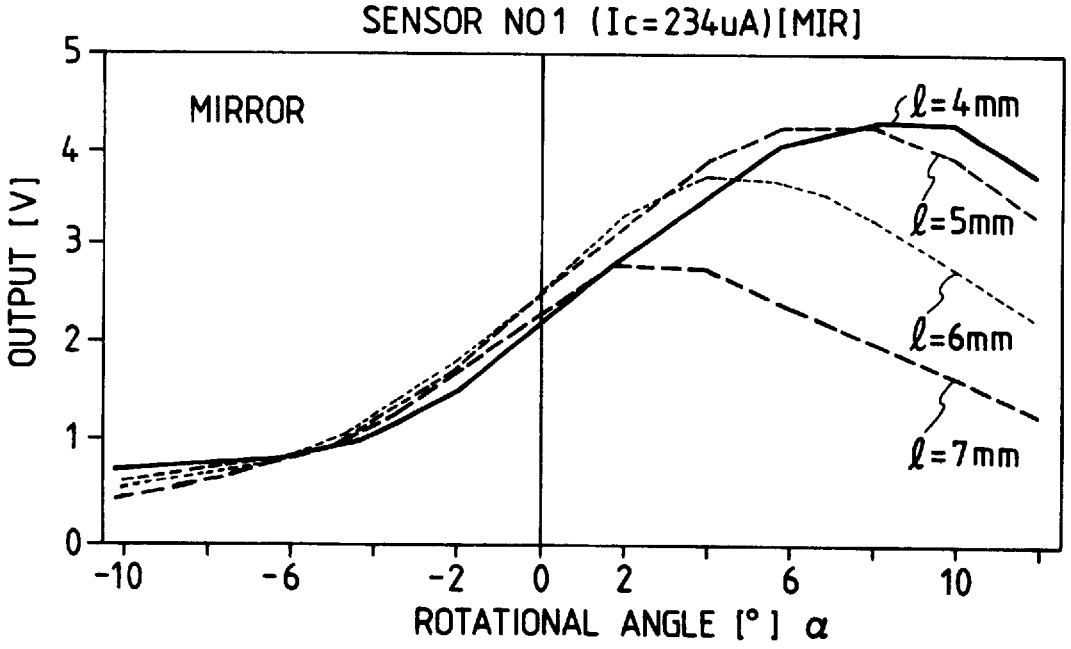
FIG. 24 is a diagram showing a detected output property when a mirror is used as a recording medium.
Figure 25:
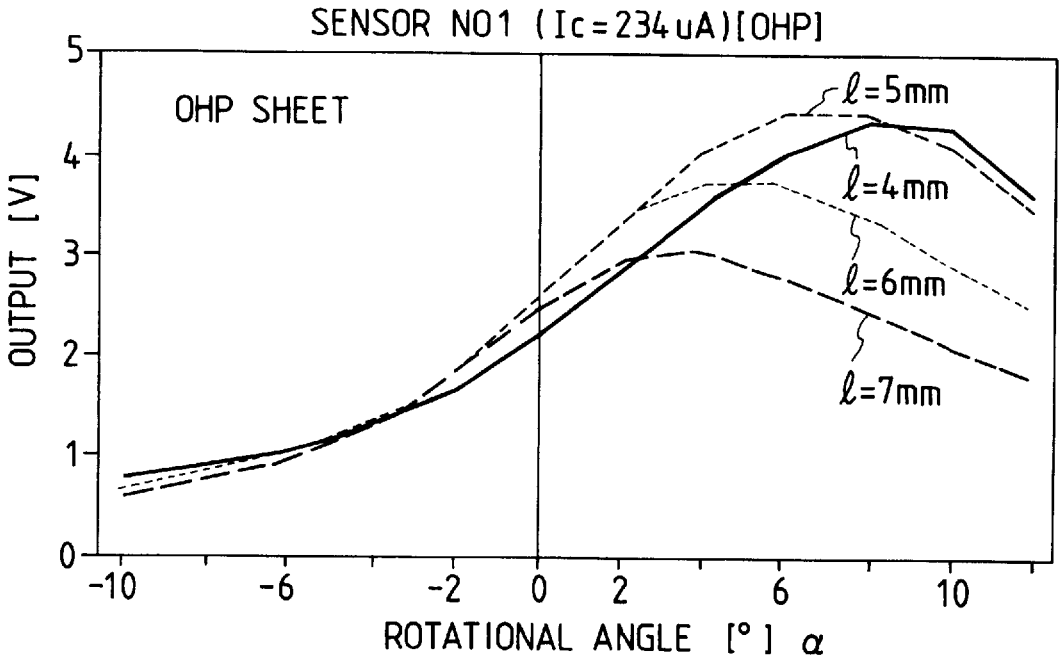
FIG. 25 is a diagram showing a detected output property when an OHP sheet is used as a recording medium.
Figure 26:
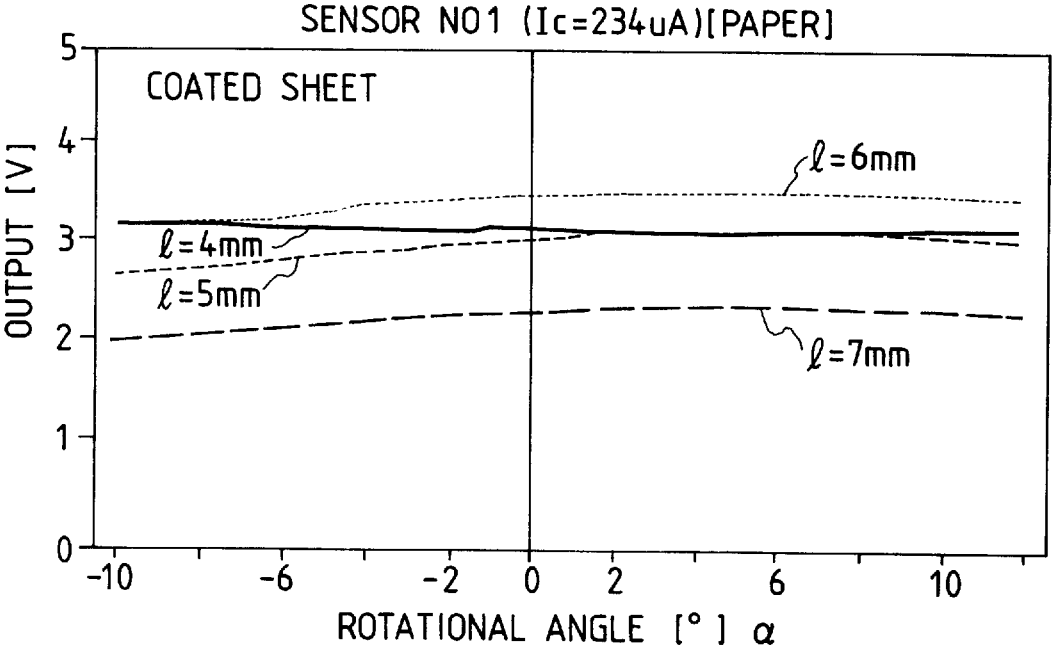
FIG. 26 is a diagram showing a detected output property when a coated paper is used as a recording medium.
Figure 27:
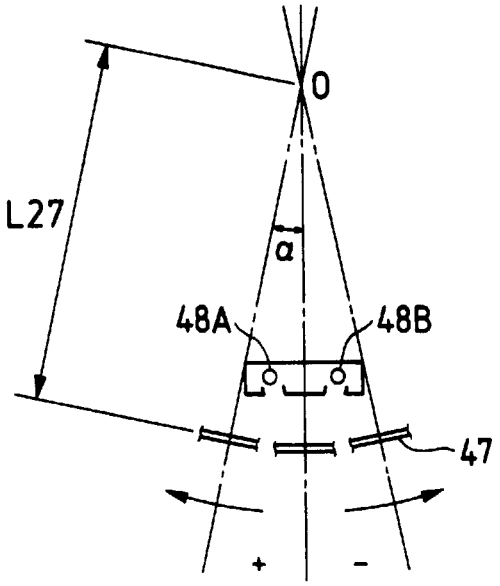
FIG. 27 is a diagram showing a measuring jig for varying the relative positional relationship between the sensor and the recording medium.
Figure 28:
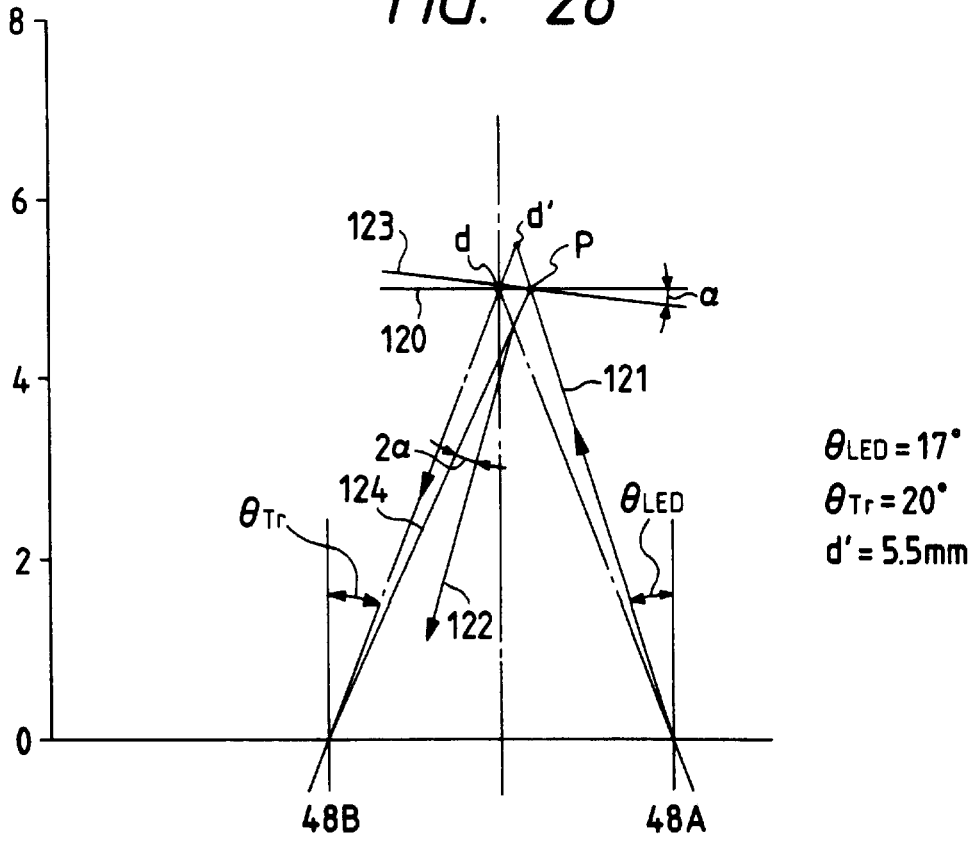
FIG. 28 is a diagram for the explanation of the direction property of the sensor.

From FIGS. 24 to 26, the following matters can be understood: (1) The OHP sheet is of substantially the same property as that in the case of a mirror; (2) In the case of coated paper, the output Vo is hardly related to the rotating angle, that is, the random reflection is principal. As shown in FIGS. 24 and 25, the sensor used has a peak of the output level near 6 degrees of the angle. This will now be described with reference to FIG. 28. FIG. 28 shows a light path passing from the light emitting section 48A to the light receiving section 48B. If ΘTr=ΘLED, the light emitting section 48A passes through the path shown by a dotted line and then reflected at the point d to reach the light receiving section 48B. However, due to the relationship ΘTr>ΘLED, the light emitted from the light emitting section 48A will pass through a line 121 to enter the point P on the recording medium. The line 120 designates the light when the gradient angle of the recording medium is zero, in which the reflected light is reflected along the line 121 not to reach the light receiving section 48B. But, it is possible to obtain the maximum output level since the reflected light passes through the line 124 to enter the light receiving element 48B by inclining the medium surface by an angle in the same manner as in the medium 123 shown. Due to these reasons, in a regular reflection medium such as a mirror or an OHP sheet, the output Vo becomes maximum when the rotating angle of the medium is set to a certain angle in the plus direction.

For the results noted above, it would be clear that detecting the presence, the line and the effective width of the recording medium by a single reflective sensor on the basis of only the absolute value of the output Vo level by a single reflective sensor 48 will have difficulty because of such reasons as the difference of the sensor mounting accuracy (distance, horizontal degree, etc.) and the difference of the characteristics inherent in the sensor (directivity etc.)

Therefore, according to the first embodiment of this invention, a window is formed on a part of a black painted metal plate provided on a conveying path, making a silver-plated pseudo-mirror surface. With such a structure, the reflective rate at the mirror surface will increase to show gradually an eminent output property as shown in FIG. 24.

Further, it is also effective to approximate the light emitting—receiving relationship to regular reflection by inclining the pseudo-mirror surface from the horizontal plane by an angle on the sensor mounting angle discussed later.

In addition, as a second feature described with reference to FIGS. 24 and 26, the directivity of the sensor 48 is previously set such that a point deviates by a predetermined angle (6 degrees in this embodiment). Namely, the sensor 48 is designed to have its best sensitivity on rotating in the "+" direction in FIG. 27.

Figure 22:
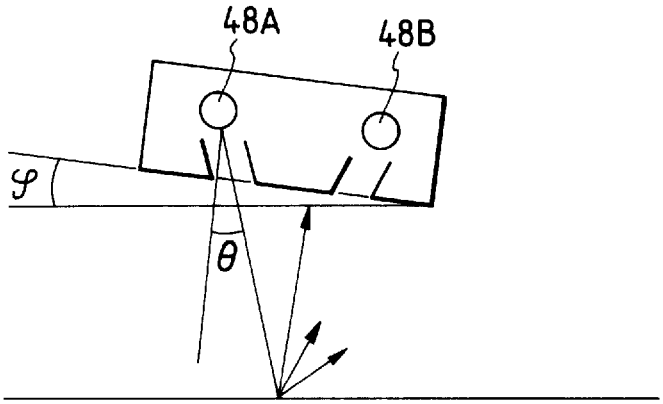
FIG. 22 is a diagram showing an aspect where the sensor is diagonally mounted according to an embodiment of the present invention.

Furthermore, the third feature of the present invention is to have set the relationship between the sensor and the recording medium as shown in FIG. 22 with a predetermined angle $\phi$ in the direction opposite to the best sensitivity direction. In FIG. 24, this corresponds to the area of a rotating angle "$\alpha<0$". As a result, the magnitude relationship of the absolute output level of the OHP paper and the coated paper can be set as "OHP paper<coated paper" from FIGS. 25 and 26.

Figure 29:
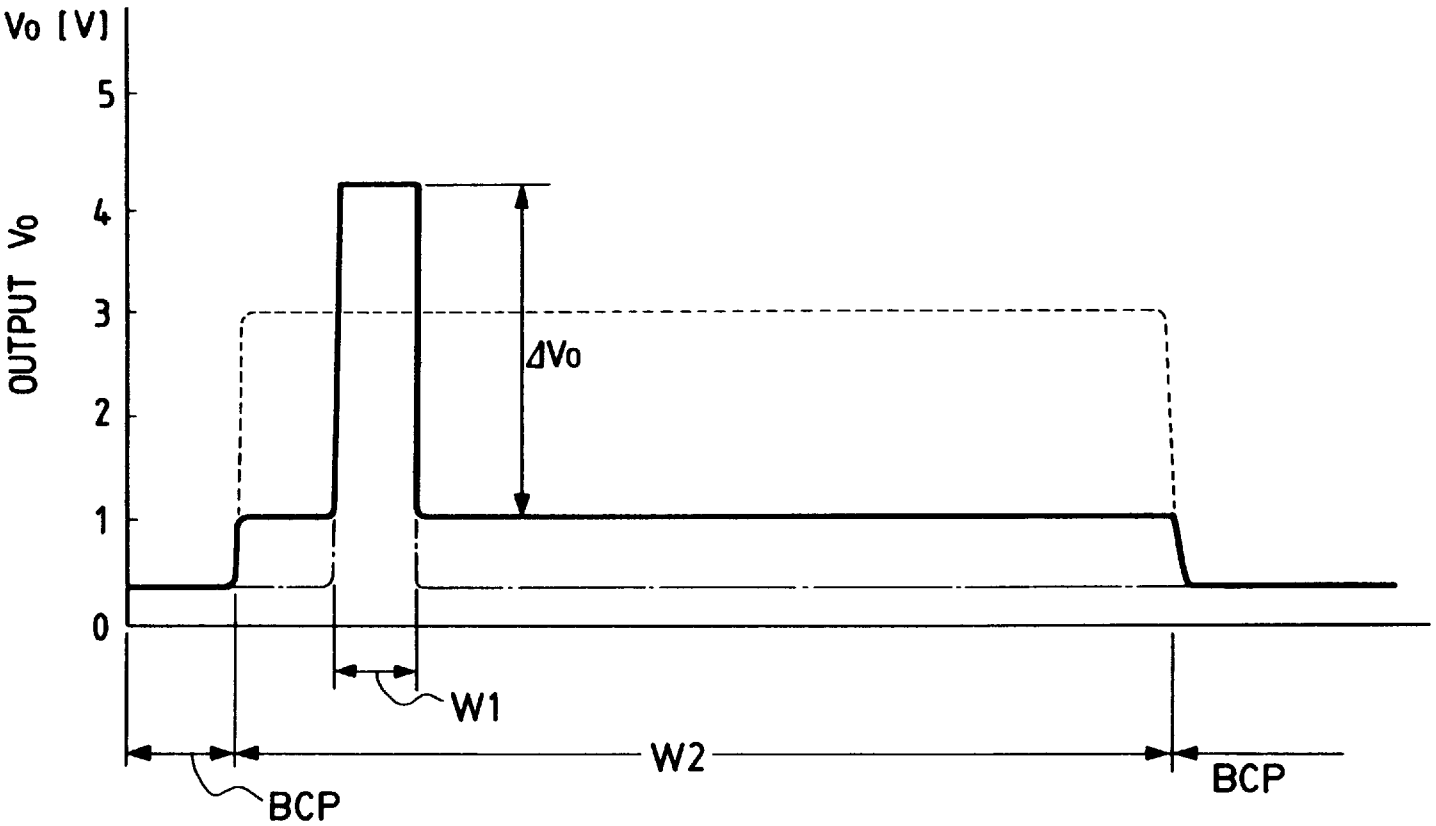
FIG. 29 is a comparative diagram for the detected output properties with respect to the recording mediums in the embodiments.

From the three features aforementioned, the detection output level with respect to each recording medium according to the apparatus of this embodiment will be as shown in FIG. 29 (dotted line=COATED SHEET, solid line=OHP SHEET, dot and dash line=WITHOUT RECORDING MEDIUM, BCP=BLACK-COATED PORTION, W1=WINDOW, W2=EFFECTIVE WIDTH). The dotted line shows the case of coated paper, in which the output level is set to be 3.0 V by adjusting the volume VR1. At this time, if the surface of the black painted metal plate is measured directly without placing any recording medium, the output is approximately 0.3 V. In the case of the coated paper, since the light cannot pass through the coated paper, the output level of the window portion will be 3.0 V all over the effective width of the recording area.

On the other hand, in the case of OHP sheet, as shown by solid lines in FIG. 29, the window portion passes approximately 70% of the light from the sensor 48 therethrough. The passed light will then reflect on the Ni-plated pseudo-mirror surface and the majority of the reflected light passes again the OHP paper, and thereafter, enters the light receiving element of the sensor 48. As previously described with reference to FIG. 24, this pseudo-mirror surface has a quite high reflection rate, which would make the detected output saturated. According to the circuit used in this embodiment shown in FIG. 20, the upper limit of the output level is 4.2 V, above which voltage any output level would be saturated. Therefore, in the case of the OHP sheet, the output level at the window portion is saturated as shown in FIG. 29. Further, the portions other than the window portion of the OHP sheet are equivalent to a point of $\alpha=-6$ degrees in FIG. 25 because of being inclined by $\phi=6$ degrees as shown in FIG. 22, thereby leading to 1 V, approximately. However, this value of 1V contains, as previously mentioned, dispersive factors due to the directive dispersion inherent in the sensor or the sensor mounting inaccuracy. Therefore, in this embodiment, when the level difference $\Delta$Vo between the output level at the window part and that at the other parts is larger than a predetermined value C, as shown in FIG. 29, the paper kind is judged as OHP.

As mentioned above, if the pseudo-mirror surface is also inclined by an angle $\phi$ such that the relationship between the pseudo-mirror surface and the light-emitting/receiving approximates regular reflection, the detected output level at the window portion will be more highly assured.

If there is no paper due to exhaustion, etc., the output would be as indicated by an alternate long and short dash line in FIG. 29, the output at the window portion is saturated by the upper limit while the other parts would have an output level of the black-coated portion.

As could be understood from the aforementioned explanation, according to the printer of the present invention, it is possible to distinguish the kind of the recording medium and to detect the effective recording width of the recording medium. Therefore, disadvantages such that erroneous recording is made on a black coated metal plate without paper set thereon so as to make the inside of the apparatus dirty can be surely avoided.

Further, according to the present invention, it is also possible to determine whether the front end of the recording medium has been fed to a predetermined position, and whether the rear end of the recording medium has passed the predetermined position.

Thus, according to the present invention, only a single sensor can perform such various operations as the judgment of the presence of the recording medium to be used in the recording apparatus, judgment of the kind of the recording medium, detection of the effective recording width, thereby providing the ability to simplify, minimize in size and lower the cost of the apparatus so as to improve the cost performance.

Figure 30:
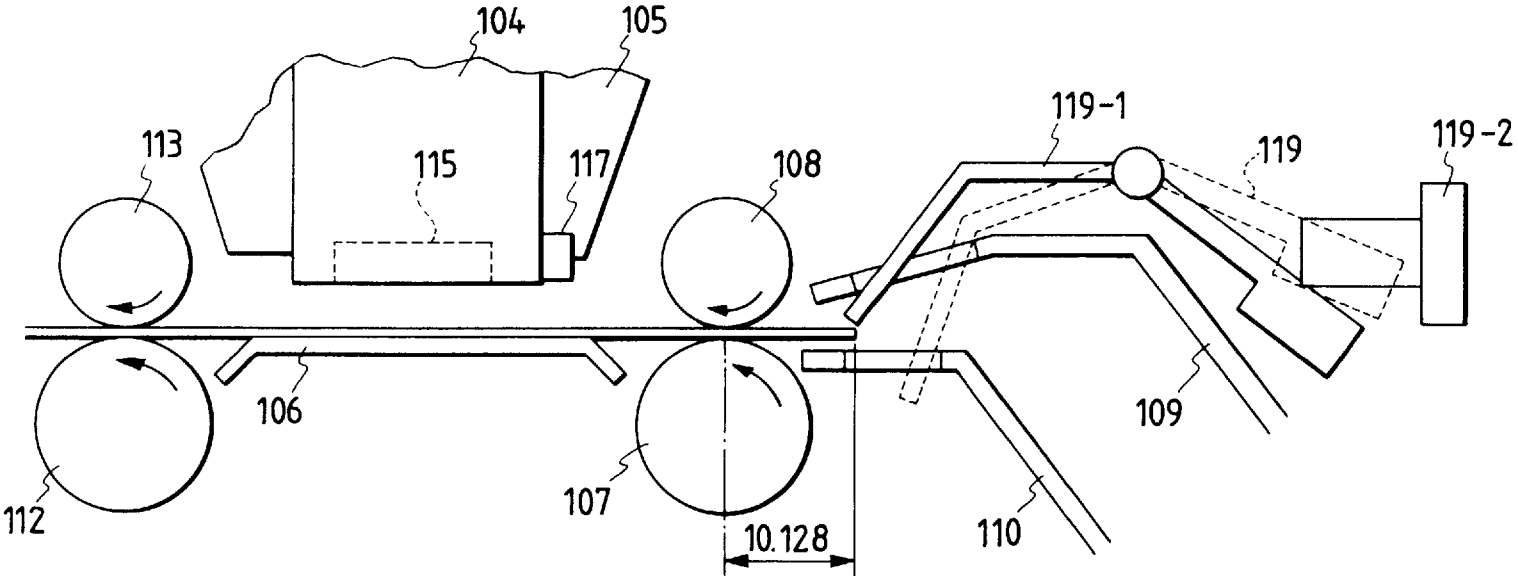
FIG. 30 is a diagram showing schematically a composition of an image recording apparatus incorporating the present invention.
Figure 31:
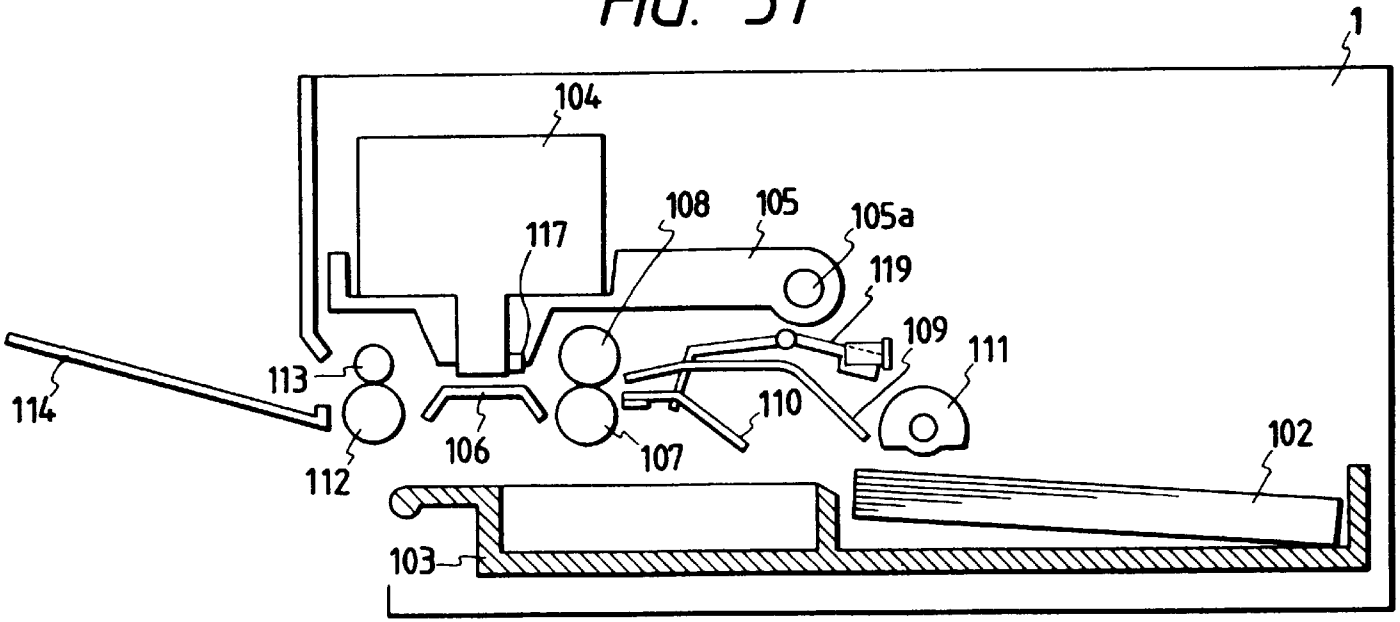
FIG. 31 is a cross-sectional view of an image recording apparatus shown in FIG. 30.

An embodiment of the present invention in which an operator recording operation is performed on a heat material end portion will now be described with reference to the drawings. FIG. 30 shows a schematic composition of an image recording apparatus according to the fifth embodiment of the present invention, while FIG. 31 is a cross-sectional view of the apparatus body. As shown in FIG. 31, a cassette 103 in which a plurality of sheet members 102 are accumulated is disposed at the bottom portion of the image recording apparatus body 101. In FIG. 31, at the left hand side, there is disposed a carriage 105 incorporating a recording head 104 under which a platen 106 is provided.

The recording head 104 is of an ink jet type for recording on a sheet member 102. There is formed m ink jet openings at the rear end of the ink ejecting section 115 which has an ink chamber therein to eject ink drops in response to an image signal from the m number of ejection openings. A carriage motor is coupled to the carriage through a timing belt (not shown), the carriage 105 reciprocally moving along a guide shaft 105*a* by the carriage driving motor.

To correctly join the recordings, however, a quite severe requirement, e.g., a high accuracy, would be imposed on a person to feed the sheet member 102 by the feeding roller 107.

In the recording apparatus, when the paper feeding roller 111 rotates by the feeding signal, only the most upper one sheet member 102 is separated to be fed between the pair of feeding guides 109 and 110.

Subsequently, the sheet member 102 is guided by the paper feeding guides 109 and 110, being held between the conveying lower roller 107 and the conveying upper roller 108 rotating passively following the conveying lower roller 107.

For the sheet at this time, the sensor arm 119-1 is in such a state as shown by the solid lines shown in FIG. 31, and the light from the light-emitting section of the transparent-type sensor 119-2 reaches the light receiving sensor. Meanwhile, during a non-detection time, the sensor arm 119-1 would become as shown by the dotted lines, and the light from the light emitting section is shut down by the sensor arm. Due to this change of state, the sheet sensor 119, composed of the sensor arm 119-1 and the transparent-type sensor 119-2, detects the rear end of the sheet.

Next, the sheet member 102 further passes through a platen 106 by virtue of the force given by the conveying lower rollers 107, 108 to be led to the tension upper and lower rollers 112 and 113, and the rear end of the sheet member 102 conducted between the tension upper rollers 112 and 113, thereby stopping the operation temporarily.

Although the tension lower roller 112 rotates interlocking with the conveying lower roller 107, the conveying amount is set a little larger, and a proper tension is applied to the sheet member 102 to prevent its undesirable relaxation, since the holding force for the sheet member 102 is set to be weakened by the upper and lower conveying rollers 107 and 108.

In this state, the recording medium, moving in the direction from the leading side to the rear side in FIG. 31, performs the recording operation on the sheet member 102 with a constant width (recording width) by ejecting ink thereon in response to the image signals. The recording width W is represented by m×d where d is a dot diameter and m is the number of ink ejecting openings.

Each time that the recording operation for one line is completed, the sheet material 102 is fed in steps by the same amount as the recording width thereof by the conveying upper and lower rollers 107, 108, for the recording of the next line.

A series of the above-described operations are iterated to advance the recording operation on the sheet member 102. When the rear end of the sheet member 102 is detected by the paper sensor 119 passing through the conveying upper and lower rollers 107, 108 during the stepped feeding, there is a part of the operation in which the recording member is fed only by the pair of the tension upper and lower rollers 112 and 113. To prevent an excessive feeding caused by such a structure, it is possible to reduce the rotating angle of the drive motor for controlling the feeding amount thereof, and correspondingly to reduce the number of ink ejecting openings such that the mutual relationship of the recording at each step may be adjusted.

On completion of the recording operation for one sheet member 102, the sheet member 102 is discharged through the tension upper and lower rollers 112 and 113 to the paper discharging tray 114. In the shown embodiment, numeral 117 designates a paper width sensor composed of a reflection-type sensor. This sensor is mounted on the carriage 105 to detect a range over which the sheet is present when the carriage once reciprocally moves on the sheet member, in advance of starting the recording operation after being conveyed toward the position above the platen 106. By virtue of this operation, the range for ink ejection is restricted so as not to allow undesirable ink ejection on a portion with no sheet member, preventing the apparatus from being made dirty.

Figure 33:
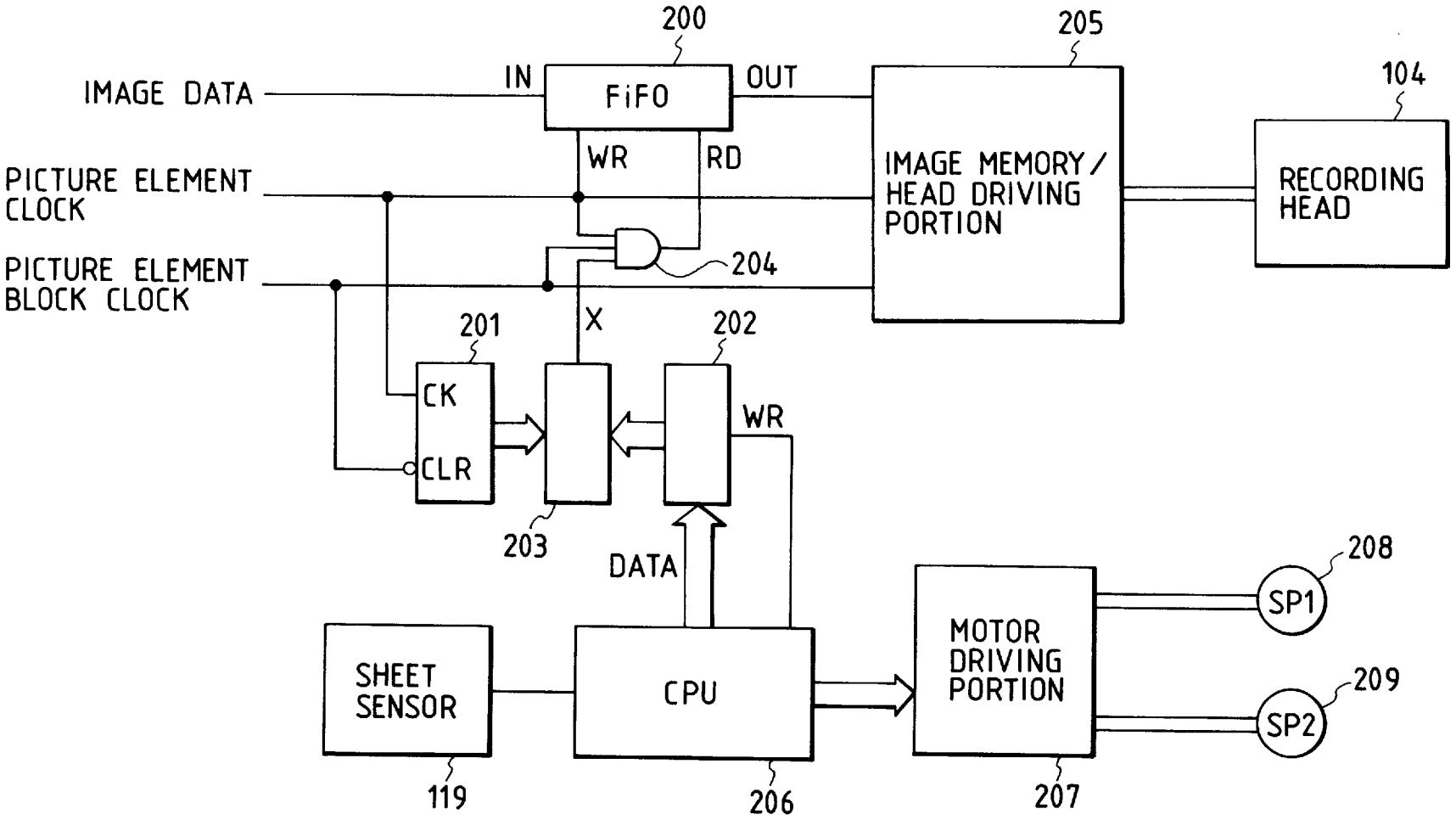
FIG. 33 is a block diagram showing a controlling section of an image recording apparatus shown in FIG. 30.

FIG. 33 is a block diagram showing the control section of the recording apparatus shown in FIG. 30.

In FIG. 33, the numerals designate respectively: 201, an up-counter for counting up a pixel clock and reset by a pixel block clock. The pixel block clock represents an effective area of the image data, and is equivalent to 128 pixel clocks; 202, a register having a printing dot position correcting value for the printing dot position which is set by a CPU 206; 203, a comparator for comparing a counted value in the up-counter 201 and the correcting value of the printing dot position correcting value set in the register 202, and generating an output X when both values are equal or the counted value is larger; 204, an AND gate for AND-calculating the output value of the comparator 203, the pixel clocks, and the pixel block clocks; 200, a FiFo memory for temporarily storing the image data, into which the image data is written synchronously with the pixel clocks and the written data is then read out in synchronicity with the output signal from the AND gate 204; 205, an image memory/head driving section for storing the image data sent from the FiFo memory 200 and driving the recording head in accordance with the stored image data; 208, a pulse motor for scanning the recording head; 209, a pulse motor for paper feeding (hereinafter referred to as a "driving motor"); 207, a motor driving section for driving the pulse motors 208 and 209 in accordance with the rear end amount obtained by the detecting operation of the paper sensor for the rear end of the sheet member.

In this embodiment, the conditions are set as follows:

dot diameter d: 0.0635 mm number of ink ejecting openings m: 128 recording width W (=m×d): 8.128 mm number of pulses n required to feed by the recording width W: 96 pulses conveyed amount t by the conveying roller at one pulse (=W/n): approximately 0.0847 mm/pulse conveying amount ratio of the tension rollers 112 and 113 to the conveying rollers 107 and 108: 1.01 conveying amount of the sheet member by the conveying roller on starting the recording operation: 20 mm distance a from the conveying rollers 107 and 108 to the detecting point of the sensor arm 119-1: 10.128 mm distance from the conveying rollers 107 and 108 to the ink ejecting section: 11 mm.

A method for conveying the sheet member 102 will now be described in detail.

Figure 32:
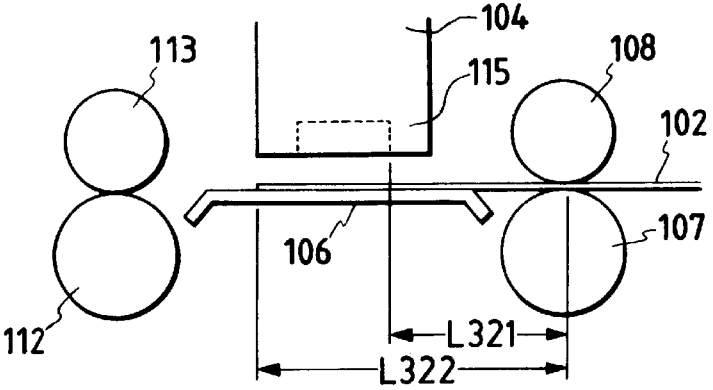
FIG. 32 is a diagram showing a state where the sheet member is sunk.

The sheet member 102 is fed by the conveying upper and lower rollers 107 and 108 by 20 mm and then stopped to become in a state as shown in FIG. 32 (D1=11 mm, D2=20 mm) for detecting the width of the sheet member 102 aforementioned. Thereafter, the sheet member 102 is fed by the amount 8.128 mm as the recording width W by the conveying lower roller 107 every time one line of the recording is completed by the recording head 104. These operations are re-iterated on the sheet member 102. When the paper sensor 119 detects that the rear end of the sheet member 102 reaches a position near the conveying lower roller 107, the size of the sheet member is determined from the paper width and the number of conveying steps needed until detecting the rear end of the sheet member by the paper sensor. In the following TABLE 1, there are shown: Width corresponding to sheets of various sizes; Number of paper feeding steps until the paper sensor 119 detects the rear end; and Remaining amount of the sheet member from the conveying roller 107 when detected by the paper sensor.

TABLE I is a diagram showing a relationship between a width corresponding to sheet materials of respective size and number of steps until detecting the rear end of the sheet and remaining amount of the sheet.

TABLE I

| (1) | (2) | (3) | (4) | (5) |
|---|---|---|---|---|
| B4 257 × 364 | 257 mm | 344 mm | 42 times | 2.624 mm |
| A4 210 × 297 | 210 mm | 277 mm | 33 times | 8.776 mm |
| 8.5 × 11 inch 215.9 × 279.4 | 215.9 mm | 259.4 mm | 31 times | 7.432 mm |
| B5 182 × 257 | 182 mm | 237 mm | 28 times | 9.416 mm |
| 5.5 × 8.5 inch 139.7 × 215.9 | 139.7 mm | 195.9 mm | 23 times | 8.956 mm |
| A5 148 × 210 | 148 mm | 190 mm | 23 times | 3.056 mm |
| B6 128 × 182 | 128 mm | 162 mm | 19 times | 7.568 mm |
| A6 105 × 148 | 105 mm | 128 mm | 15 times | 6.08 mm |

For example, if the width is 210 mm and the number of steps needed until the rear end detection by the paper sensor 119 is 33, the paper size is determined to be A4, such that the driving motor and the number of the ink ejecting openings are controlled properly for the remaining amount 8.776 mm of the rear end of the sheet member.

The driving motor and the number of the ink ejecting openings are controlled in a manner as disclosed in Japanese Patent Application No. 2-272394. In this embodiment, the following five kinds of controlling operations are carried out:

(1) Number of feeding pulses by the driving motor: 95; Printing dot position correction: 0 dot (no correction)

(2) Number of feeding pulses by the driving motor: 95; Printing dot position correction: 1 dot (3) Number of feeding pulses by the driving motor: 94; Printing dot position correction: 2 dots (4) Number of feeding pulses by the driving motor: 93; Printing dot position correction: 3 dots (5) Number of feeding pulses by the driving motor: 95; Printing dot position correction: 0 dot.

For example, the control of the above-noted item (2) is to set the number of feeding pulses by the driving motor 209 from normally 96 to 95 pulses, to set the feeding amount by steps to 95/96 of the normal amount, and not to perform the ejecting operation of one nozzle (opening) among the ink ejecting openings located at the most downstream side.

The other items of the control listed above also perform, in the similar manner as (2), the number of feeding pulses by the driving motor and the number of ink ejecting openings.

Figure 34:
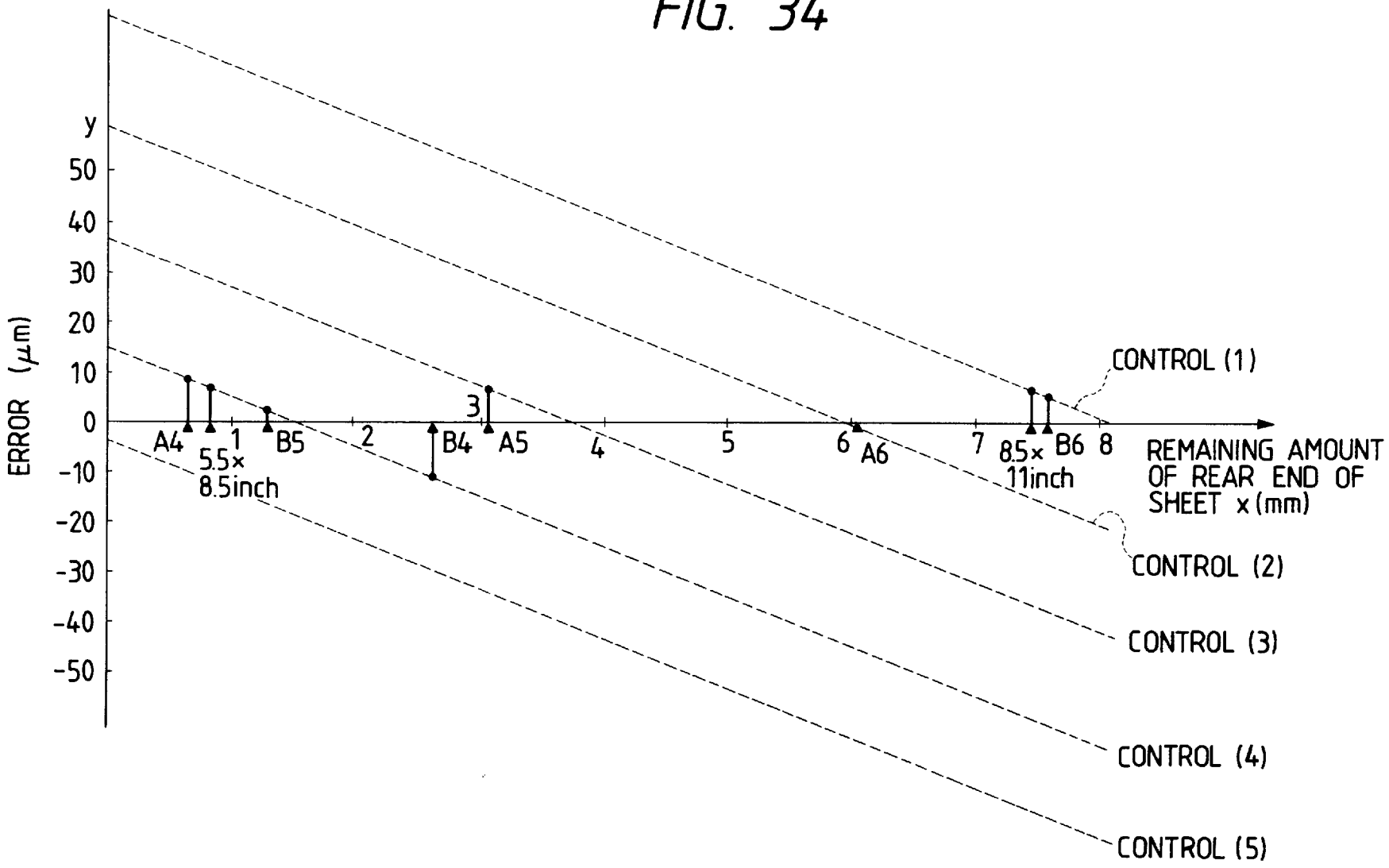
FIG. 34 is a diagram showing a relationship between a remaining amount at the rear end and an error of recording junction when the controlling operations are carried out in the fifth embodiment.

In FIG. 34, the horizontal axis represents the remaining amount of the rear end of the sheet member from the conveying lower roller when the above-mentioned five kinds of controls are performed, while the vertical axis represents the errors in combining the recordings. The positive (+) error represents a gap between the dots while the negative (−) error represents an overlapping of dots. To perform the recording operation, that having the smallest error among the five control modes (1)–(5) is selected in accordance with the remaining amount of the rear end of the sheet.

For example, if the sheet member is determined to be of A4 size, the remaining amount of the rear end would be 8.776 mm. Therefore, in the subsequent stepping feeding control is performed, as in the normal operation, with 8.128 mm of feeding and with 128 nozzles to be used. At this time, the remaining amount of the rear end would be 8.776 mm−8.128 mm=0.648 mm, and then the control of item (4) is carried out to record 0.009 mm of error. In the next recording, since the rear end of the sheet member will be completely out of the conveying lower roller 7 and be fed only by the tension lower roller 12, the state could be considered to be substantially the same as the case with no remaining amount of the rear end so as to perform the recording by item (5) with an error of approximately 0.004 mm. However, in practice, since the rear end of the sheet member would be fed by approximately 15.4 mm from the conveying lower roller 7 so as to enter the recording section, the recording operation of (5) cannot be performed, so that the recording operation finishes. Likewise, if the width is 148 mm and the number of feeding steps until the paper sensor detects the rear end of the sheet is 23, the paper size is A5 with the remaining amount of the rear end of 3.056 mm. In this case, item (3) is selected for the controlling operation to perform the recording with an error of approximately 0.007 mm.

In this embodiment, since the gap between the conveying lower roller 7 and the ink ejecting section is 11 mm, when the rear end of the sheet member comes out of the conveying lower roller 7 and is fed by more than approximately 2.96 mm, the next step of the recording operation cannot be performed since the recording section does not engage with the sheet member. Further, if the width is 139.7 mm and the number of feeding steps until the paper sensor 119 detects the rear end is 23, it becomes 5.5×8.5 inches with the remaining amount of the rear end of 8.956 mm. In this case, in the next step, item (1) of no correction is carried out to feed 8.128 mm, with the remaining amount of the rear end of 0.828 mm at this time. Here, the control of item (4) can be performed to record with an error of approximately 0.007 mm. For two sheets of 5.5×8.5 inch size and of A5 size, the number of steps until the paper sensor detection is the same, 23, but the remaining amounts of the rear end are mutually different, so the optimum control from the respective sheets is also different. This judgment is made by detecting the paper width. For the other sheet members of various sizes, the remaining amount of the rear end is also detected by the width of the sheet member and the number of steps until the paper sensor 119 detects the rear end to allow the most optimum control operation suitable for the remaining amount of the rear end as shown in FIG. 34 as to record in combination with high accuracy.

Figure 35:
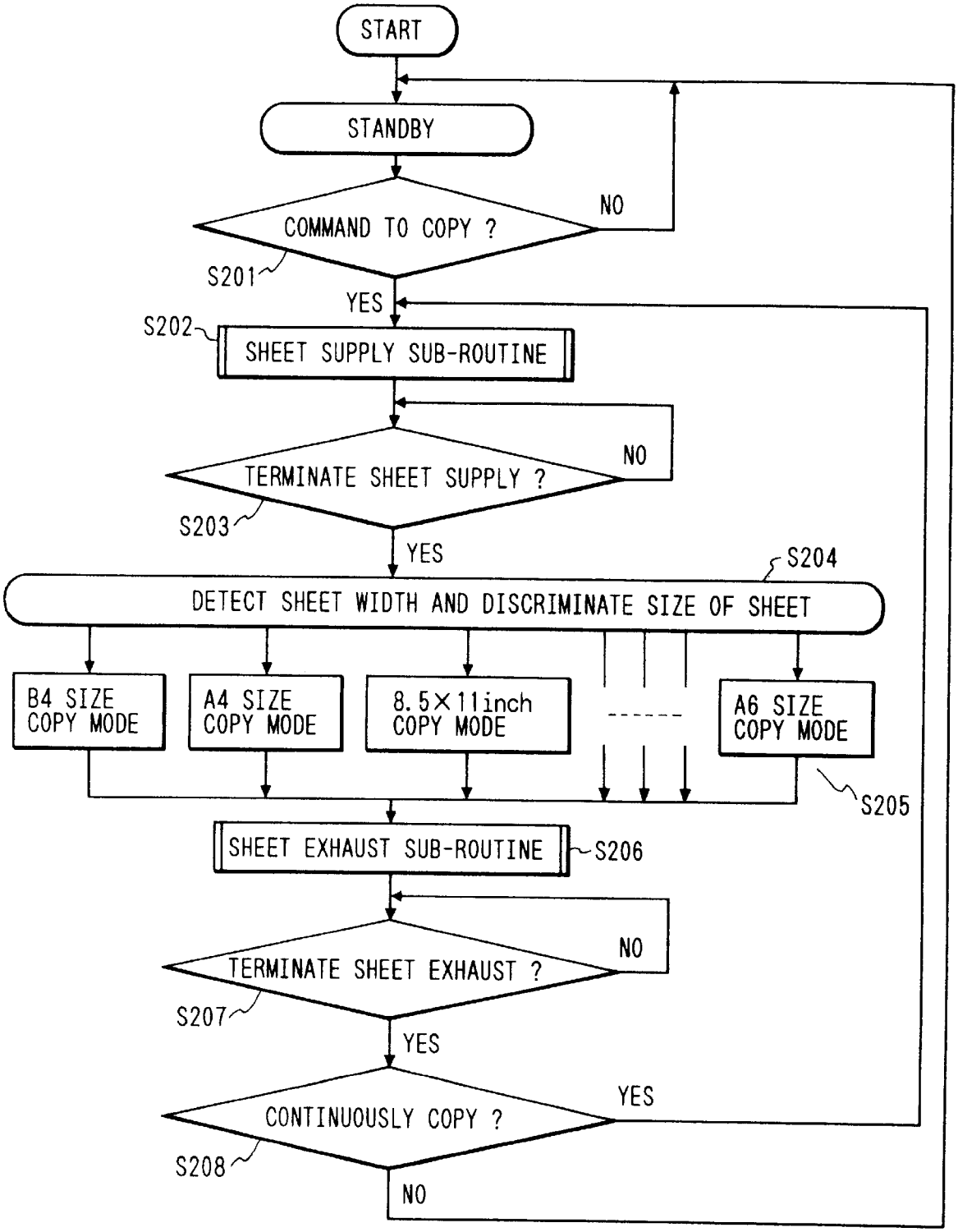
FIG. 35 is a flow diagram showing a sequence of a controlling operation in the fifth embodiment of the present invention.
Figure 36:
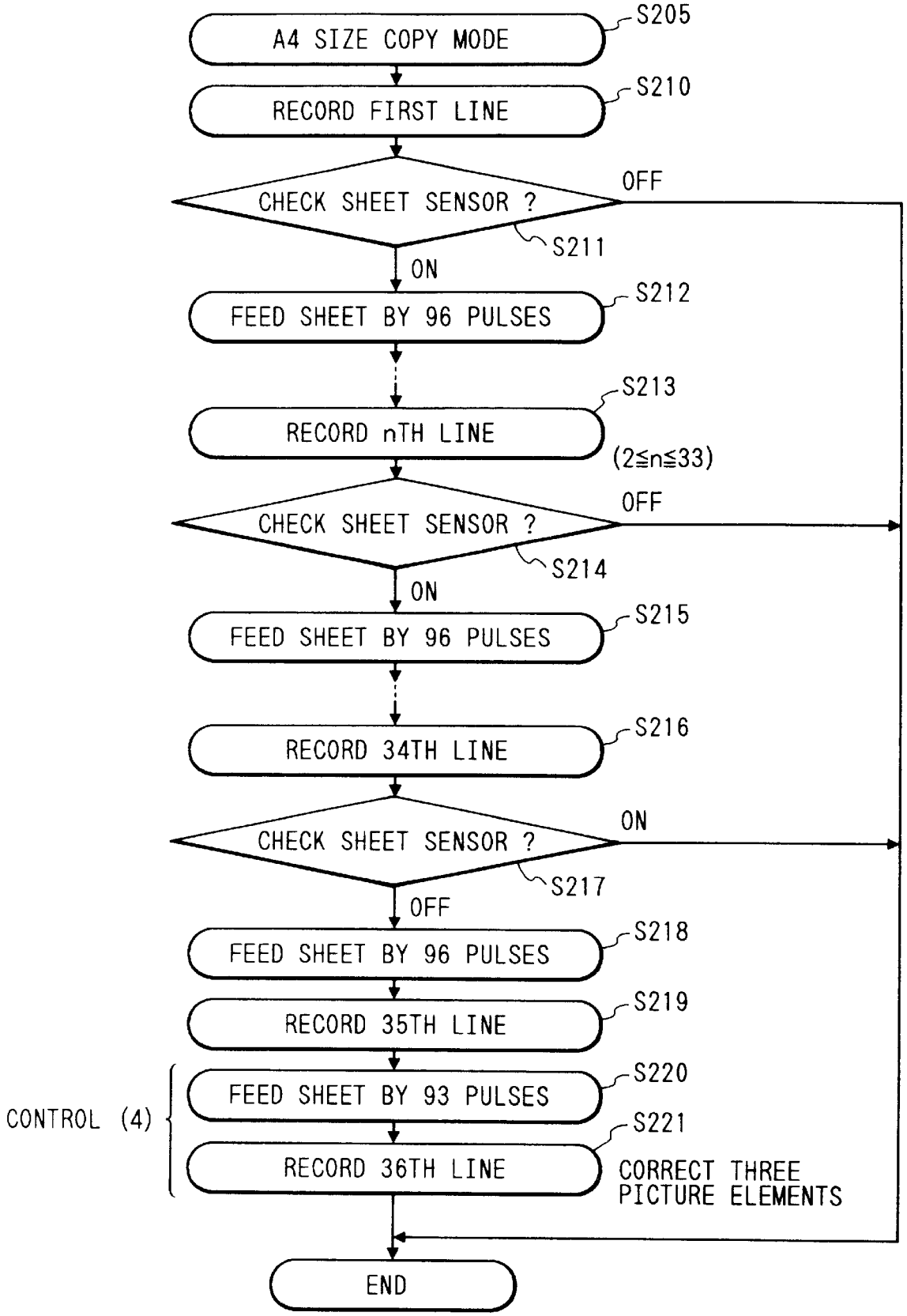
FIG. 36 is a flow diagram showing the details of a part of FIG. 35.

FIGS. 35 and 36 are flow diagram showing the controlling sequence of the present apparatus executed by the CPU 206. In step S201, the CPU 206 waits for an order to start the copying operation. In response to the order for starting, the CPU 206 controls to convey the sheet member until a position separated by 20 mm from the conveying lower roller 7 in step S202. In step S203, the finish of the paper feeding is waited for. Then, in step S204, the pulse motor 208 is driven to make the carriage 105 scan and make the paper width sensor 117 detect the width of the sheet member to detect its form size, thereby shifting to a copying mode (step S205) corresponding to the respective size. In step S205, a recording control operation in accordance with the respective form size is carried out.

FIG. 36 shows a control sequence in a copy mode for A4 size. First, in step S210, the carriage 105 is moved and ink is ejected from the ink ejecting section to perform the recording for the first line. In step S211, it is judged if the paper sensor 119 is turned on or off. If the paper sensor 119 is turned off (sheet not detected),it is not of A4 size so as not to advance any more, and the process shifts to a paper discharging sub-routing in step S206. In step S211, if the paper sensor 119 is turned on (detecting a sheet), the driving motor performs step feeding by 96 pulses in step S212, and in step S213 the second line is recorded. Next, it is judged whether the paper sensor 119 is turned on or off, and in the case of being turned off, the process finishes as in step S211 and advances to the paper discharging sub-routine in step S206, while in the case of being turned on, the step feeding of 96 pulses by the driving motor 109 is performed in step S215. Thereafter, in step S214, the steps through S213–S215 are re-iterated until the paper sensor 119 is turned off or until n=33 to continue the recording operation. In step S216, the 34th line is recorded, and in step S217, it is determined whether the paper sensor 119 is turned on or off, and in the case of being turned on, this means that the paper size is not A4 so as to finish the process. In the case of being turned off, it is ascertained that the paper size is A4, so that the step feeding of 96 pulses by the driving motor 109 is carried out in step S218, and in step S219 the 35th line is recorded. Subsequently, the recording of the 36th line, in which the three pixel correction is executed, is carried out in step S221 to end the process, and then it shifts to the paper discharging sub-routing in step S206 shown in FIG. 35.

In step S206, the paper is discharged, and in step S207, the completion of the paper discharge is waited, and then the process shifts to the paper feeding subroutine in step S202, and returns to the initial stand-by state if the copying is not continued.

Although in FIG. 36 the case in which the paper width is judged as being A4 has been described, the process is basically the same even when the size of the paper is judged as being another form size. The differences are the line corresponding to n in step S213, the line to which the recording of step S216 corresponds, and the paper feeding and recording operation in steps S218–S221 depending on the size, only.

In the above-mentioned embodiment, the description has been related to an image recording apparatus using only sheet members of form size, but in the sixth embodiment of the present invention, non-form size sheets can be used.

Figure 37:
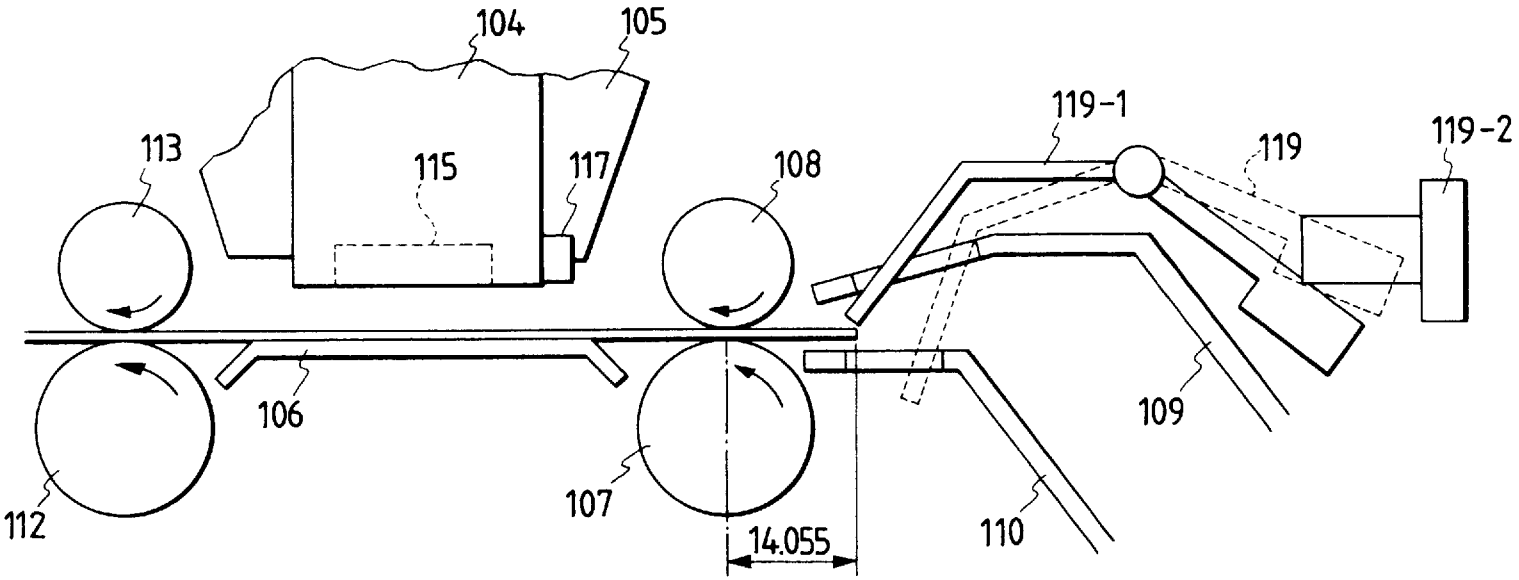
FIG. 37 is a diagram showing a schematic composition of an image recording apparatus according to the sixth embodiment of the present invention.

FIG. 37 shows a schematic view showing an image recording apparatus of this embodiment, in which the distance from the conveying lower roller to the detecting point of the sensor arm 119-1 is 14.055 mm. The other composition is the same as that of the fifth embodiment.

The following TABLE II shows, for the respective sheet size: Width; number of steps until the paper sensor 119 detects the sheet member; and remaining amount of the sheet member from the conveying lower roller 107 when the sheet member is detected by the paper sensor 119.

TABLE II is a diagram showing a relationship between the width corresponding to the sheet material of the respective size and number of steps until detecting the rear end and remaining amount according the sixth embodiment of the present invention.

TABLE II

| (1) | (2) | (3) | (4) | (5) |
|---|---|---|---|---|
| B4 257 × 364 | 257 mm | 344 mm | 4l times | 10.752 mm |
| A4 210 × 297 | 210 mm | 277 mm | 33 times | 8.776 mm |
| 8.5 × 11 inch 215.9 × 279.4 | 215.9 mm | 259.4 mm | 3l times | 7.432 mm |
| B5 182 × 257 | 182 mm | 237 mm | 28 times | 9.416 mm |
| 5.5 × 8.5 inch 139.7 × 215.9 | 139.7 mm | 195.9 mm | 23 times | 8.956 mm |
| A5 148 × 210 | 148 mm | l90 mm | 22 times | 11.184 mm |
| B6 128 × 162 | 128 mm | 142 mm | l9 times | 7.568 mm |
| A6 105 × 148 | 105 mm | 128 mm | l5 times | 6.03 mm |

(1): Size of the sheet member
(2): Width of the sheet member
(3): Remaining amount after being conveyed 20 mm
(4): Number of steps until the sensor detection
(5): Remaining amount at the sensor detection For form-sized sheet members, the optimum controlling operation is carried out on the basis of the width and the number of steps until the sensor detection of the rear end in TABLE II, in the same manner as in the fifth embodiment.

Figure 38:
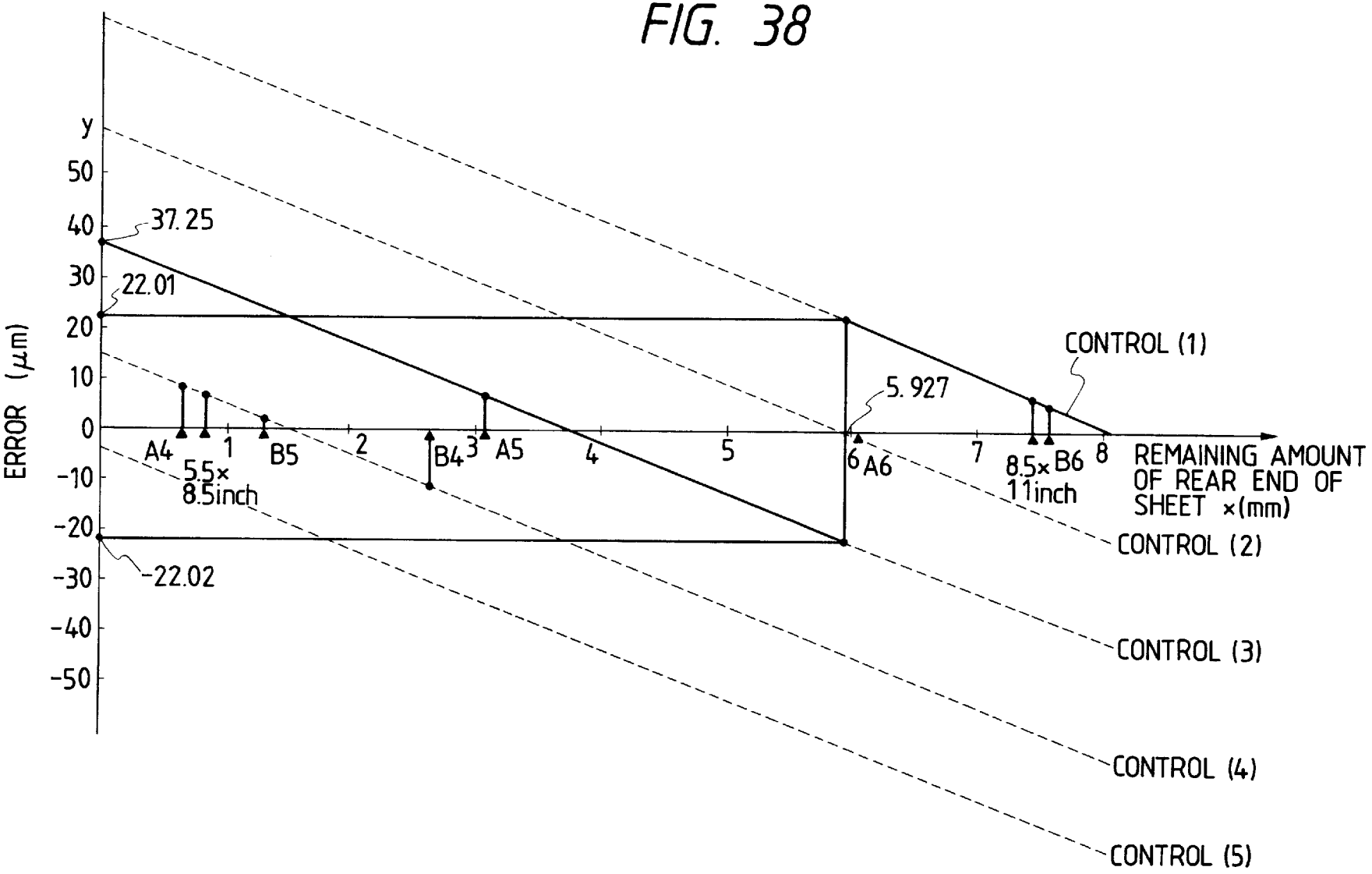
FIG. 38 is a diagram showing a relationship between the remaining amount of the rear end and an error of a recording junction when the controlling operations are carried out in the sixth embodiment of the present invention.

FIG. 38 shows a relationship between the remaining amount at the rear end and the combining error in each control of the sixth embodiment. In this case, the line shown at the position with a remaining amount of 5.927 mm represents the detecting point of the paper sensor 119-1. Although the actual detecting point lies at a position separated by 14.055 mm from the conveying lower roller 107, it is shown in the drawing at a position deviated by a feeding amount for one step, 8.128 mm for descriptive convenience.

When a non-form size sheet member is conveyed, the width of the sheet member and the number of steps until the paper sensor 119 detects the rear end of the sheet member does not have such a relationship as shown in TABLE II. In this case, at the time when the paper sensor 19 detects the rear end of the sheet member, the remaining amount x of the rear end would be $5.927 \leqq x < 14.055$. The subsequent step feeding is the normal one, the item (1) of the previous list, for feeding 8.128 mm.

In such a state, the remaining amount x at the rear end would be $-2.201 \leqq x < 5.927$. Here, when x is negative (−), the rear end is at the downstream side of the conveying lower roller 107, representing that the sheet member has come out of the conveying lower roller 107 and is fed by the tension roller 112. Therefore, on terminating this step, if the remaining amount x of the rear end is in the range of $0 \leqq x < 5.927$, the combining error is zero. Meanwhile, $-2.201 \leqq x < 0$, i.e., when the paper sensor 119 detects that the rear end is measured in the range of $5.927 \leqq x < 8.128$, the error of the control (1) in the range of $5.927 \leqq x < 8.128$ would be in the range of 0–22.01 μm. In the subsequent step, the control of item (3) is carried out. If the remaining amount x of the rear end when the control (3) is performed is in the range of $-2.201 \leqq x < 0$, the error would be 37.25 μm, likewise, the rear end amount 0 mm in FIG. 38, and in the range of $0 \leqq x < 5.927$, the error range would be within −22.02 μm −37.25 μm.

In this manner, even for non-form sized sheet material, reliable recording combination with less errors can be achieved by setting the detecting point of the paper sensor 119 to a proper position, and by judging as being non-form sized sheets from the width of the sheet and the number of steps until the paper sensor 119 detects the rear end thereof.

Figure 39:
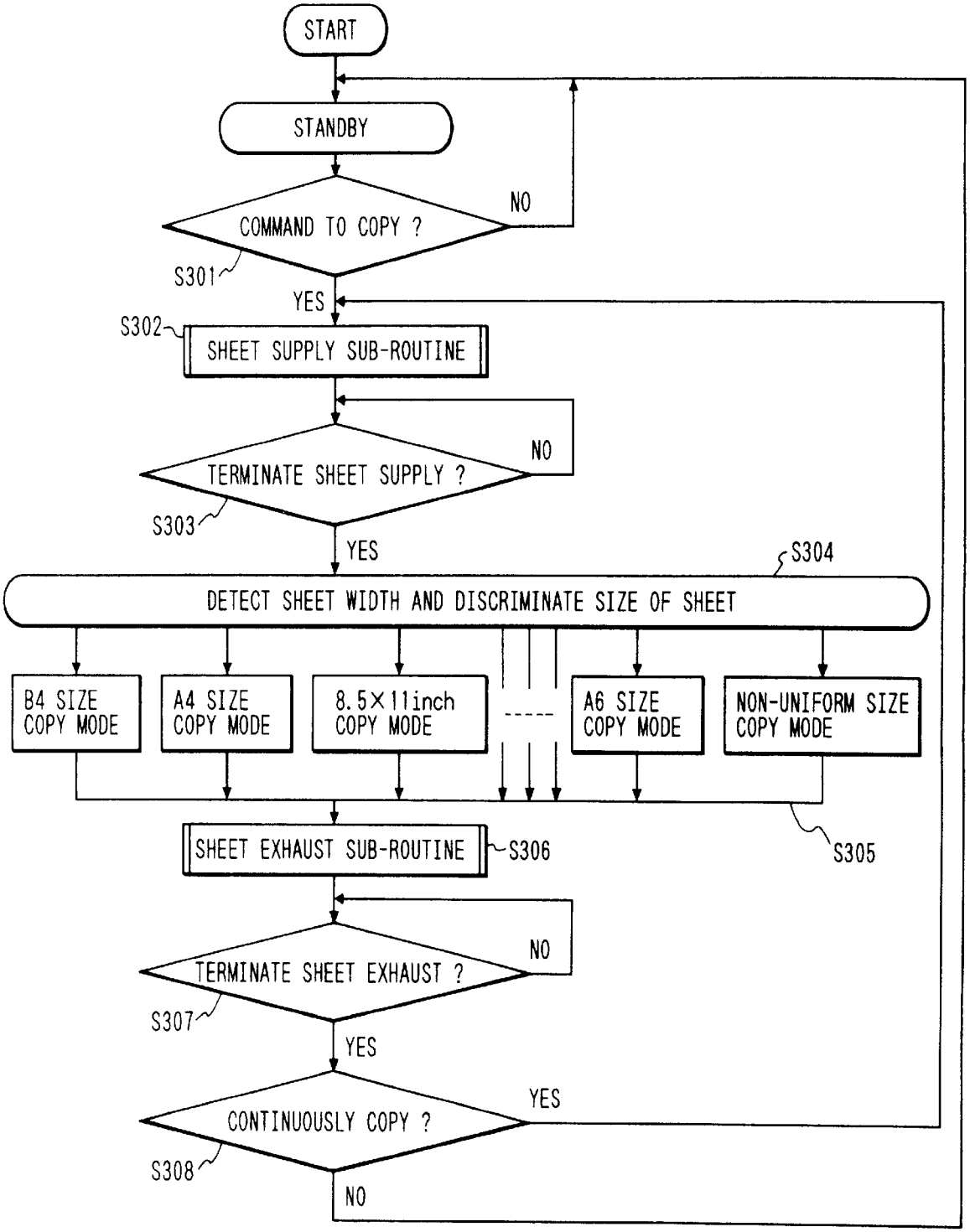
FIG. 39 is a flow diagram showing a sequence of the controlling operation according to the sixth embodiment of the present invention.
Figure 40:
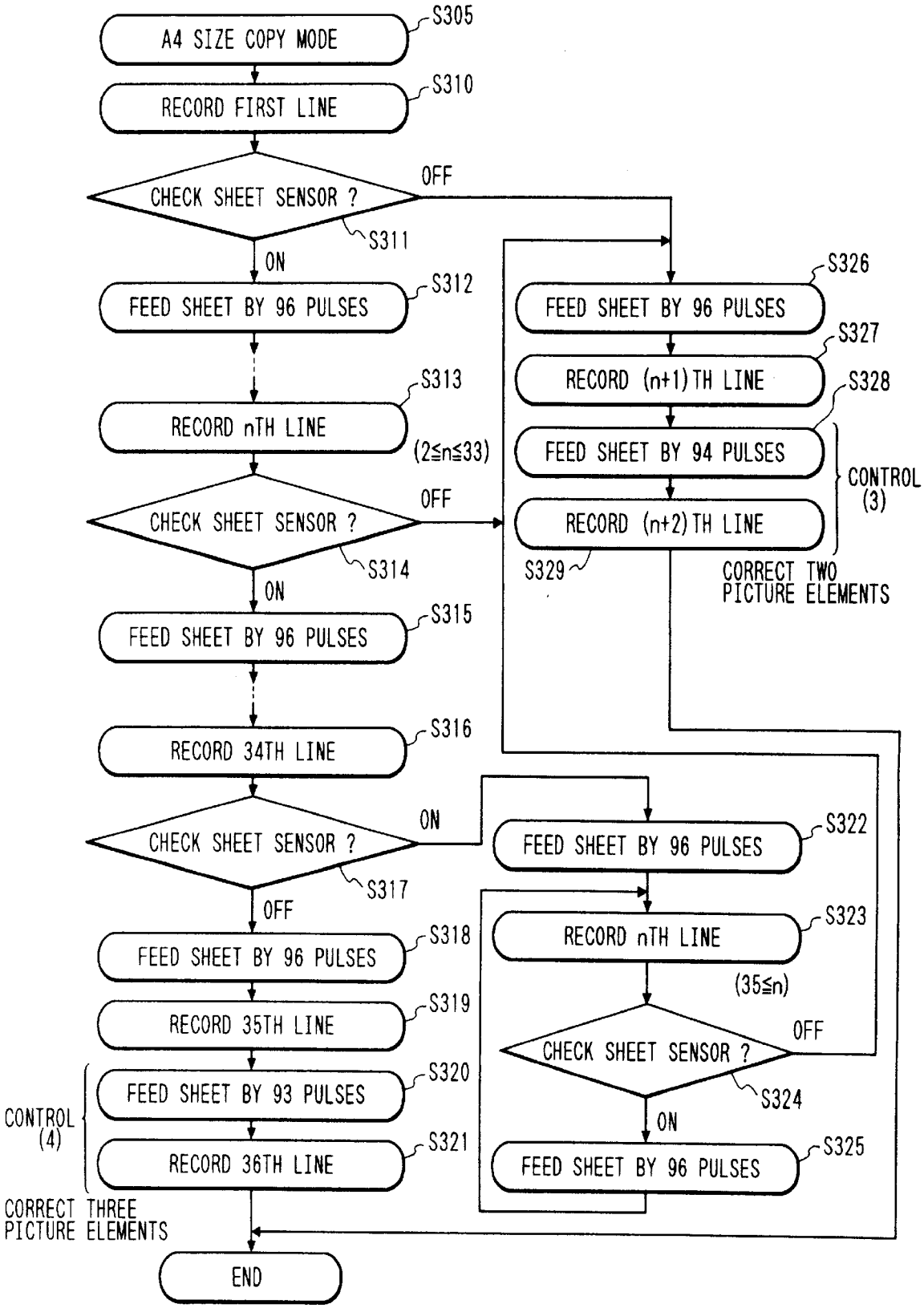
FIG. 40 is a flow diagram showing in detail a part of FIG. 39.
Figure 41:
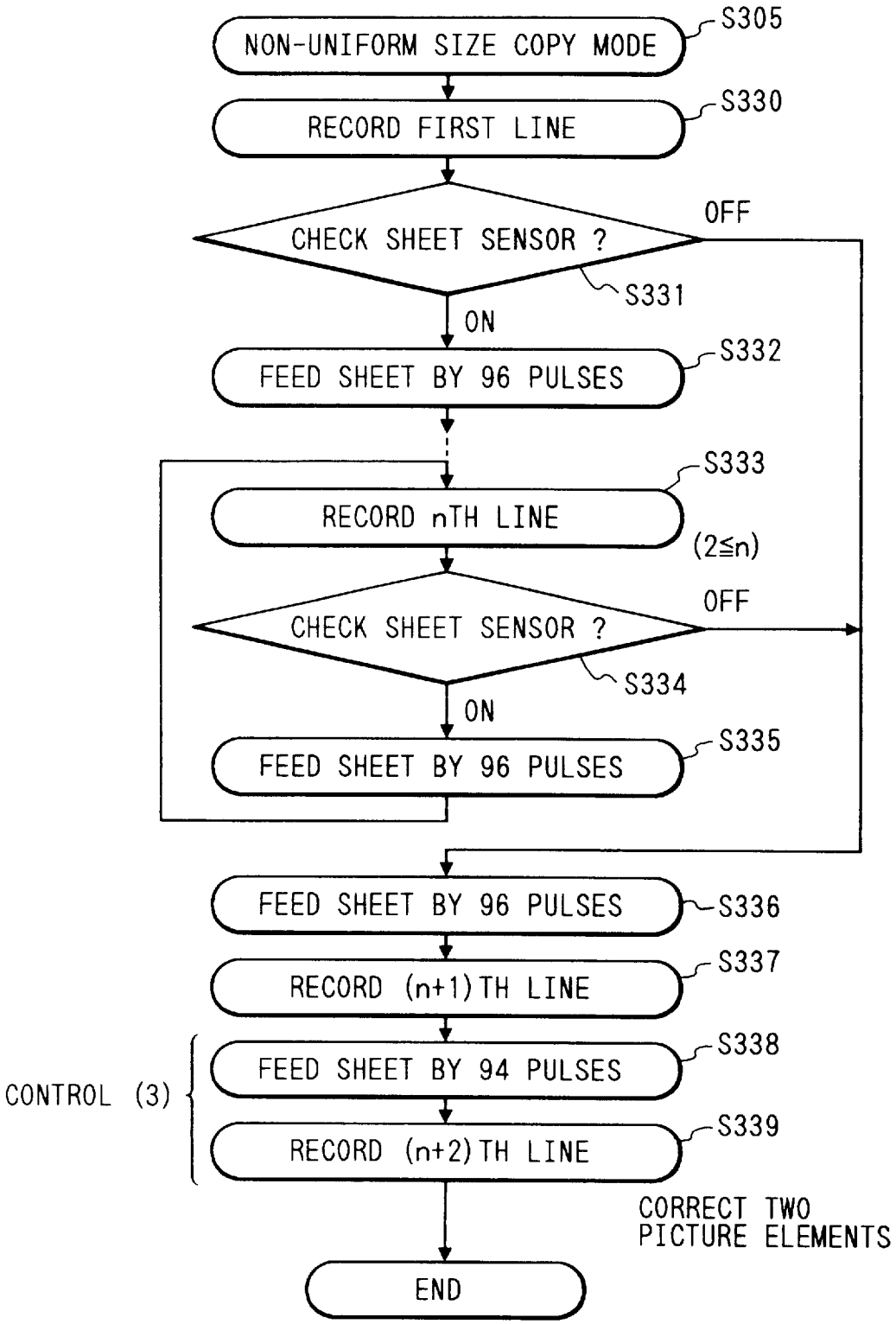
FIG. 41 is a flow diagram showing in detail a part of FIG. 39.

FIGS. 39–41 are flow diagrams showing the controlling sequences embodying the sixth embodiment of the present invention. In step S301, a copy starting order is waited for. In response to the starting order, the sheet member is conveyed until a position separated by 20 mm from the conveying lower roller 107, and then the completion of the paper feeding is waited in step S303. In step S304, the pulse motor 29 is driven to allow the carriage 105 to scan while the paper width sensor 117 detects the width of the sheet member to determine the corresponding form size, and then the process shifts to a copying mode (step S305) corresponding to the respective size. In step S305, recording operations corresponding to the respective form size are carried out. In a case of a non-form sized sheet, the process shifts to a non-form sized sheet mode shown in FIG. 41.

FIG. 40 shows a controlling sequence for A4 size sheet. First, in step S310, the carriage 105 is driven and ink is ejected from the ink ejecting section to perform recording on the first line, and in step S311, it is determined whether the paper sensor 119 is turned on or off. If the paper sensor 119 is turned off, i.e., no sheet member is detected, this means that the sheet is not A4 size, but therefore, non-form size. As a result, the process shifts to step S326 where step feeding of 96 pulses is carried out by the driving motor 209 as a controlling operation for non-form size sheet. In step S311, if the paper sensor 199 detects the turned-on state i.e., the sheet member, a step feeding of 96 pulses is performed by the driving motor 209 in step S312.

Then, in step S313, the second line is recorded. And the paper sensor 119 determines whether it is in a turned on or off state, and in the case of being turned off, the sheet is determined as being a non-form size in the same manner as in step S311, and the process shifts to step S326. In the case of being tuned on, a step feeding of 96 pulses by the driving motor 209 is performed in step S315. Thereafter, in step S314, the steps S313 through S315 are re-iterated until the paper sensor 19 turns off or until n=33 to continue the recording operation. In step S316, the 34th line is recorded, and in step S317 it is determined whether the paper sensor 119 is turned on or off. In the case of being turned on, it is non-form size so that the rear end does not yet reach the paper sensor 119, the normal step feeding of 96 pulses is carried out in step S322. In the next step S323, an nth ($35 \leqq n$) line is recorded, and in step S324, it is judged whether the paper sensor 119 is turned on or off. In the case of being turned on, a step feeding of 96 pulses is performed in step S325, and returns to step S323 to perform the recording. In step S324, the process continues until the paper sensor 119 turns off, and after it is turned off, a step feeding of 96 pulses is carried out by the driving motor 96 in step S326, and thereafter, the normal recording operation is executed in step S327. In step S328, a step feeding of 94 pulses is carried out as the control (3), in step S329 the recording for two pixel correction is performed, and then the process shifts to the paper discharging sub-routine in step S306. In step S317, if the paper sensor 119 is turned off, the sheet size is judged to be A4 size, and then the same controlling operation as in steps S218–S221 in the fifth embodiment is carried out in steps S218–S321, and then the process shifts to the paper discharging sub-routine in step S306.

If the sheet is judged to be non-form size in step S304, the control would be as shown in FIG. 41. First, in step S330, the carriage 105 is moved and ink is ejected from the ink ejecting opening to perform the recording on the first line, and in step S331 it is determined whether the paper sensor 119 is turned on or off. In the case of being turned off, the process shifts to step S336 for the controlling operation of the rear end, while in the case of being turned on, this means that the rear end does not yet reach the paper sensor 119, and a normal step feeding of 96 pulses is carried out in step S332.

Next, in step S332 an nth ($2 \leqq n$) line is recorded, and in step S324, it is determined whether the paper sensor 119 is turned off or on. In the case of being turned on, a step feeding of 96 pulses is performed in step S335, and then the process returns to step S333 to perform the recording. The recording is continued until the paper sensor 119 is turned off in step S334. After turning off of the sensor, a step feeding of 96 pulses is performed by the driving motor 209 in step S336 as a control (1) for the rear end of a non-form sized sheet, and in step S337 the normal recording operation is carried out. As the control (3), in step S338, a step feeding of 94 pulses is performed by the driving motor 209, and in step S339, the two pixel correction is performed, and then the process shifts to the paper discharging sub-routine in step S306 to discharge the sheet. The completion of the discharging operation is waited in step S307, and in step S308 it is judged whether it is in a continuous copying mode, or not, and in the case of the continuous copying mode the process shifts to the paper feeding sub-routine in step S302, and otherwise, it returns to the initial stand-by state.

Although the sheet member is fed in the longitudinal direction in both the fifth and sixth embodiments, if there are included widthwise feeding sheets, for example, the widths for widthwise feeding of A5 size and for the longitudinal feeding of A4 size are both 210 mm. In the fifth embodiment, the number of steps for the rear end detection would be 33 and 15 times. Therefore, if the number of steps in the case of a width of 210 mm is 33, it is judged as being longitudinal feeding of A4 size, and if it is 15, in the case of a width of 210 mm, it is judged as being widthwise feeding of A5 size, to perform the optimum controlling operation.

In the aforementioned embodiment, although the control has been performed using the number of steps until the paper sensor 119 turns off, alternatively, for example, a time from the recording start to the turning off of the paper sensor 119 also can be used for the same purpose.

By providing a control means which varies both or either one of the conveying amount of the sheet conveying means and the recording area of the recording means on the basis of the width of the detected sheet member and the number of steps of conveying by the sheet conveying means until the detection of the rear end of the sheet, it is possible to perform highly accurate image recording even at the end portion of the sheet member.

Next, a seventh embodiment of the present invention will now be described. In this embodiment, the total number of ink ejecting openings of the recording head 4 is set larger than that used for the actual recording to change the usable area of the entire ink ejecting opening (also called an injecting element) between before and after the sheet passes through the conveying upper and lower rollers, thereby enabling preventing any blank portion from being generated between the lines, so as to provide an accurate combination.

Figure 42:
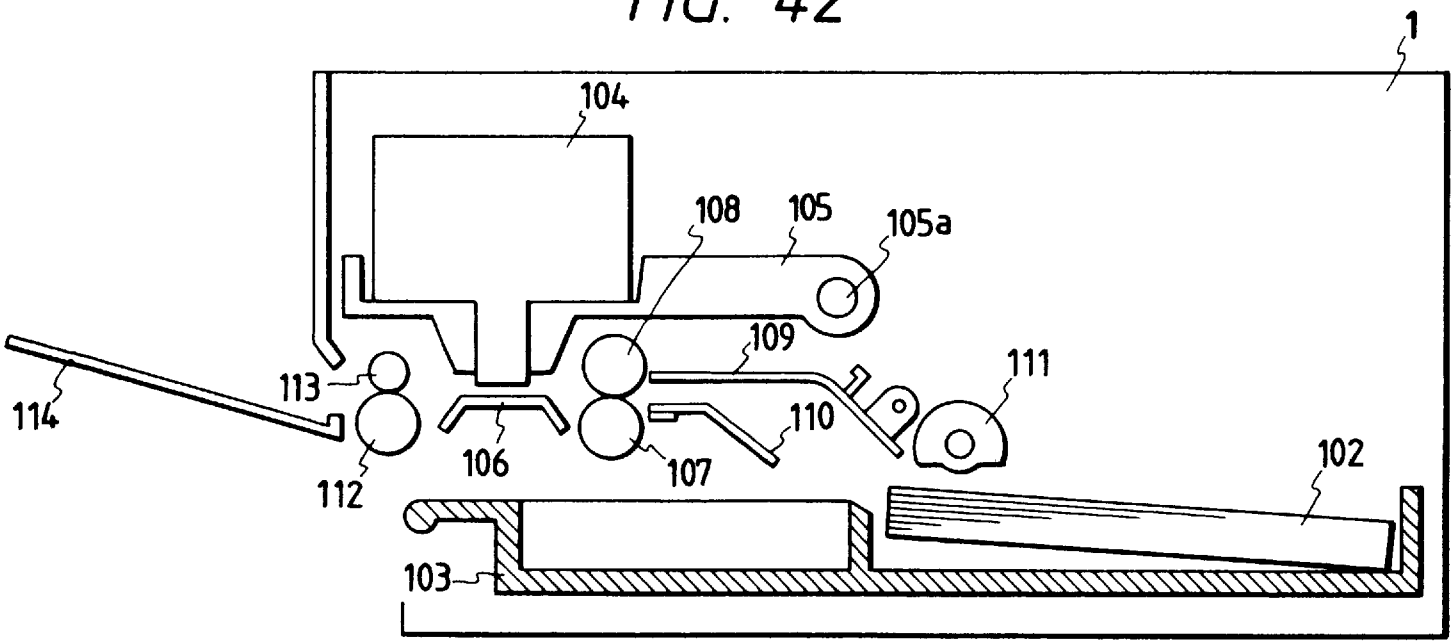
FIG. 42 is a cross-sectional view of an image recording apparatus according to the seventh embodiment of the present invention.

FIG. 42 shows a schematic view of an image recording apparatus according to the present embodiment. The numeral 101 designates an image recording apparatus body having a bottom portion on which a cassette 103 contains a plurality of accumulated sheet members 102. At the left-hand side of FIG. 42, a carriage incorporating a recording head 104 is disposed, and a platen 106 is located below the recording head 104.

The recording head is an ink jet type head in which recording is performed on the sheet member 102 by applying thermal energy to the ink to generate a state change so as to provide an injection of the ink drops. At the rear end of the injection element portion, there are provided m nozzles of the injection elements which contain an ink chamber (not shown) to output ink drops through the m injecting elements 116 in response to image signals. A carriage driving motor (not shown) is connected to the carriage through a timing belt, so the carriage 105 is reciprocally moved by the carriage driving motor along the guide shaft 105*a*.

To correctly combine the resulting record of each line, the feeding accuracy of the sheet member 102 by the conveying lower roller 107 should be significantly high. Therefore, the conveying lower roller 107 has an external diameter accurately finished, and a pulse motor having an excellent stopping accuracy is used as a driving apparatus. The rotating angle is controlled by pulses.

In the recording apparatus, when the paper feeding roller 111 is rotated by the feeding signal, the most upper sheet of the sheet member 102 is separated and supplied between the paper feeding guides 109 and 110.

Next, the sheet member 102 is guided by the paper feeding guides 109 and 110 to be fed and held between a conveying lower roller 107 rotated by a not shown driving motor and a conveying upper roller 108, rotated dependently by the conveying lower roller 107.

Then, the sheet member 102 further passes through the platen 106 by the conveying force of the conveying lower and upper rollers 107 and 108 to the tension upper and lower rollers 112 and 113. When the rear end of the sheet member 102 is held between the tension upper and lower rollers 112 and 113, the feeding movement is temporarily stopped.

Although the tension lower roller 112 rotates interlocking with the conveying lower roller 107, since the conveying amount is set to a value somewhat larger than the actual amount and its sheet member holding force is set weaker than that of the conveying upper and lower rollers 107 and 108, a proper tension is applied to the sheet member 102 for preventing it from being relaxed.

In this state, the recording head 104 moves from the leading side in FIG. 42 toward the rear side by the carriage 105, and injects ink in response to the image signal to provide a recording of a constant width (recording width) on the sheet member 102. The recording width W can be expressed by m×p where p is a pitch between the injecting elements and m is the number of nozzles of the injecting elements.

Each time the recording of one line is terminated, the sheet member 102 is fed by the same amount W as the recording width by the conveying roller to perform the recording for the next line.

Figure 43:
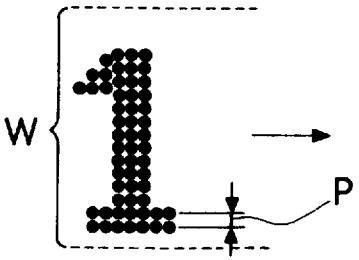
FIG. 43 is a diagram showing an example of a recorded image of the present invention.

By re-iterating the aforementioned operation, the recording operation continues on the sheet member 102, the sheet member 102 is discharged through the tension upper and lower rollers 112 and 113 to the paper discharging tray. An example of the image recorded on the sheet member is shown in FIG. 43 (recording width W=p×m; arrow indicates scanning direction of recording head; p=pitch between jetting elements).

Figure 44:
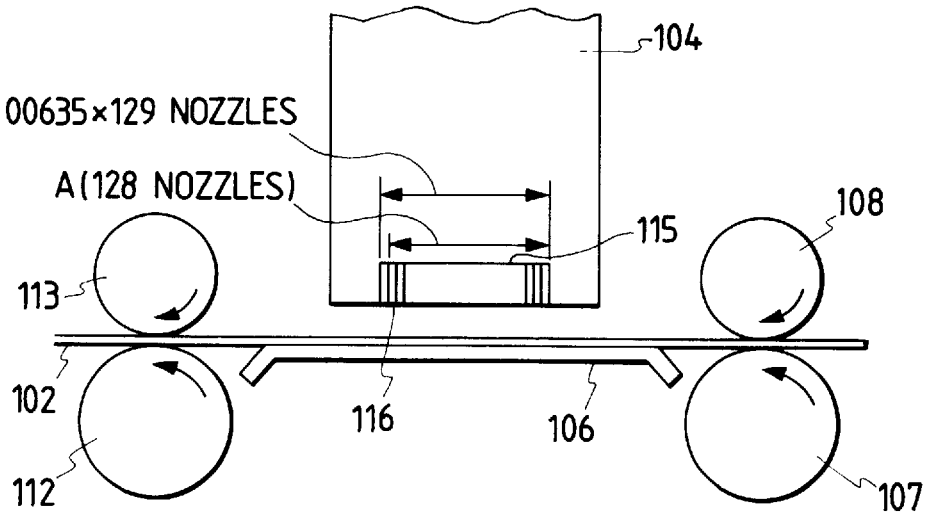
FIG. 44 is a diagram showing a schematic structure of an image recording apparatus according to a seventh embodiment of the present invention.
Figure 45:
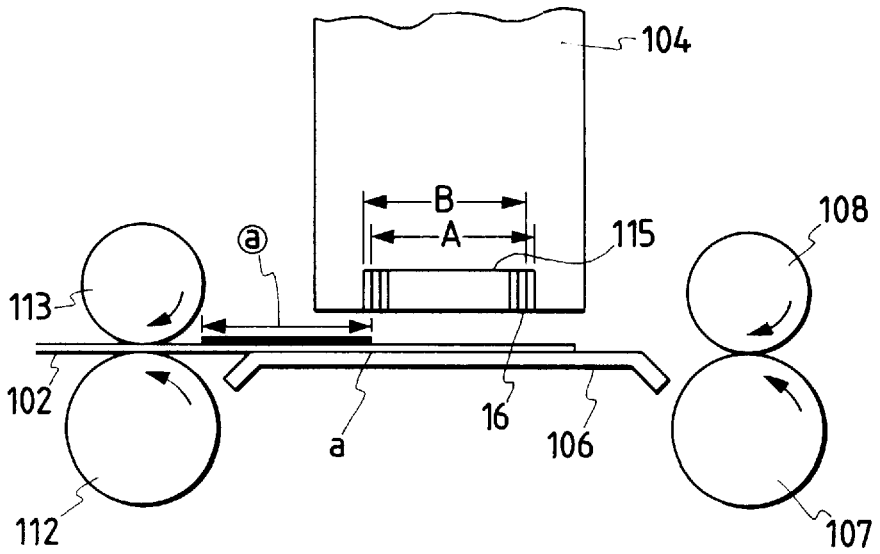
FIG. 45 is a diagram for the explanation of a relationship between a conveyed state of the sheet material and the recorded position.

In the present embodiment, as shown in FIG. 44, the conditions are set as follows:

Pitch p between the injecting element: 0.0635 mm

Number of nozzles of the injecting elements m1 used at recording: 128

Recording width W (=m×p): 8.128 mm

Conveying amount L1 (=W) by the conveying roller for one step: 8.128 mm

Conveying amount L2 by the tension roller for one step: 8.128+0.0635=8.1915 mm Number of nozzles m2 for all the injecting elements (ml=1): 129.

Each time that the 128 nozzles at the A portion near the conveying lower roller 107 among the 129 nozzles of the injecting elements of the recording head 104 complete the recording operation for one line (width W), the same amount L1 as the recording width W of the sheet is fed by the conveying lower roller 107.

Figure 47:
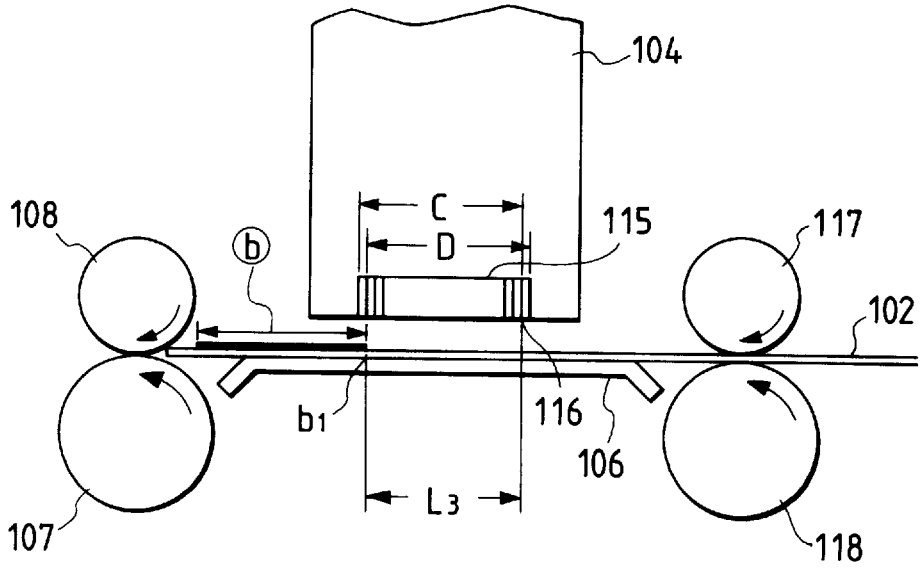
FIG. 47 is a diagram showing a relationship between a conveying state of sheet material and a recording position.

After such a series of recording processes is continued, when the rear end of the sheet member 102 comes out of the conveying upper and lower rollers 107 and 108, the sheet member 102 is conveyed by the tension roller 112. The conveying amount L2 (8.1915 mm) at this time is set to be larger than that L1 by the conveying lower roller 7 by 0.063 mm equivalent to one pitch p between the injecting elements. Here, if the same recording operation as aforementioned is continued, since the portion a recorded before the step feeding is continued by an amount larger than the recording width W by 0.0635 mm as shown in FIG. 47, the rear end a1 of the a portion does not align with the front end portion of the 128 nozzles at a portion, but comes to a position advanced by one pitch of the injection element in the paper feeding direction. Therefore, in such a state, the 128 nozzles of the injection elements used for the recording are those of the B portion deviated by one pitch in the paper feeding direction, to realize a blankless combination. In this case, the timing for changing the nozzles from the A portion to the B portion is determined by previously recognizing the step feeding in which the rear end of the sheet member 102 passes through the conveying upper lower rollers 107 and 108.

In this embodiment, since the gap between the conveying rollers 107, 108 and the injecting elements is small and therefore, there is only one step of feeding after the rear end of the sheet member passes through the conveying rollers 107, 108, the number of nozzles of the injecting elements is set to be larger by one than that of the injecting element actually used in recording, 128. But if the gap is large and there are more than two steps of feeding after that, it is possible to provide a head having more nozzles by that number of steps, and to move the nozzle to be used one by the number of that step, and to move the nozzle to be used one by one number of that steps, and to move the nozzle to be used one by one in accordance with the times of conveying by the tension rollers 112 and 113.

Further, in this embodiment, if the length of the sheet member is not constant, it is possible to dispose a sensor for detecting the sheet member at the upstream side of the conveying lower roller to detect the rear end of the sheet member 102 so as to determine the timing for changing the injecting elements to be used.

Further, in this embodiment, although the conveying amount L2 by the tension roller 112 is set to be larger than that of L1 by the conveying lower roller 107 by an amount equivalent to one pitch p between the injecting elements, it is alternatively also possible to set it to be larger by a plurality of pitches such that the injecting elements to be used for recording are shifted by the set pitch each time.

Figure 46:
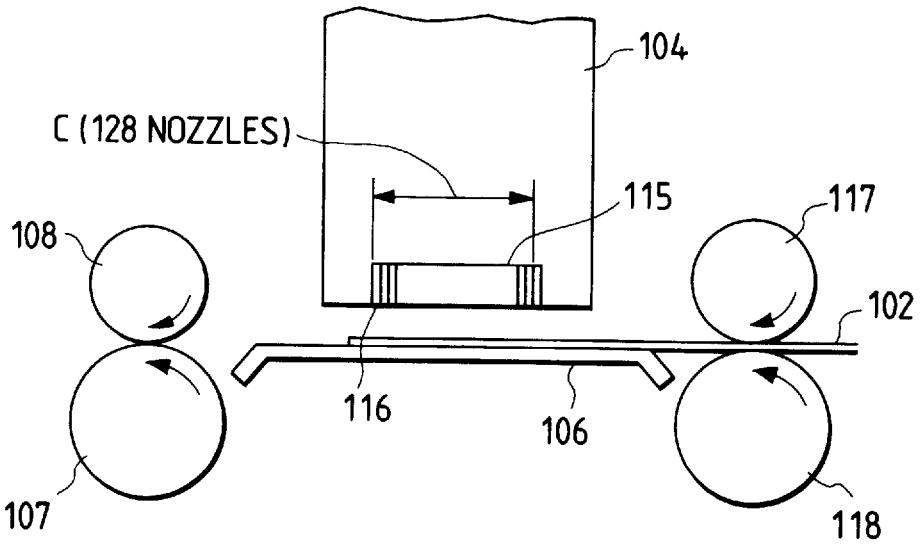
FIG. 46 is a diagram showing a schematic structure of an image recording apparatus according to an eighth embodiment of the present invention.
Figure 48:
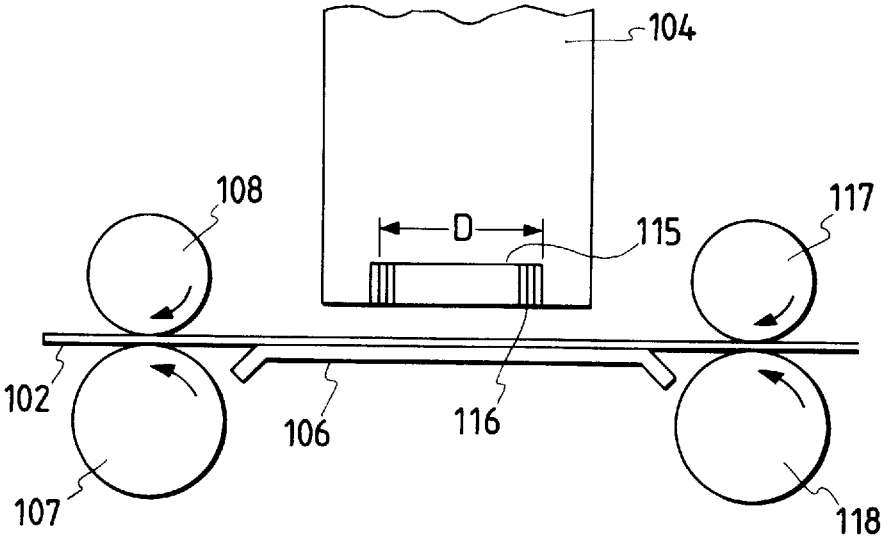
FIG. 48 is a diagram for the explanation of the conveyed state of the sheet material and the recorded position.
Figure 49:
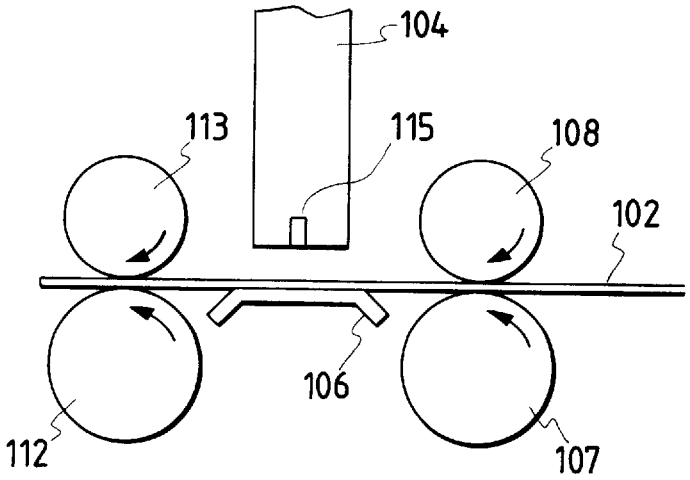
FIG. 49 is a diagram showing a schematic structure of an image recording apparatus according to the ninth embodiment of the present invention.
Figure 50:
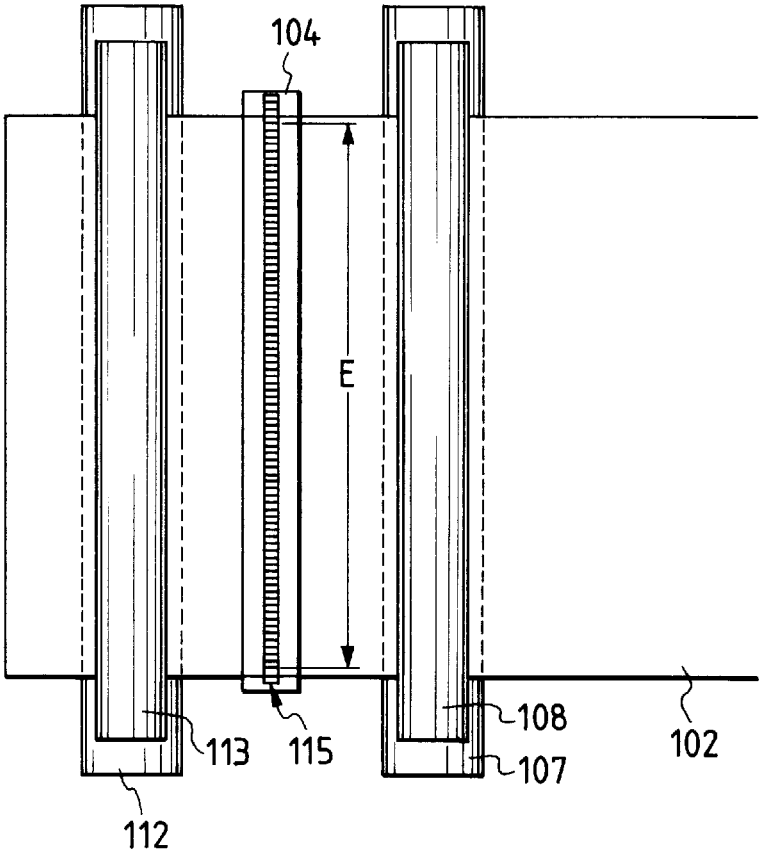
FIG. 50 is a plan view showing a relationship between a recording head and a sheet material in an image recording apparatus shown in FIG. 49.

The eighth embodiment of the present invention will now be described with reference to FIGS. 46–48. In this embodiment, tension rollers 117 and 118 are provided at the upstream side of the recording section, while conveying rollers 107 and 108 are provided at the downstream side. The sheet member 102 is first conveyed by the tension rollers 117 and 118, and then stopped in the state shown in FIG. 46. Among 129 nozzles of the injecting elements, 128 nozzles of the C portion located at the downstream side are used to perform the recording operation with the recording width W (8.128 mm). Subsequently, a feeding of a conveying amount L3: 8.128 mm−0.0635 mm (−8.0645 mm) is carried out by the tension rollers 118 and 117 (FIG. 47). In this case, the rear end b1 of the recording section b recorded by the nozzles of the C portion is not aligned with the front end portion of the 128 nozzles of the C portion, but reaches a position at the upstream side by 0.0635 mm. Therefore, the next recording is performed by using 128 nozzles of the D portion deviated by one nozzle toward the upstream side from the C portion.

In the conveying of the sheet member 102 in the next step, since the rear end of the sheet member is fed from immediately before the nips of the conveying rollers 107 and 108, the conveying amount would be 8.128 mm. Therefore, when the sheet member 102 is fed to the conveying lower roller 107 as shown in FIG. 48, the injecting elements used for the recording operation would be the 128 nozzles of the D portion to achieve the recording operation even to the rear end of the sheet member 102.

In this embodiment, although the number of injecting elements is set to 129, when several steps are required until the rear end of the sheet member enters the conveying rollers due to a large gap between the injecting elements and the conveying rollers, it is possible to provide a head having more nozzles by the number of steps and to shift the nozzles to be used sequentially.

Figure 51:
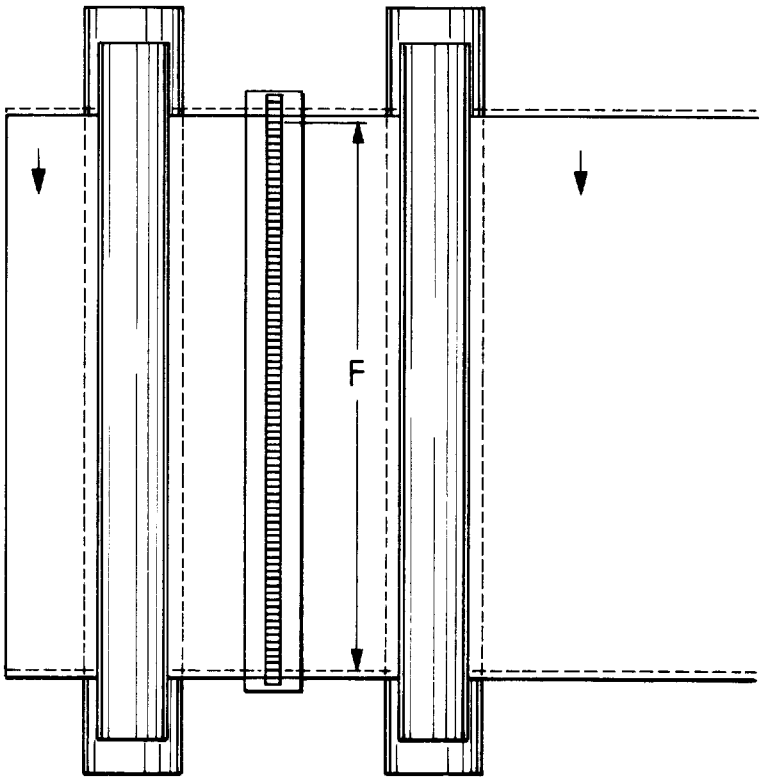
FIG. 51 is a plan view showing a relationship between a recording head and a sheet material in an image recording apparatus shown in FIG. 49.
Figure 52:
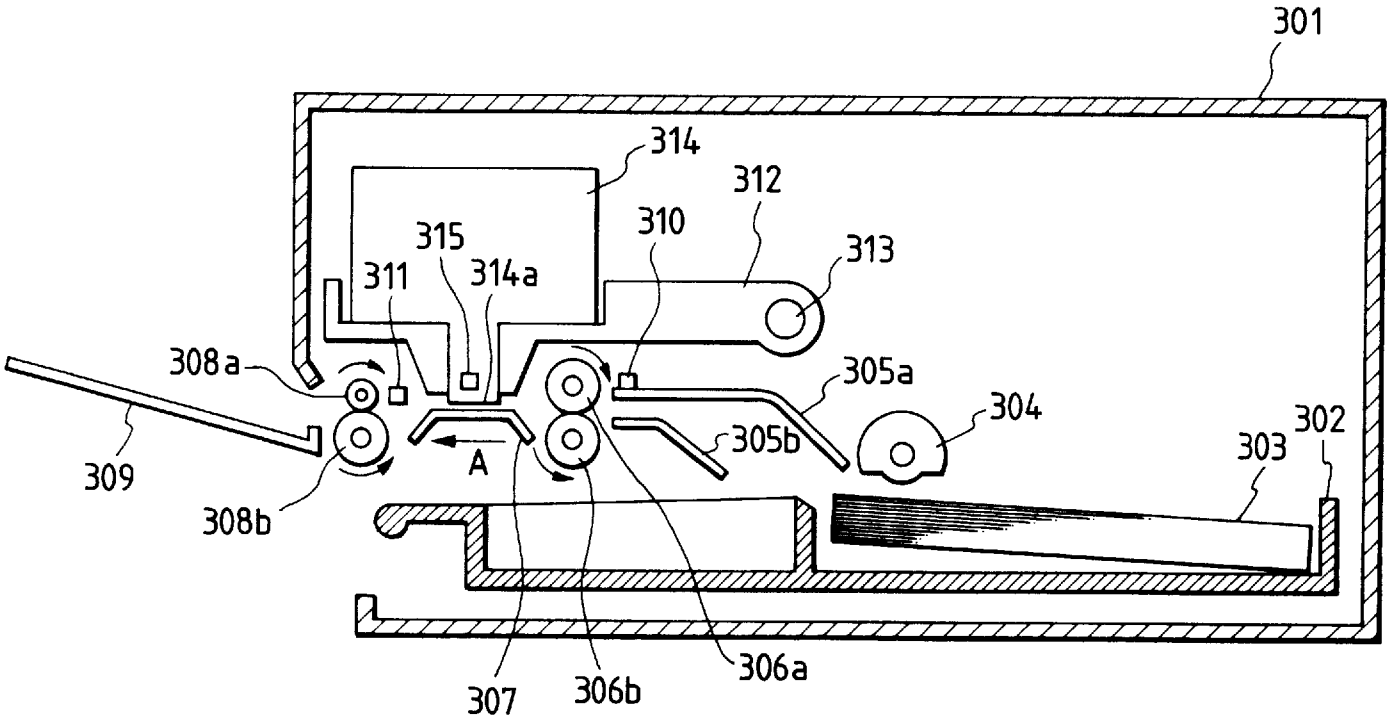
FIG. 52 is a cross-sectional view of an apparatus according to the present invention.

A ninth embodiment of the present invention will now be described with reference to FIGS. 51–53. In this embodiment, the recording head 104 is fixed to the body during the recording operation, and there are (m+6) nozzles of the injecting elements perpendicular to the paper feeding direction. During the sheet member 102 being continuously conveyed on the platen 106 by the conveying rollers 107, 108 and the tension rollers 112, 113, the recording operation is carried out by the m nozzles of the injecting elements of the E portion with a width of m×p (pitch between the injecting elements) as shown in FIG. 52. At this time, when the sheet member 102 is deviated in the direction (shown by the arrow) perpendicular to the paper feeding direction due to curling thereof, etc., before being conveyed by the conveying rollers 107 and 108, this deviation is detected by a position sensor (not shown) to change the injecting elements to be used for the recording to m nozzles of the F portion. Although the shifted amount is equivalent to only one nozzle in FIG. 53, it is possible to vary the amount to be shifted in accordance with the detected value to perform the recording on the center of the sheet member 102.

As described above, by providing the injecting elements in a number larger than that of the injecting elements equivalent to the recording width, it is possible to select the injecting elements to be used for the recording in accordance with the state of the recording medium, and to perform highly accurate recording by changing the recording position when the end portion of the sheet member is recorded.

In this manner, according to the present invention, a proper recording operation can be applied even to the sheet end portion, enabling a highly accurate image combination.

Next, an embodiment in which the floating of the recording member at the recording area is prevented to achieve high-grade recording will now be described.

Figure 54:
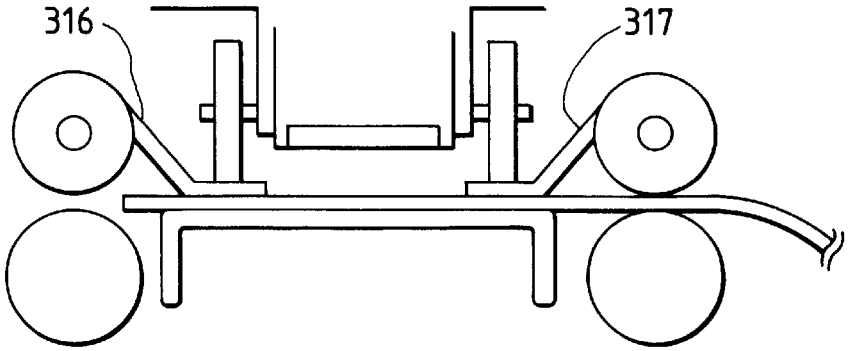
FIG. 54 is a cross-sectional view showing a state in which a pressing member and a recording paper are pressed by a carriage of the present invention.

FIG. 54 is a cross-sectional view showing a tenth embodiment of the ink jet recording apparatus according to the present invention.

As shown in FIG. 52, a recording medium such as a coated paper cut out in a predetermined magnitude or a clear sheet for OHP paper is contained in a cassette 302 which is removably mounted on the bottom portion of the body 301. A pick-up roller 304 is provided above one end of the recording medium 303, and two guide plates 305*a*, 305*b* are provided in the vicinity of the pick-up roller 304. At the left-hand side of two guide plates 305*a*, 305*b*, a pair of paper feeding rollers 306*a*, 306*b* as a paper feeding means and a pair of paper discharging rollers 308*a*, 308*b* are arranged in order. The conveying means is composed of these paper feeding means and paper discharging means. At the left-hand side of the pair of paper discharging rollers 308*a*, 308*b*, a paper discharging tray 309 is removably mounted to project externally from the body 301. On the guide plate 305*a*, a paper feeding sensor 310 is disposed in the vicinity of the paper feeding roller 306*a*. On the other hand, a paper discharging sensor 311 is disposed at a position near the right hand side of the paper discharging roller 308*a*. Each of the paper feeding sensor 310 and the paper discharging sensor 311 is composed of a type in which a reflecting light from the recording medium 303 is read by a reflection type photosensor provided against the recording medium and a type in which the shift of a movable lever in contact with the recording medium 30 is detected by a photosensor or a microswitch. Though not shown, directly near the paper discharging tray 309 side of the paper discharging roller 308*a*, a movable lever of the paper discharging sensor 311 is provided for detecting the rear end of the recording medium inserted through the paper discharging tray 309 in the case of a manually inserting mode as described later.

The carriage 312 is slidably coupled to a guide shaft 313 provided on the body 301 parallel to the paper feeding roller 306*a*, and reciprocally moved in the paper width direction (arrow B direction and its reverse direction) perpendicular to the conveying direction (arrow A direction) in which the recording medium 303 is on the platen. The carriage 312 has a recording head 314 removably provided thereon for ejecting ink from an ejecting opening (not shown) to perform recording. The ejecting surface 314*a* on which the ejecting opening 314*a* is opened is opposed to the platen 7 with a predetermined gap (e.g., 0.75 mm) therebetween. Just near the ejecting opening surface 314*a*, a paper width sensor 315 is provided on the carriage 312, composed of a reflection type photosensor for emitting light and reading the amount of reflected light. On a part of the path of the emitted light from the paper width sensor 315 on the platen, a silver plate 316 having a nickel-plated coating thereon for increasing the amount of reflecting light is provided. The other surface of the platen 307 is zinc-plated in black color for reducing the reflecting light amount. The paper width sensor 315 and the ejecting opening of the recording head 314 are separated by a distance equal to the distance between the rear end of the recording medium 303 and the rear end of the recordable area in the leading/rear end mode in the conveying direction.

Next, the operation when the recording medium 303 is conveyed will now be described. The recording medium 303 is fed between the two guide plates 305*a*, 305*b*, and its rear end reaches nip portions of a pair of paper feeding rollers 306*a*, 306*b*. Thereafter, the recording medium 303 is held and conveyed between the paper feeding rollers 306*a* and 306*b* rotating in the arrow direction in FIG. 53 so as to be fed in the conveying direction (arrow A direction) along the platen 307. The recording medium having passed through the platen 307 is then held and conveyed between the paper discharging rollers 308*a* and 308*b* rotating in the arrow direction in FIG. 52 in synchronicity with the paper feeding rollers 306*a* and 306*b* and discharged to the paper discharging tray 309. The recording head 314 is moved by the carriage 312 and performs recording on the recording medium 303 on the platen 307. Further, in the case of a manual inserting recording operation, the recording medium is inserted along the discharging tray 309 and when it reaches the nip portions of the paper discharging rollers 308*a* and 308*b*, they are sensed by the movable lever (not shown) of the paper discharging sensor 311, and the paper discharging rollers 308*a* and 308*b* rotate in the reverse direction of that of the arrow (FIG. 52), thereby feeding the recording medium 303 by a predetermined amount along the platen 307 in the reverse direction of the arrow A direction. At this time, the paper feeding rollers 306*a* and 306*b* also rotate in synchronicity with the paper discharging rollers 308*a* and 308*b* in the reverse direction of the arrow direction (FIG. 52). After the recording medium 303 is fed to a predetermined position, the recording medium 303 will be conveyed in the arrow A direction in accordance with the recording operation by the recording head 314 and then discharged on the paper discharging tray 309.

Figure 53:
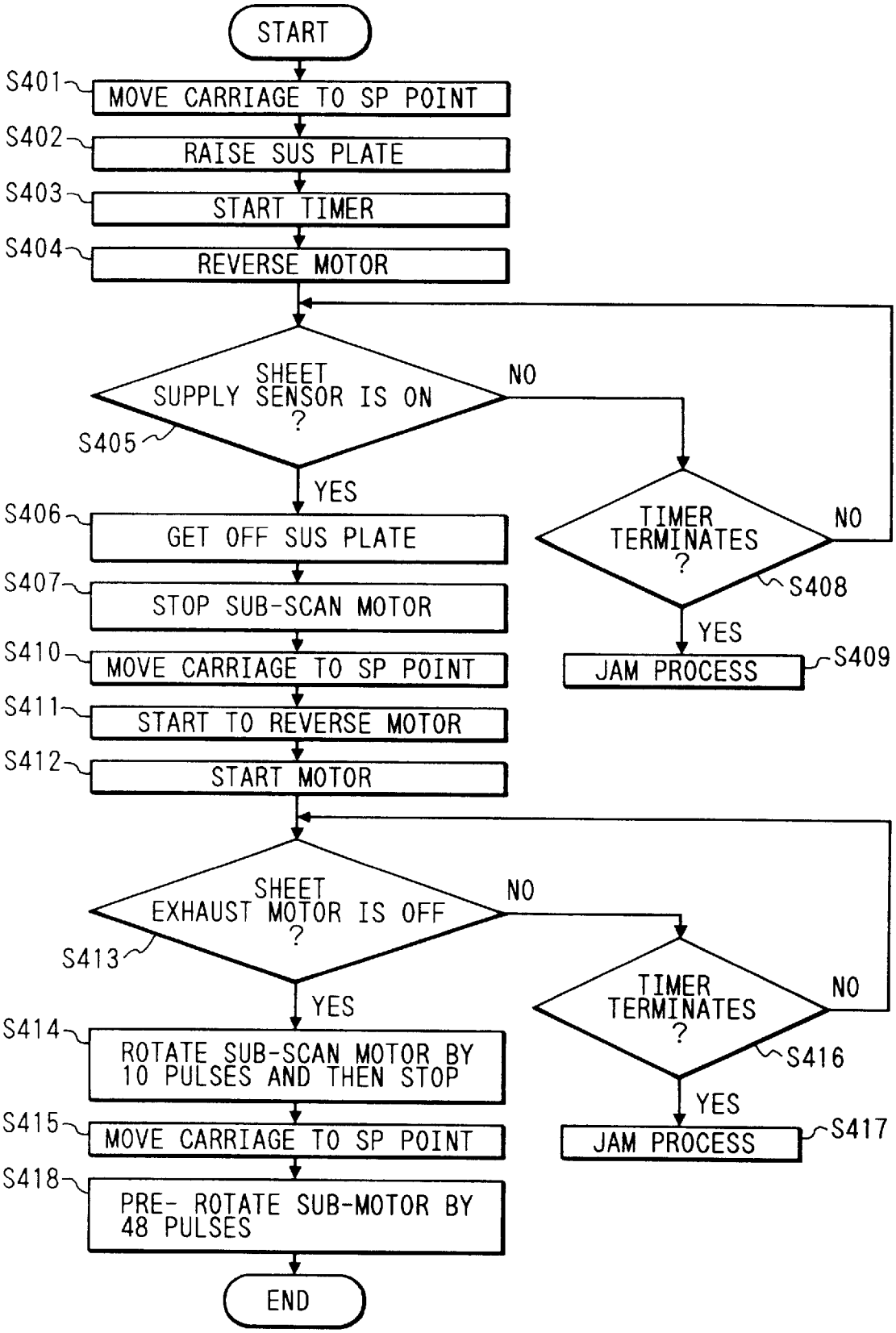
FIG. 53 is a flow diagram of a manual feeding operation according to the present invention.

FIG. 53 is a flow diagram of the operation of the ink jet recording apparatus in the case of a manual paper feeding. When the manual paper feeding starts, the SUS plate at the paper feeding side is moved up. Next, a sub-scanning motor is reversely rotated (the paper feeding roller and the paper discharging roller are reversely rotated).

Then, the turning on of the paper feeding sensor is checked and the SUS plate having been raised is lowered. If the paper feeding sensor does not turn on even after a predetermined time from the rotation start, a jamming process is taken.

Figure 56A:
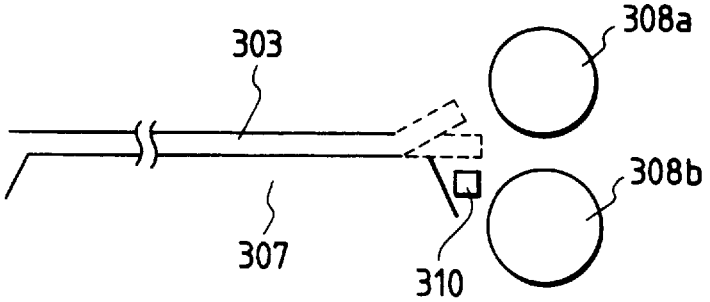
FIGS. 56A and 56B are diagrams for the explanation of a state of manual paper feeding.

When the paper feeding sensor is turned on, the rotation of both rollers are stopped. Next, the carriage shifts to the S position. As shown in FIG. 56, the base wheel of the carriage presses both pressing members of the paper feeding and paper discharging sides.

After the carriage is stopped at the S position, the sub-scanning motor (paper feeding roller and the paper discharging roller) rotates reversely. This rotation continues until the paper discharging sensor turns off. If the paper discharging sensor does not turn off even after a predetermined time has passed, the jamming process is taken.

When the paper discharging sensor is turned off, both rollers are stopped at 10 pulses and the carriage moves to the SP position. When the carriage stops at the SP position, the sub-motor will be rotated for 48 pulses for the paper feeding, thereby finishing the paper feeding operation.

Figure 56B:
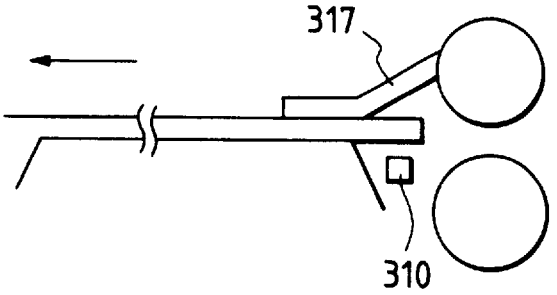

The SUS plate (pressing member) 317 (FIG. 56B; arrow indicates conveyance direction of sheet at the paper feeding side is raised and lowered by a solenoid. This solenoid is used in common with the paper feeding solenoid for controlling the pick-up roller.

Figure 55A:
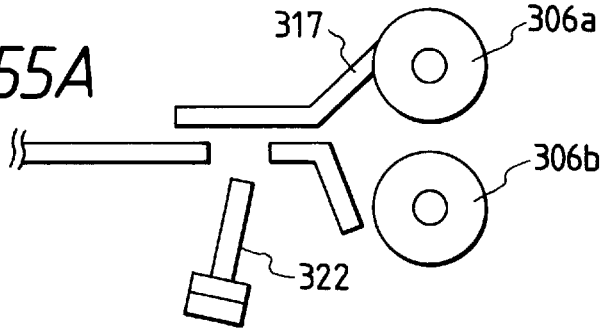
FIGS. 55A to 55C are diagrams for the explanation of a SUS plate up mechanism according to the present invention.
Figure 55B:
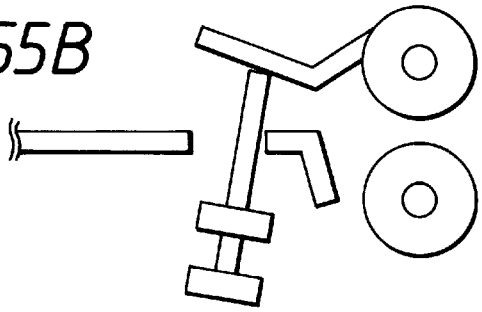
Figure 55C:
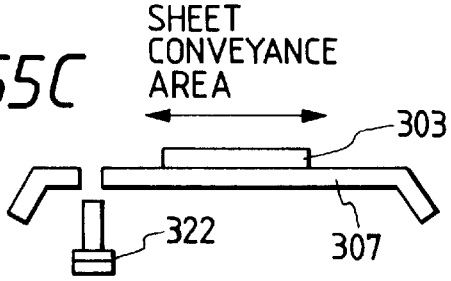

As shown in FIGS. 55A–55C, a hole is formed on the platen at a position slightly separated from the position through which the paper passes. Therefore, when the solenoid functions, the lever is raised from the lower side of the platen upwardly. The SUS plate can be raised to a sufficient height by this lever.

To lower the SUS plate, the solenoid is turned off to lower the lever, thereby the SUS plate naturally comes down on the platen.

FIG. 55A is a drawing for the explanation of the state when the paper feeding solenoid is turned off (normal state). FIG. 55B is a drawing for the explanation of the state when the paper feeding solenoid is turned on (the lever is raised). FIG. 55C is a drawing for the explanation of the SUS plate up lever hole and the paper feeding area.

After the carriage is shifted to the S point in step S410, the sub-motor is driven to continue the paper feeding operation, for the purpose of enhancing the accuracy for detecting the paper end by the paper discharging sensor in step S411. This is the key point of this embodiment.

By pressing the paper on the platen through the SUS plate by the carriage as shown in FIG. 55B, the detecting timing by the paper discharging sensor can be improved to accurately position the paper in the manual feeding mode.

The state in which the paper feeding sensor is turned on and the SUS plate comes down (step S406 in the flow diagram in FIG. 53) signifies that when the sensor is turned on, it can be ascertained that the rear end side of the paper is completely entered below the SUS plate at the paper feeding roller side, according to the composition of this invention.

Figure 57:
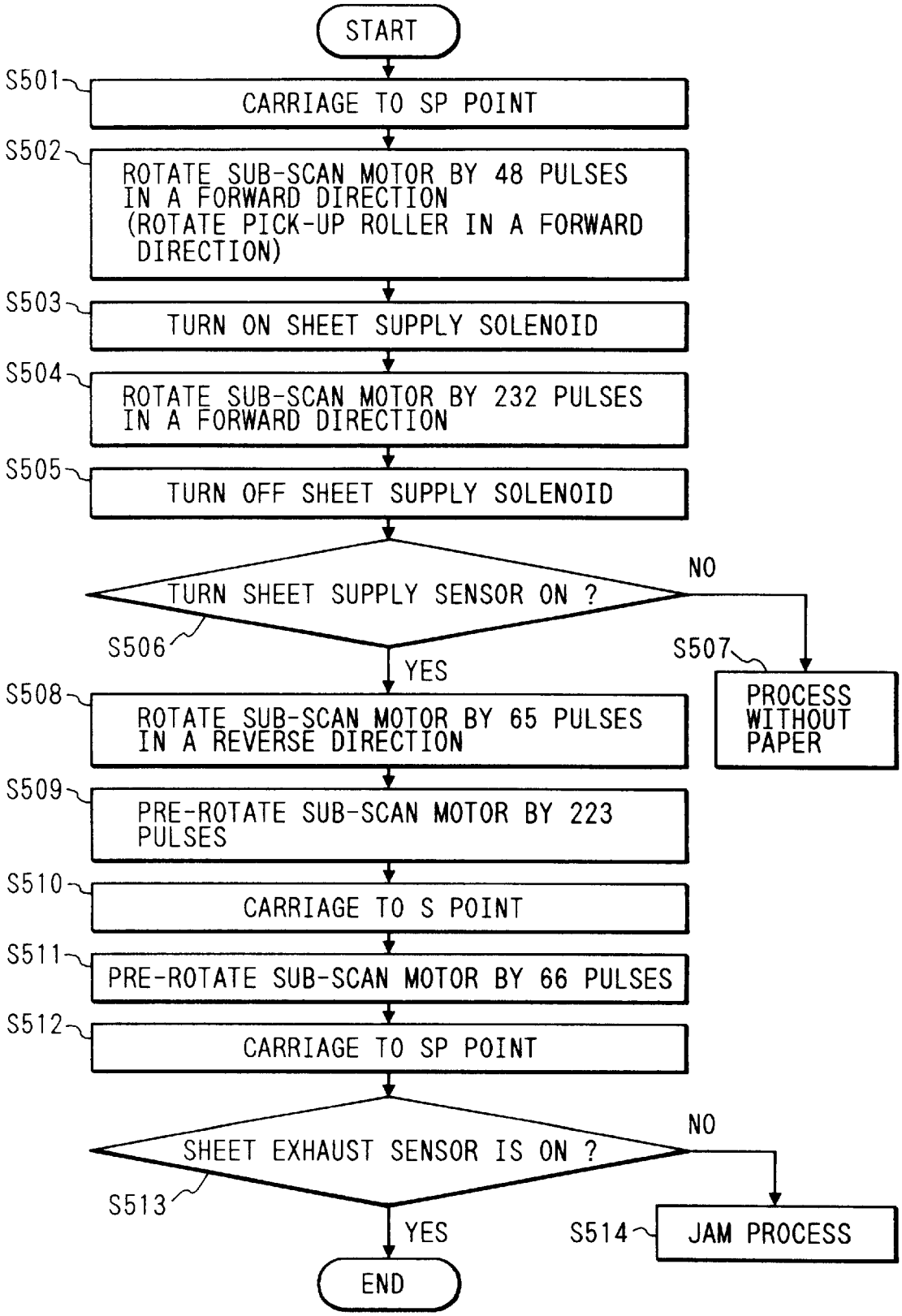
FIG. 57 is a flow diagram of a paper feeding operation in an RHS mode according to the present invention.

FIG. 57 is a flow diagram of the paper feeding operation in RHS mode. In response to the paper feeding order, the carriage shifts to the SP point in step S501, and in step S502 the sub-motor is rotated for 48 pulses. In step S503, the paper feeding solenoid is turned on, and in step S504, the sub-scan motor is rotated for 232 pulses. In step S505, the paper feeding solenoid is turned off, and in step S506, the presence of the paper is checked by the paper feeding sensor. In step S508, the sub-motor is reversely rotated for 65 pulses, and in step S509 (aimed at diagonal travel), the sub-motor is forwardly rotated by 223 pulses, and in step S510, the carriage moves to the S point.

After the shifting of the carriage to the S point, the SUS plate is in a state of pressing the paper. In step S511, the sub-scan motor is rotated forwardly for 66 pulses. After this operation, the rear end of the paper is entered into the paper discharging rollers. In step S512, the carriage shifts to the SP point. In step S513, the paper discharging sensor checks the presence or absence of the paper.

If the paper is present, the paper feeding operation is completed.

Figure 58:
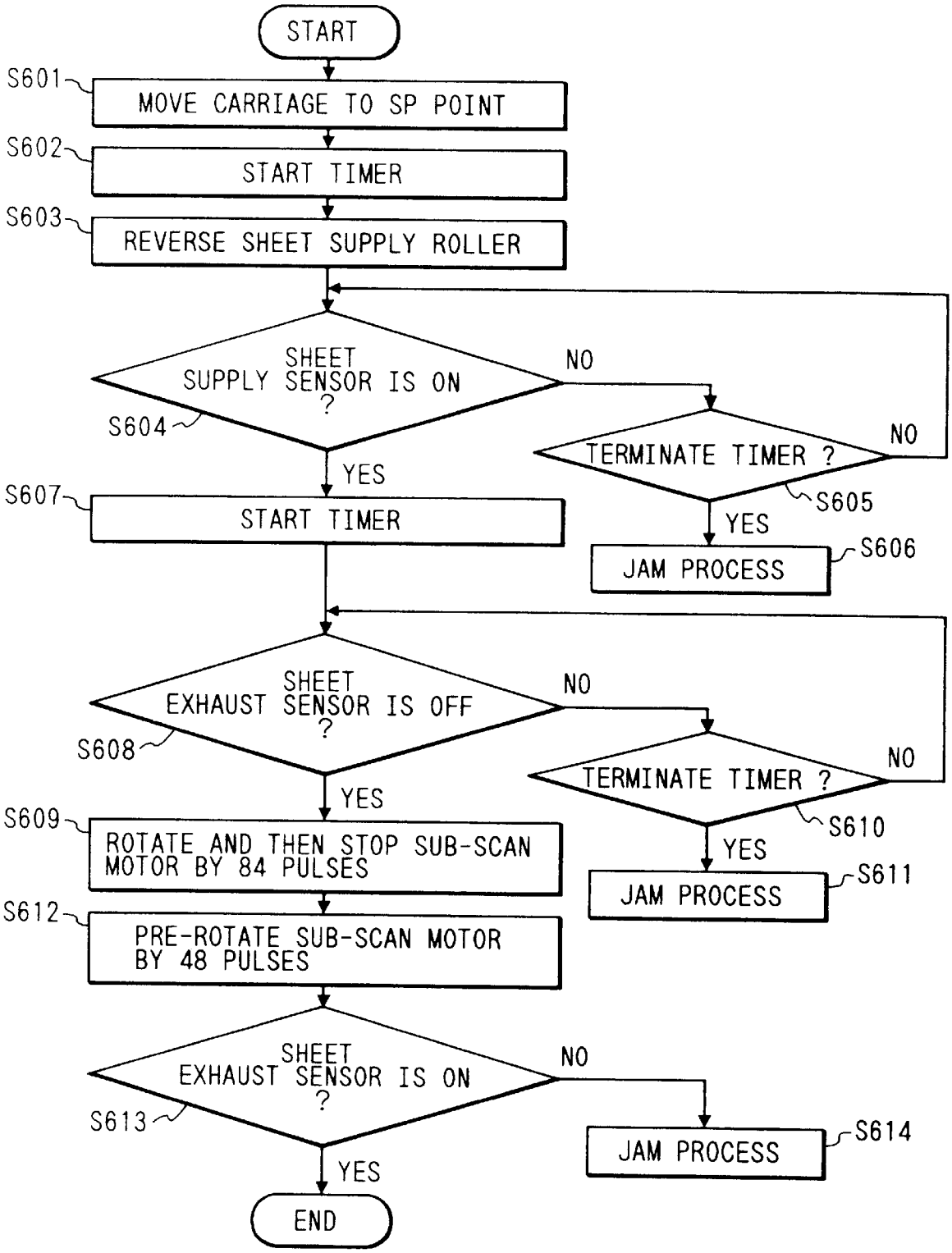
FIG. 58 is a flow diagram of a paper feeding operation in an OHP mode according to the present invention.

FIG. 58 shows the OHP paper feeding mode.

Figure 59:
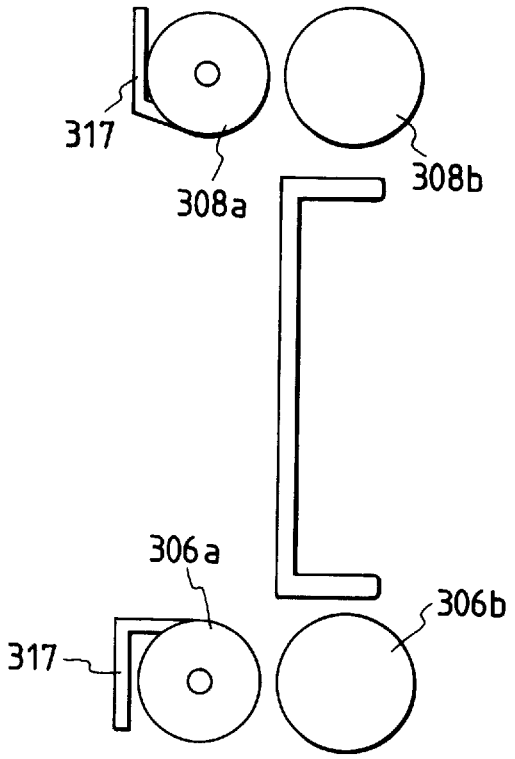
FIG. 59 is a diagram showing a state of the pressing member at the time of an OHP mode according to the present invention.

The OHP paper feeding mode according to the present invention consists of only the manual paper feeding mode. In the case of the OHP mode, both pressing members 316 and 317 at the paper discharging side and the paper feeding side are in a state as shown in FIG. 59. Further, the space between the paper discharging rollers 308*a* and 308*b* is increased.

Therefore, the control operation in the OHP manual paper feeding is different from that in the coated paper feeding.

When the OHP manual paper feeding starts, in step S601, the carriage shifts to the SP point. In step S602, the timer starts and the sub-scan motor is reversely rotated. In step S304, it is checked whether the paper feeding sensor is turned on or off. In the case of being turned off, a state of "wait" is taken to check the sensor. After finishing the timer operation, the jamming process starts.

In the case of being turned on of the paper feeding sensor, in step S607, the timer is restarted and in step S608 it is checked whether the paper discharging sensor is turned off.

The checking operation performed until the sensor is turned off is carried out in the same manner as in the case of the paper feeding sensor.

When the paper feeding sensor is turned off, the subscan motor is rotated for 84 pulses and then stopped, and thereafter, the sub-motor is forwardly rotated by 48 pulses to advance the paper. Then, it is checked if the paper discharging sensor is turned on. If the sensor is turned on, the paper feeding operation is completed.

In the OHP manual paper feeding mode, such a control as feeding the paper while pressing the SUS plate by the carriage is not performed due to the following reasons:

1. No SUS plate (pressing member) is on the platen; and
2. The distance between the pair of the paper discharging rollers is larger than that in the case of coated paper.

Figure 60:
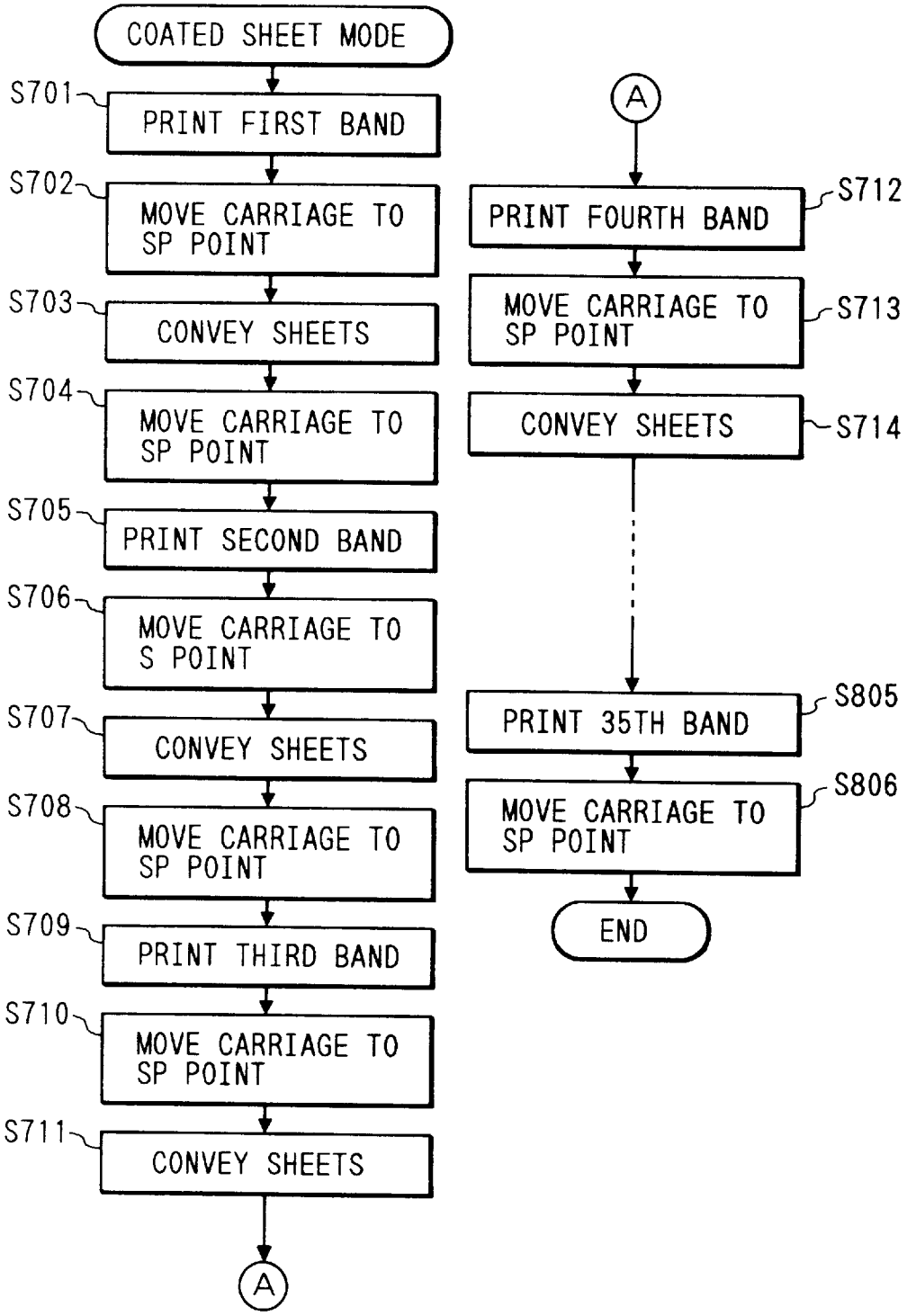
FIG. 60 is a flow diagram of a printing mode of a coated paper according to the present invention.

FIG. 60 is a controlling flow diagram for the printing operation in the coated paper mode. In step S701, the first band is printed. In step S702, the carriage shifts to the S point. In step S703, the paper is conveyed.

Figure 61:
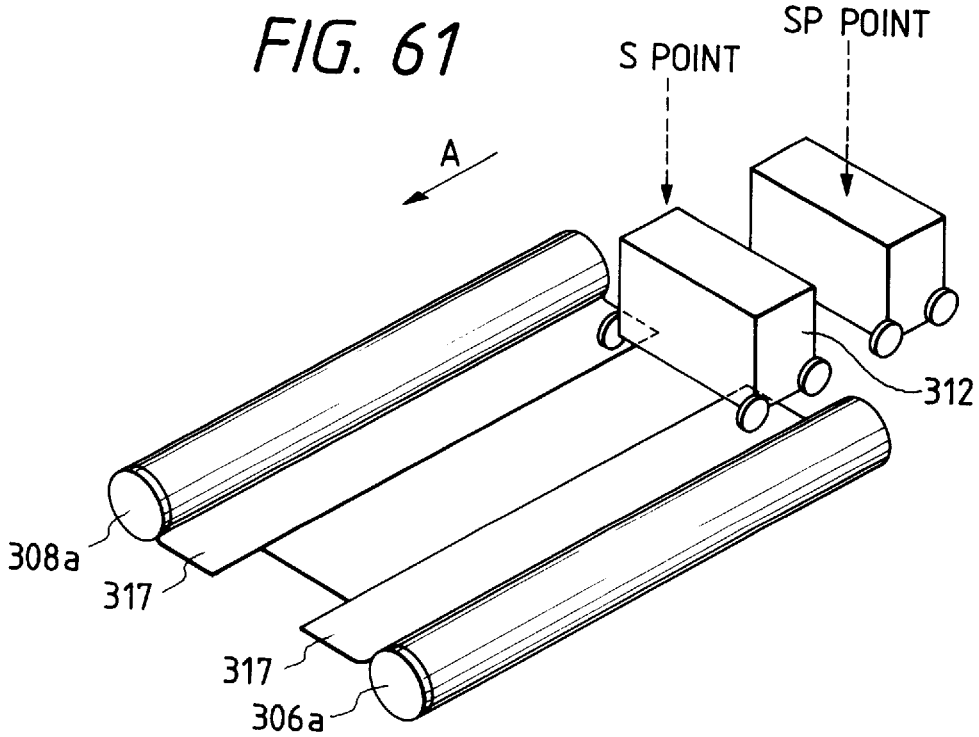
FIG. 61 is a perspective view showing a state in which a pressing member and a recording paper are pressed by a carriage of the present invention.

Namely, as shown in FIG. 61, the paper on the platen is conveyed while being pressed by the carriage through the SUS plate. In step S704, the carriage shifts to the SP point for the subsequent printing operation. The SP point is the starting position of the printing operation. The operations of the steps S705–S708 are for the printing of the second band in the same manner as that in the first band.

After the third band (including the third band), the controlling operation will be somewhat changed. In step S709, the third band is printed, and in step S710 the carriage shifts to the SP point. In step S711, the paper is conveyed.

Since the rear end of the paper enters into the pair of the paper discharging rollers at the second paper feeding, the paper feeding operation after and including the third paper feeding is carried out with the carriage stopped at the SP point.

Thereafter, a printing operation for 35 bands are performed until step S106.

In the case of A4 size paper, the printing operation is carried out for 35 bands.

Figure 62:
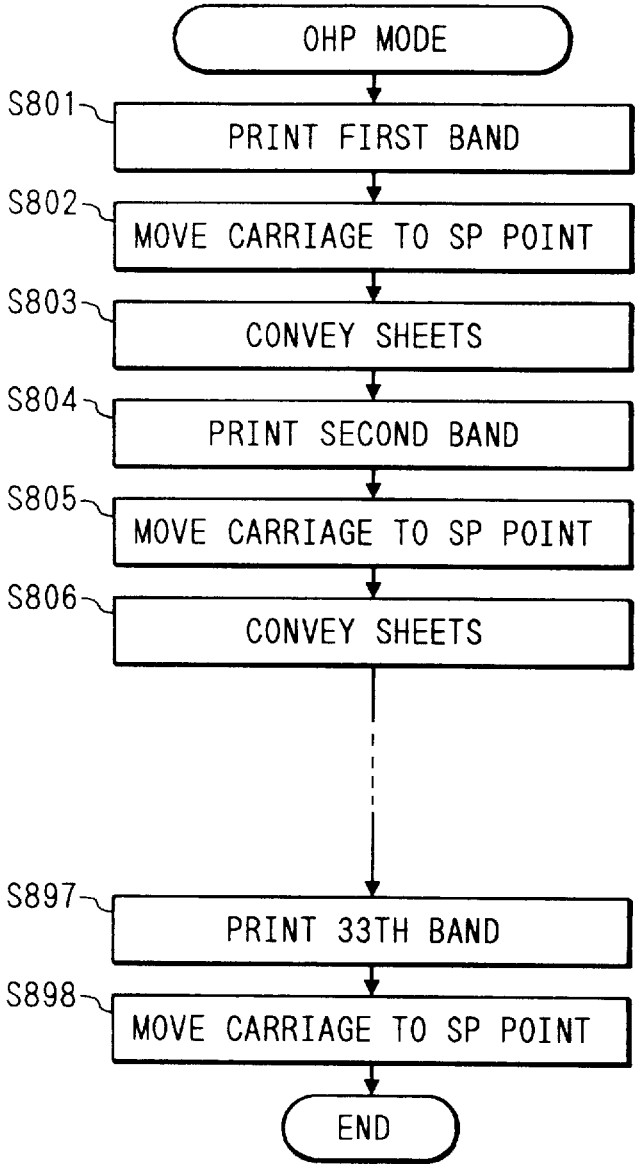
FIG. 62 is a flow diagram of a printing mode of OHP 1 according to the present invention.

FIG. 62 shows an OHP printing mode.

The OHP printing control differs from the coated paper printing mode in the carriage operation for the first and the second bands. In step S801, the first band is printed while in step S802, the carriage is shifted to the SP point. In step S803, the paper is conveyed.

The amount for paper feeding is 8 mm, being the printing width for one band. In step S804, the second band is printed.

Likewise, the printing operation is carried out for 33 bands. This is the printing operation for OHP paper of A4 size.

In the case of the OHP mode, the SUS plate is composed as shown in FIG. 59. Therefore, such a printing control operation as stopping the carriage at the S point as in the coated paper mode for feeding the paper being in printing is not carried out.

Figure 63:
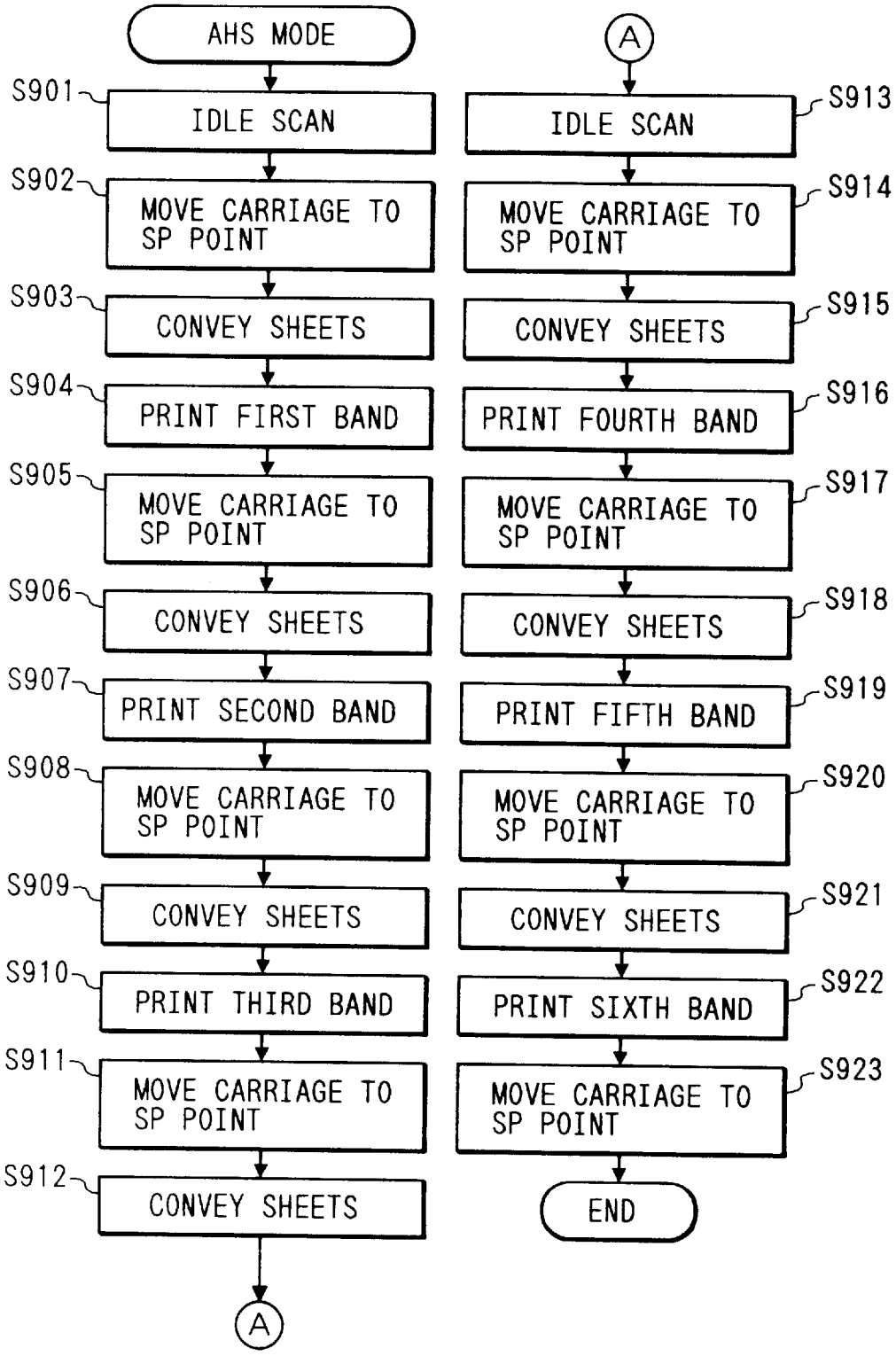
FIG. 63 is a flow diagram of a printing mode of RHS according to the present invention.

FIG. 63 shows a controlling flow diagram in the RHS printing mode. In step S901, the carriage advances to a predetermined position. No printing is done. In step S902, the carriage moves to the SP point. In step S903, the paper is conveyed. The paper feeding amount is approximately 8 mm. In step S904, the printing operation is carried out for the first band. In step S905, the carriage shifts to the SP point. In step S906, the paper is conveyed. The operations of the steps S907–S909 and S910–S912 for the second and third bands respectively are the same as those of the steps S904–S906.

The operations of the steps S913–S923 are repeated of the aforementioned operations. The carriage executes eight times of the scanning operation in total.

The eight times of the scanning operations can be broken as follows: one time of empty scan; continuous printing for three bands; one time of empty scan; and continuous printing for three bands, and thereafter the RHS mode terminates.

In the case of the RHS printing mode, on entering the printing mode, the rear end of the paper enters between the discharging paper rollers.

Therefore, it is impossible that the carriage stops at the S point on conveying the paper in the coated paper mode.

Figure 64:
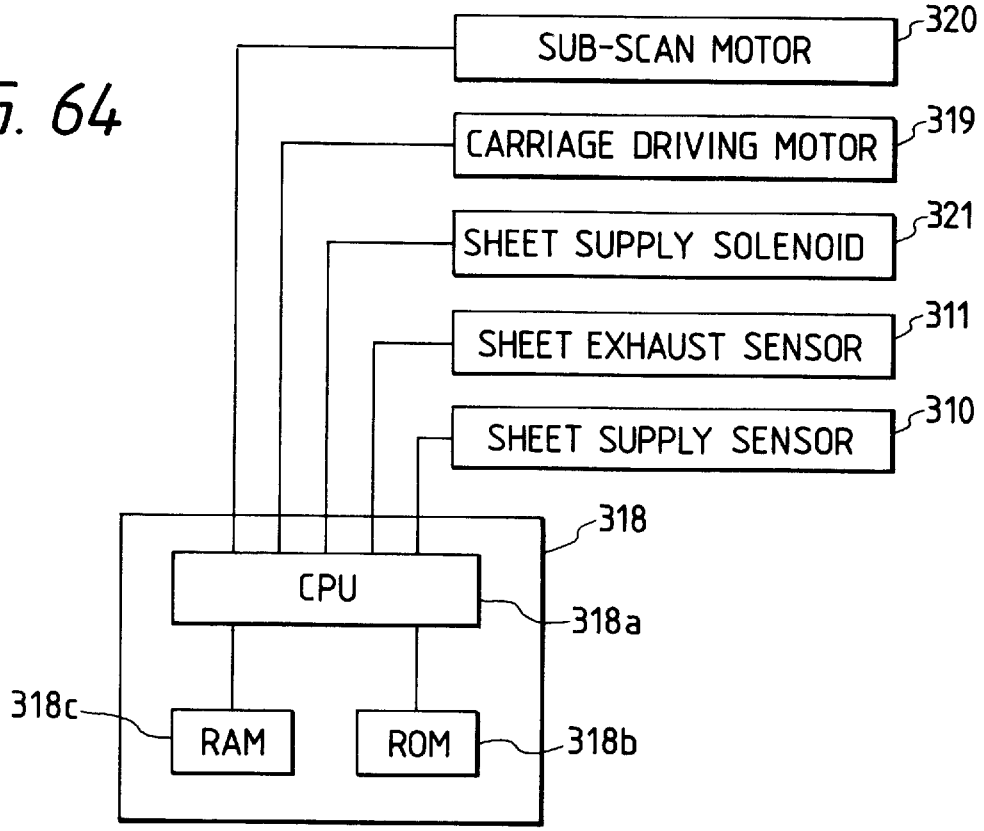
FIG. 64 is a block diagram showing a controlling operation of the present invention.

FIG. 64 is a block diagram of the controlling system of the present invention.

The control section 318 comprises a CPU 318*a* for executing the processes of the above-mentioned embodiments, a ROM 318*b* for storing fixed data such as programs corresponding to the process, and a RAM 318*c* for working.

Further, the carriage driving motor 319 comprises a paper feeding motor and a paper discharging roller, a sub-scan motor 320 for driving the pick-up roller, a paper feeding solenoid 321, a paper feeding sensor 310 and a paper discharging sensor.

In the tenth embodiment, the SUS plate may be used to press the paper also when two images are printed on a single paper and when a paper is transported between two printing areas, in addition to the paper feeding operation before and in the printing operation.

Further, as shown in FIG. 61, the position where the carriage stops on the SUS plate is only one S point. But if the paper size or position to be supplied is changed, the carriage stopping position on the SUS plate can be changed in accordance therewith (alternatively the force to press the SUS plate may be changed).

For example, the present invention can be applied, in addition to A4 size, also to A5 size and A6 size for recording operations.

The force and position of the pressing member, therefore, can be changed in accordance with the paper size or position on the platen.

Figure 65A:
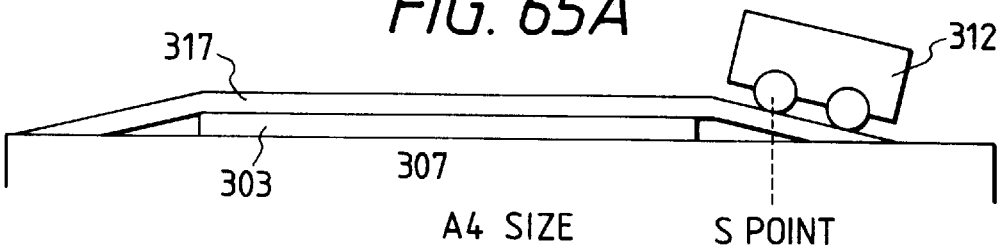
FIGS. 65A and 65B are diagrams for the explanation of a third embodiment according to the present invention.

FIG. 65A is a diagram for the explanation of the above operation. In this cross-sectional view, it is shown that the SUS plate (pressing member) 317 is pressed by the wheels of the carriage 312, and using this pressing force, the SUS plate holds the recording paper.

Figure 65B:
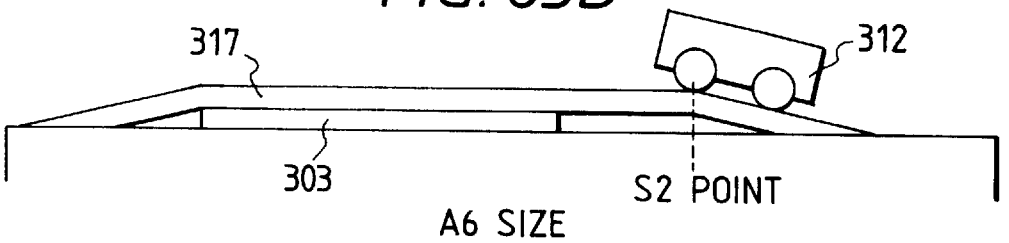

FIG. 65B shows a case of feeding a paper of A6 size.

Since the whole paper is deviated toward the left-hand side, it is preferable to hold the paper at the point S2 at the left side of the point S. Thus, the position to hold the paper by the carriage can be effectively changed in accordance with the paper size.

As explained above, the following advantages can be obtained:

(1) The paper is prevented from floating on the platen by holding the pressing member by the carriage on conveying the paper, so as to provide a desirable image; and (2) In the case of manual paper feeding, an undesirable jamming effect can be avoided by raising or lowering the pressing member at the paper feeding side by the solenoid.

What is claimed is:

1. An image recording apparatus for recording with a recording head on a recording medium conveyed by a platen located opposite to said recording head, said apparatus comprising:

paper width detecting means for detecting a width of the recording medium after it is conveyed to a predetermined position on the platen and for outputting a signal representative of the width;

determining means for determining a positional deviated amount of the recording medium, the recording medium having been conveyed on the platen, on the basis of the signal from said paper width detecting means; and controlling means for controlling the recording on the recording medium, wherein when the positional deviated amount is less than a predetermined amount, said controlling means controls the recording position on the recording medium on the basis of the positional deviated amount so as to record an image at a proper position on the recording medium, and when the deviated amount is more than the predetermined amount, said controlling means prohibits recording.

2. An image recording apparatus according to claim 1, wherein said paper width detecting means comprises means for detecting a presence or absence of the recording medium within a recordable area of a recording head.

3. An image recording apparatus according to claim 1, wherein said paper width detecting means comprises means for detecting a presence or absence of the recording medium by moving in a direction perpendicular to the conveying direction of the recording medium.

4. An image recording apparatus according to any of claims 1 or 2, wherein said paper width detecting means comprises a first paper width sensor and a second paper width sensor, each for detecting a presence or absence of the recording medium at different respective positions with respect to the conveying direction of the recording medium, and wherein said determining means determines the conveyed state of the recording medium on the basis of output signals from said first paper width sensor and said second paper width sensor.

5. An image recording apparatus according to any of claims 1 through 3, wherein said recording head is an ink jet recording head for discharging ink by using thermal energy.

6. An image recording apparatus according to claim 1, wherein said controlling means comprises prohibiting means for prohibiting the recording operation on the recording medium when the respective positional deviated amounts corresponding to said first paper width sensor and said second paper width sensor are different.

7. An image recording apparatus for recording with a recording head on a recording medium, a recording area and a non-recording area being adjacent the recording area being located at a front end or a rear end of the recording medium along a direction across a conveying direction of the recording medium to be conveyed, said apparatus comprising:

a carriage for moving said recording head in a direction across the conveying direction of the recording medium;

sheet width detecting means provided on said carriage for detecting the length of the recording medium in the direction across the conveying direction of the recording medium, wherein a position of a recording portion of said recording head for acting on the recording medium is spaced apart from a position of said sheet width detecting means in said carriage by a distance corresponding to the length of the recording medium at the non-recording area;

determining means for determining a positional deviated amount of the recording medium on the basis of the detection by said sheet width detecting means; and controlling means for controlling the recording on the recording medium, wherein when the positional deviated amount is less than a predetermined amount, said controlling means controls the recording position on the recording medium on the basis of the positional deviated amount so as to record an image at a proper position on the recording medium, and when the deviated amount is more than the predetermined amount, said controlling means prohibits recording.

8. An apparatus according to claim 7, wherein said recording head is an ink jet recording head for discharging ink from an ink discharge port.

9. An apparatus according to claim 8, wherein said record acting portion is the ink discharge port.

10. An apparatus according to claim 8, wherein said recording head is an ink jet recording head having an electrothermal converter for generating thermal energy for discharging ink.

11. A recording apparatus for recording with recording means on a recording medium located at a predetermined position on a platen, said apparatus comprising:

detecting means for detecting a position of the recording medium located at a platen area where said recording means is capable of recording and outputting a detection result indicating the position of the recording medium on said platen;

recognizing means for recognizing a deviated amount between the position of the recording medium on said platen and the position at the predetermined position in accordance with the detection result of said detecting means; and control means for controlling the recording by adjusting a recording position of the recording medium for recording when the deviated amount recognized by said recognizing means is less than a predetermined value, so that recording is performed at a position of the recording medium without the deviated amount, and for prohibiting recording when the deviated amount is more than the predetermined value.

12. A recording apparatus according to claim 11, further comprising paper width detecting means for detecting a width of the recording medium after the recording medium is conveyed to the predetermined position on the platen.

13. A recording apparatus according to claim 12, wherein said paper width detecting means comprises means for detecting a presence or absence of the recording medium within a recordable area of said recording means.

14. A recording apparatus according to claim 13, wherein said paper width detecting means comprises means for detecting a presence or absence of the recording medium by moving in a direction perpendicular to a conveyance direction of the recording medium.

15. A recording apparatus according to claim 14, wherein said paper width detecting means comprises a first paper width sensor and a second paper width sensor, each for detecting a presence or absence of the recording medium at different respective positions with respect to the conveyance direction of the recording medium.

16. A recording apparatus according to any of claims 11 through 15, wherein said recording means comprises an ink jet recording head for discharging ink by using thermal energy.

17. A recording apparatus for recording with recording means on a recording medium located at a predetermined position on a platen, said apparatus comprising:

a carriage for moving said recording means to a position, including the predetermined position, opposed to said platen;

detecting means movable with said carriage for detecting a position of the recording medium located at a platen area where said recording means is capable of recording and outputting a detection result indicating the position of the recording medium in a moving direction of said carriage on said platen;

recognizing means for recognizing a deviated amount between the position of the recording medium in the moving direction of said carriage on said platen and the position at the predetermined position in the moving direction of said carriage, in accordance with the detection result of said detecting means; and control means for performing recording by adjusting a recording position of the recording medium for recording when the deviated amount recognized by said recognizing means is less than a predetermined value, so that recording is performed at a position of the recording medium without the deviated amount, and for prohibiting recording when the deviated amount is more than the predetermined value.

18. A recording apparatus according to claim 17, further comprising paper width detecting means for detecting a width of the recording medium after the recording medium is conveyed to the predetermined position on the platen.

19. A recording apparatus according to claim 18, wherein said paper width detecting means comprises means for detecting a presence or absence of the recording medium within a recordable area of said recording means.

20. A recording apparatus according to claim 19, wherein said paper width detecting means comprises means for detecting a presence or absence of the recording medium by moving in a direction perpendicular to a conveyance direction of the recording medium.

21. A recording apparatus according to claim 20, wherein said paper width detecting means comprises a first paper width sensor and a second paper width sensor, each for detecting a presence or absence of the recording medium at different respective positions with respect to the conveyance direction of the recording medium.

22. A recording apparatus according to any of claims 17 through 21, wherein said recording means comprises an ink jet recording head for discharging ink by using thermal energy.

23. A recording method for recording with recording means on a recording medium located at a predetermined position on a platen, said method comprising:

moving the recording means to a position, including the predetermined position, opposed to the platen, using a carriage;

detecting, using detecting means movable with the carriage, a position of the recording medium located at a platen area where the recording means is capable of recording and outputting a detection result indicating the position of the recording medium in a moving direction of the carriage on the platen;

recognizing a deviated amount between the position of the recording medium in the moving direction of the carriage on the platen and the position at the predetermined position in the moving direction of the carriage, in accordance with the detection result of said detecting step; and controlling recording by adjusting a recording position of the recording medium for recording when the deviated amount recognized in said recognizing step is less than a predetermined value, so that recording is performed at a position of the recording medium without the deviated amount, and by prohibiting recording when the deviated amount is more than the predetermined value.

24. A recording method according to claim 23, further comprising detecting, using paper width detecting means, a width of the recording medium after the recording medium is conveyed to the predetermined position on the platen.

25. A recording method according to claim 24, further comprising detecting a presence or absence of the recording medium within a recordable area of the recording means, using the paper width detecting means.

26. A recording method according to claim 25, further comprising detecting a presence or absence of the recording medium by moving the paper width detecting means in a direction perpendicular to a conveyance direction of the recording medium.

27. A recording method according to claim 26, wherein the paper width detecting means comprises a first paper width sensor and a second paper width sensor, and further comprising detecting a presence or absence of the recording medium at different respective positions with respect to the conveyance direction of the recording medium, using the first and second paper width sensors.

28. A recording method according to any of claims 23 through 27, wherein the recording means comprises an ink jet recording head for discharging ink by using thermal energy.

29. An image recording apparatus for recording with a recording head on a recording medium conveyed by a platen located opposite to said recording head, said apparatus comprising:

paper width detecting means for detecting a width of the recording medium after the conveying means has conveyed the recording medium to a predetermined position on the platen and for outputting a signal representative of the width;

determining means for determining a positional deviated amount of the recording medium, the recording medium having been conveyed on the platen by the conveying means, on the basis of the signal from said paper width detecting means;

controlling means for controlling a recording position on the recording medium, wherein when the positional deviated amount is less than a predetermined amount, said controlling means controls the recording position on the recording medium on the basis of the positional deviated amount so as to record an image at a proper position on the recording medium; and prohibiting means for prohibiting a recording operation on the recording medium, said prohibiting means prohibiting the recording operation on the recording medium when the positional deviated amount exceeds the predetermined amount.

30. An image recording apparatus according to claim 29, wherein said paper width detecting means comprises means for detecting a presence or absence of the recording medium within a recordable area of a recording head.

31. An image recording apparatus according to claim 29, wherein said paper width detecting means comprises means for detecting a presence or absence of the recording medium by moving in a direction perpendicular to the conveying direction of the recording medium.

32. An image recording apparatus according to any of claims 29 through 31, wherein said paper width detecting means comprises a first paper width sensor and a second paper width sensor, each for detecting a presence or absence of the recording medium at different respective positions with respect to the conveying direction of the recording medium, and wherein said determining means determines the conveyed state of the recording medium on the basis of output signals from said first paper width sensor and said second paper width sensor.

33. An image recording apparatus according to any of claims 29 through 31, wherein said recording head is an ink jet recording head for discharging ink by using thermal energy.

* * * * *

UNITED STATES PATENT AND TRADEMARK OFFICE

CERTIFICATE OF CORRECTION

PATENT NO. : 5,870,114

DATED : February 9, 1999

INVENTOR(S) : YASUHIRO NUMATA, ET AL.

It is certified that error appears in the above-identified patent and that said Letters Patent is hereby corrected as shown below:

COVER PAGE [56] FOREIGN PATENT DOCUMENTS,
"452585 10/1991 European Pat. Off.", "61-041567 2/1986 Japan", and "3000275 1/1991 Japan" should be deleted.

COVER PAGE [57] ABSTRACT,
"An image recording apparatus for controlling an image recording operation on the basis of a detected width of a recording medium by a paper width detecting means after the recording medium is fed to a predetermined position on a platen. Whether the recording medium is desirably conveyed or not is determined on the basis of a signal obtained by said paper width detecting means."

should read

--An image recording apparatus having a platen and a conveying unit for conveying a recording medium in a conveying direction, including a paper width detecting unit for detecting a width of the recording medium after the conveying unit has conveyed the recording medium to a predetermined position on the platen and for outputting a signal representative of the width, a determining unit for determin-

UNITED STATES PATENT AND TRADEMARK OFFICE

CERTIFICATE OF CORRECTION

PATENT NO. : 5,870,114

DATED : February 9, 1999

INVENTOR(S) : YASUHIRO NUMATA, ET AL.

It is certified that error appears in the above-identified patent and that said Letters Patent is hereby corrected as shown below:

COVER PAGE [57] ABSTRACT (Cont.),
ing a conveyed state of the recording medium in accordance with the signal output by the paper width detecting unit, and a controlling unit for controlling an image recording operation in accordance with the signal output by the paper width detecting unit.--

COLUMN 1,
Line 33, "the" should be deleted.

COLUMN 9,
Line 10, "is judged" should be deleted;
Line 11 should be deleted;
Line 12 should be deleted; and
Line 13, "informed that no recording medium 3" should be deleted.

COLUMN 11,
Line 47, "n" should read --in--.

COLUMN 17,
Line 7, "is" should read --are--.

UNITED STATES PATENT AND TRADEMARK OFFICE

CERTIFICATE OF CORRECTION

PATENT NO. : 5,870,114

DATED : February 9, 1999

INVENTOR(S) : YASUHIRO NUMATA, ET AL.

It is certified that error appears in the above-identified patent and that said Letters Patent is hereby corrected as shown below:

COLUMN 19,
Insert Table I as follows:
--(1): Size of the sheet member
(2): Width of the sheet member
(3): Remaining amount after being conveyed 20mm
(4): Number of steps until the sensor detection
(5): Remaining amount at the sensor detection--.

COLUMN 21,
Line 4, "diagram" should read --diagrams--; and
Line 49, "waited," should read --awaited,--.

COLUMN 23,
Line 20, "waited" should read --awaited,--; and
Line 47, "tuned" should read --turned--.

COLUMN 25,
Line 33, "most upper" should read --uppermost--.

Signed and Sealed this

Sixteenth Day of November, 1999

*Attest:*

*Attesting Officer*

Q. TODD DICKINSON

*Acting Commissioner of Patents and Trademarks*